US007578866B2

(12) United States Patent
Kawase et al.

(10) Patent No.: US 7,578,866 B2
(45) Date of Patent: Aug. 25, 2009

(54) IRON-BASED SINTERED ALLOY HAVING EXCELLENT MACHINABILITY

(75) Inventors: Kinya Kawase, Niigata (JP); Yoshinari Ishii, Niigata (JP)

(73) Assignee: Mitsubishi Materials PMG Corporation, Nigata (JP)

( * ) Notice: Subject to any disclaimer, the term of this patent is extended or adjusted under 35 U.S.C. 154(b) by 495 days.

(21) Appl. No.: 10/548,677

(22) PCT Filed: Mar. 10, 2004

(86) PCT No.: PCT/JP2004/003094

§ 371 (c)(1),
(2), (4) Date: Sep. 8, 2005

(87) PCT Pub. No.: WO2004/081249

PCT Pub. Date: Sep. 23, 2004

(65) Prior Publication Data

US 2006/0198752 A1 Sep. 7, 2006

(30) Foreign Application Priority Data

Mar. 10, 2003 (JP) ..... 2003-062854

(51) Int. Cl.
*B22F 3/12* (2006.01)
*C22C 38/40* (2006.01)

(52) U.S. Cl. ..... 75/233; 75/246; 419/10

(58) Field of Classification Search ..... 75/231, 75/233, 246; 419/37, 38, 10
See application file for complete search history.

(56) References Cited

U.S. PATENT DOCUMENTS

| | | | | |
|---|---|---|---|---|
| 3,069,758 | A * | 12/1962 | Wulff | 428/564 |
| 5,525,293 | A * | 6/1996 | Kagawa et al. | 419/65 |
| 5,534,220 | A | 7/1996 | Purnell et al. | |
| 5,679,909 | A | 10/1997 | Kaneko et al. | |
| 6,264,718 | B1 * | 7/2001 | Akagi et al. | 75/246 |
| 6,436,338 | B1 * | 8/2002 | Qiao | 420/69 |

FOREIGN PATENT DOCUMENTS

| | | | |
|---|---|---|---|
| JP | 03-267354 | A | 11/1991 |
| JP | 7-505446 | A | 6/1995 |
| JP | 8-260113 | A | 10/1996 |
| JP | 2001-98291 | A | 4/2001 |
| SU | 1585069 | A1 | 8/1990 |
| SU | 1 724 436 | A1 | 4/1992 |
| WO | WO-93/19875 | A1 | 10/1993 |

OTHER PUBLICATIONS

International Search Report for PCT/JP2004/003094 mailed Jun. 22, 2004.

* cited by examiner

*Primary Examiner*—Roy King
*Assistant Examiner*—Ngoclan T Mai
(74) *Attorney, Agent, or Firm*—Darby & Darby P.C.

(57) ABSTRACT

This iron-based sintered alloy contains 0.05 to 3% by mass of calcium carbonate or 0.05 to 3% by mass of strontium carbonate. As a result, an iron-based sintered alloy having excellent machinability is obtained.

6 Claims, No Drawings

IRON-BASED SINTERED ALLOY HAVING EXCELLENT MACHINABILITY

CROSS-REFERENCE TO PRIOR APPLICATION

This is a U.S. national phase application under 35 U.S.C. §371 of International Patent Application No. PCT/JP2004/003094 filed Mar. 10, 2004, and claims the benefit of Japanese Patent Application No. 2003-62854 filed Mar. 10, 2003 which is incorporated by reference herein. The International Application published in Japanese on Sep. 23, 2004 as WO 2004/003094 A1 under PCT Article 21(2).

TECHNICAL FIELD

The present invention relates to an iron-based sintered alloy having excellent machinability which is used as materials for various machine components.

BACKGROUND ART

With the progress of a sintering technique, various electric components such as yoke and rotor, and various machine components such as pistons for shock absorber, rod guides, bearing caps, valve plates for compressor, hubs, forkshifts, sprockets, toothed wheels, gears and synchronizer hubs have recently been produced using an iron-based sintered alloy obtained by sintering a raw powder mixture. For example, it is known that an iron-based sintered alloy having the composition consisting of pure iron and 0.1 to 1.5% by mass of P, the balance being Fe and inevitable impurities, is used to produce various electric components such as yokes and rotors. It is known that an iron-based sintered alloy having the composition consisting of 0.1 to 1.2% by mass of C, the balance being Fe and inevitable impurities, is used to produce pistons for shock absorber, and lot guides. It is known that an iron-based sintered alloy having the composition consisting of 0.1 to 1.2% by mass of C and 10 to 25% by mass of Cu, the balance being Fe and inevitable impurities, is used to produce bearing caps, and valve plates for compressor. It is known that an iron-based sintered alloy having the composition consisting of 0.1 to 1.2% by mass of C and 0.1 to 6% by mass of Cu, the balance being Fe and inevitable impurities, is used to produce forkshifts, sprockets, gears, toothed wheels, and pistons for shock absorber. It is known that an iron-based sintered alloy having the composition consisting of 0.1 to 1.2% by mass of C, 0.1 to 6% by mass of Cu, 0.1 to 10% by mass of Ni and 0.1 to 6% by mass of Mo, the balance being Fe and inevitable impurities, is used to produce CL cranks, sprockets, gears, and toothed wheels.

It is known that an iron-based sintered alloy having the composition consisting of 0.1 to 1.2% by mass of C and 0.1 to 6% by mass of Mo, the balance being Fe and inevitable impurities, an iron-based sintered alloy having the composition consisting of 0.1 to 1.2% by mass of C, 0.1 to 10% by mass of Cr and 0.1 to 6% by mass of Mo, the balance being Fe and inevitable impurities, an iron-based sintered alloy having the composition consisting of 0.1 to 1.2% by mass of C, 0.1 to 10% by mass of Ni, 0.1 to 10% by mass of Cr and 0.1 to 6% by mass of Mo, the balance being Fe and inevitable impurities, an iron-based sintered alloy having the composition consisting of 0.1 to 1.2% by mass of C, 0.1 to 6% by mass of Cu, 0.1 to 10% by mass of Ni, 0.1 to 10% by mass of Cr and 0.1 to 6% by mass of Mo, the balance being Fe and inevitable impurities, an iron-based sintered alloy having the composition consisting of 0.1 to 1.2% by mass of C and 0.1 to 10% by mass of Ni, the balance being Fe and inevitable impurities, an iron-based sintered alloy having the composition consisting of 0.1 to 1.2% by mass of C, 0.1 to 10% by mass of Ni and 0.1 to 6% by mass of Mo, the balance being Fe and inevitable impurities, and an iron-based sintered alloy having the composition consisting of 0.1 to 1.2% by mass of C, 0.1 to 6% by mass of Cu and 0.1 to 10% by mass of Ni, the balance being Fe and inevitable impurities, are used as materials of various machine components such as sprockets, gears and toothed wheels.

Also it is known that an iron-based sintered alloy having the composition consisting of 1.0 to 3.0% by mass of C, 0.5 to 8% by mass of Cu and 0.1 to 0.8% by mass of P, the balance being Fe and inevitable impurities, are used as materials of valve guides.

Also it is known that an iron-based sintered alloy having the composition consisting of 0.3 to 2.5% by mass of C, 0.5 to 12% by mass of Cr, 0.3 to 9% by mass of Mo, 3 to 14% by mass of W and 1 to 6% by mass of V, the balance being Fe and inevitable impurities, an iron-based sintered alloy having the composition consisting of 0.3 to 2.5% by mass of C, 0.5 to 12% by mass of Cr, 0.3 to 9% by mass of Mo, 3 to 14% by mass of W, 1 to 6% by mass of V and 5 to 14% by mass of Co, the balance being Fe and inevitable impurities, an iron-based sintered alloy having the composition consisting of 0.3 to 2% by mass of C, 0.5 to 10% by mass of Cr, 0.3 to 16% by mass of Mo and 0.1 to 5% by mass of Ni, and one or more kinds selected from among 1 to 5% by mass of W, 0.05 to 1% by mass of Si, 0.5 to 18% by mass of Co and 0.05 to 2% by mass of Nb, the balance being Fe and inevitable impurities, an iron-based sintered alloy having the composition consisting of 0.3 to 2% by mass of C, 0.5 to 10% by mass of Cr, 0.3 to 16% by mass of Mo and 0.1 to 5% by mass of Ni, one or more kinds selected from among 1 to 5% by mass of W, 0.05 to 1% by mass of Si, 0.5 to 18% by mass of Co and 0.05 to 2% by mass of Nb, and 10 to 20% by mass of Cu, the balance being Fe and inevitable impurities, and an iron-based sintered alloy having the composition consisting of 0.3 to 2% by mass of C, 0.1 to 3% by mass of Mo, 0.05 to 5% by mass of Ni and 0.1 to 2% by mass of Co, the balance being Fe and inevitable impurities, are used as materials of valve seats.

Also it is known that an iron-based sintered alloy having the composition consisting of 15 to 27% by mass of Cr and 3 to 29% by mass of Ni, the balance being Fe and inevitable impurities, an iron-based sintered alloy having the composition consisting of one or more kinds selected from among 15 to 27% by mass of Cr, 3 to 29% by mass of Ni, 0.5 to 7% by mass of Mo and 0.5 to 4% by mass of Cu, the balance being Fe and inevitable impurities, an iron-based sintered alloy having the composition consisting of 10 to 33% by mass of Cr, the balance being Fe and inevitable impurities, an iron-based sintered alloy having the composition consisting of 10 to 33% by mass of Cr and 0.5 to 3% by mass of Mo, the balance being Fe and inevitable impurities, an iron-based sintered alloy having the composition consisting of 10 to 33% by mass of Cr and 0.5 to 3% by mass of Mo, the balance being Fe and inevitable impurities, an iron-based sintered alloy having the composition consisting of 10 to 19% by mass of Cr and 0.05 to 1.3% by mass of C, the balance being Fe and inevitable impurities, an iron-based sintered alloy having the composition consisting of 14 to 19% by mass of Cr and 2 to 8% by mass of Ni, the balance being Fe and inevitable impurities, and an iron-based sintered alloy having the composition consisting of 14 to 19% by mass of Cr and 2 to 8% by mass of Ni, and one or more kinds selected from among 2 to 6% by mass of Cu, 0.1 to 0.5% by mass of Nb and 0.5 to 1.5% by mass of Al, the balance being Fe and inevitable impurities, are used as materials of corrosion-resistant machine components.

Various machine components made of these conventional iron-based sintered alloys are produced by blending predetermined raw powders, mixing the powders and compacting the powder mixture to obtain a green compact, and sintering the resulting green compact in a vacuum, dissociated ammonia gas, $N_2$+5% $H_2$ gas mixture, endothermic gas or exothermic gas atmosphere, and are finally shipped after piercing the required position using a drill and cutting or grinding the surface. Machining such as piercing, cutting or grinding is conducted by using various cutting tools. When machine components have a lot of positions to be cut, cutting tools are drastically worn out, resulting in high cost. Therefore, there has been made a trial of suppressing wear of the cutting tool by a method of adding about 1% of a MnS or MnO powder and sintering the resulting green compact thereby to improve machinability of the cutting tool (see Japanese Patent Application, First Publication No. Hei 3-267354) or a method of adding a CaO—MgO—$SiO_2$-based complex oxide, thereby to improve machinability (see Japanese Patent Application, First Publication No. Hei 8-260113) of the cutting tool, and thus reducing the cost.

DISCLOSURE OF THE INVENTION

An iron-based sintered alloy obtained by adding a conventional MnS powder, MnO powder or CaO—MgO—$SiO_2$-based complex oxide powder and sintering the resulting green compact has machinability, which is improved to some extent, but is not still satisfactory. Therefore, it is required to develop an iron-based sintered alloy having more excellent machinability.

From such a point of view, the present inventors have intensively studied so as to obtain an iron-based sintered alloy having more excellent machinability, which can be used as materials of various electric and machine components. As a result, they have found that an iron-based sintered alloy containing 0.05 to 3% by mass of a calcium carbonate powder or an iron-based sintered alloy containing 0.05 to 3% by mass of a strontium carbonate powder has more improved machinability.

The present invention has been made based on such a finding and is characterized by the followings:

(1) an iron-based sintered alloy having excellent machinability, comprising 0.05 to 3% by mass of calcium carbonate, (2) an iron-based sintered alloy having excellent machinability with the composition consisting of 0.05 to 3% by mass of calcium carbonate, the balance being Fe and inevitable impurities, (3) an iron-based sintered alloy having excellent machinability with the composition consisting of 0.05 to 3% by mass of calcium carbonate and 0.1 to 1.5% by mass of P, the balance being Fe and inevitable impurities, (4) an iron-based sintered alloy having excellent machinability with the composition consisting of 0.05 to 3% by mass of calcium carbonate and 0.1 to 1.2% by mass of C, the balance being Fe and inevitable impurities, (5) an iron-based sintered alloy having excellent machinability with the composition consisting of 0.05 to 3% by mass of calcium carbonate, 0.1 to 1.2% by mass of C and 10 to 25% by mass of Cu, the balance being Fe and inevitable impurities, (6) an iron-based sintered alloy having excellent machinability with the composition consisting of 0.05 to 3% by mass of calcium carbonate, 0.1 to 1.2% by mass of C and 0.1 to 6% by mass of Cu, the balance being Fe and inevitable impurities, (7) an iron-based sintered alloy having excellent machinability with the composition consisting of 0.05 to 3% by mass of calcium carbonate, 0.1 to 1.2% by mass of C, 0.1 to 6% by mass of Cu, 0.1 to 10% by mass of Ni and 0.1 to 6% by mass of Mo, the balance being Fe and inevitable impurities, (8) an iron-based sintered alloy having excellent machinability with the composition consisting of 0.05 to 3% by mass of calcium carbonate, 0.1 to 1.2% by mass of C and 0.1 to 6% by mass of Mo, the balance being Fe and inevitable impurities, (9) an iron-based sintered alloy having excellent machinability with the composition consisting of 0.05 to 3% by mass of calcium carbonate, 0.1 to 1.2% by mass of C, 0.1 to 10% by mass of Cr and 0.1 to 6% by mass of Mo, the balance being Fe and inevitable impurities,

(10) an iron-based sintered alloy having excellent machinability with the composition consisting of 0.05 to 3% by mass of calcium carbonate, 0.1 to 1.2% by mass of C, 0.1 to 10% by mass of Ni, 0.1 to 10% by mass of Cr and 0.1 to 6% by mass of Mo, the balance being Fe and inevitable impurities,

(11) an iron-based sintered alloy having excellent machinability with the composition consisting of 0.05 to 3% by mass of calcium carbonate, 0.1 to 1.2% by mass of C, 0.1 to 6% by mass of Cu, 0.1 to 10% by mass of Ni, 0.1 to 10% by mass of Cr and 0.1 to 6% by mass of Mo, the balance being Fe and inevitable impurities,

(12) an iron-based sintered alloy having excellent machinability with the composition consisting of 0.05 to 3% by mass of calcium carbonate, 0.1 to 1.2% by mass of C and 0.1 to 10% by mass of Ni, the balance being Fe and inevitable impurities,

(13) an iron-based sintered alloy having excellent machinability with the composition consisting of 0.05 to 3% by mass of calcium carbonate, 0.1 to 1.2% by mass of C, 0.1 to 10% by mass of Ni and 0.1 to 6% by mass of Mo, the balance being Fe and inevitable impurities,

(14) an iron-based sintered alloy having excellent machinability with the composition consisting of 0.05 to 3% by mass of calcium carbonate, 0.1 to 1.2% by mass of C, 0.1 to 6% by mass of Cu and 0.1 to 10% by mass of Ni, the balance being Fe and inevitable impurities,

(15) an iron-based sintered alloy having excellent machinability with the composition consisting of 0.05 to 3% by mass of calcium carbonate, 1.0 to 3.0% by mass of C, 0.5 to 8% by mass of Cu and 0.1 to 0.8% by mass of P, the balance being Fe and inevitable impurities,

(16) an iron-based sintered alloy having excellent machinability with the composition consisting of 0.05 to 3% by mass of calcium carbonate, 0.3 to 2.5% by mass of C, 0.5 to 12% by mass of Cr, 0.3 to 9% by mass of Mo, 3 to 14% by mass of W and 1 to 6% by mass of V, the balance being Fe and inevitable impurities,

(17) an iron-based sintered alloy having excellent machinability with the composition consisting of 0.05 to 3% by mass of calcium carbonate, 0.3 to 2.5% by mass of C, 0.5 to 12% by mass of Cr, 0.3 to 9% by mass of Mo, 3 to 14% by mass of W, 1 to 6% by mass of V and 5 to 14% by mass of Co, the balance being Fe and inevitable impurities,

(18) an iron-based sintered alloy having excellent machinability with the composition consisting of 0.05 to 3% by mass of calcium carbonate, 0.3 to 2% by mass of C, 0.5 to 10% by mass of Cr, 0.3 to 16% by mass of Mo and 0.1 to 5% by mass of Ni, and one or more kinds selected from among 1 to 5% by mass of W, 0.05 to 1% by mass of Si, 0.5 to 18% by mass of Co and 0.05 to 2% by mass of Nb, the balance being Fe and inevitable impurities,

(19) an iron-based sintered alloy having excellent machinability with the composition consisting of 0.05 to 3% by mass of calcium carbonate, 0.3 to 2% by mass of C, 0.5 to 10% by mass of Cr, 0.3 to 16% by mass of Mo and 0.1 to 5% by mass of Ni, one or more kinds selected from among 1 to 5% by mass of W, 0.05 to 1% by mass of Si, 0.5 to 18% by mass of Co and 0.05 to 2% by mass of Nb, and 10 to 20% by mass of Cu, the balance being Fe and inevitable impurities,

(20) an iron-based sintered alloy having excellent machinability with the composition consisting of 0.05 to 3% by mass of calcium carbonate, 0.3 to 2% by mass of C, 0.1 to 3% by mass of Mo, 0.05 to 5% by mass of Ni and 0.1 to 2% by mass of Co, the balance being Fe and inevitable impurities,

(21) an iron-based sintered alloy having excellent machinability with the composition consisting of 0.05 to 3% by mass of calcium carbonate, 15 to 27% by mass of Cr and 3 to 29% by mass of Ni, the balance being Fe and inevitable impurities,

(22) an iron-based sintered alloy having excellent machinability with the composition consisting of one or more kinds selected from among 0.05 to 3% by mass of calcium carbonate, 15 to 27% by mass of Cr, 3 to 29% by mass of Ni, 0.5 to 7% by mass of Mo and 0.5 to 4% by mass of Cu, the balance being Fe and inevitable impurities,

(23) an iron-based sintered alloy having excellent machinability with the composition consisting of 0.05 to 3% by mass of calcium carbonate and 10 to 33% by mass of Cr, the balance being Fe and inevitable impurities,

(24) an iron-based sintered alloy having excellent machinability with the composition consisting of 0.05 to 3% by mass of calcium carbonate, 10 to 33% by mass of Cr and 0.5 to 3% by mass of Mo, the balance being Fe and inevitable impurities,

(25) an iron-based sintered alloy having excellent machinability with the composition consisting of 0.05 to 3% by mass of calcium carbonate, 10 to 19% by mass of Cr and 0.05 to 1.3% by mass of C, the balance being Fe and inevitable impurities,

(26) an iron-based sintered alloy having excellent machinability with the composition consisting of 0.05 to 3% by mass of calcium carbonate, 14 to 19% by mass of Cr and 2 to 8% by mass of Ni, the balance being Fe and inevitable impurities,

(27) an iron-based sintered alloy having excellent machinability with the composition consisting of 0.05 to 3% by mass of calcium carbonate, 14 to 19% by mass of Cr and 2 to 8% by mass of Ni, and one or more kinds selected from among 2 to 6% by mass of Cu, 0.1 to 0.5% by mass of Nb and 0.5 to 1.5% by mass of Al, the balance being Fe and inevitable impurities,

(28) an iron-based sintered alloy having excellent machinability, comprising 0.05 to 3% by mass of strontium carbonate,

(29) an iron-based sintered alloy having excellent machinability with the composition consisting of 0.05 to 3% by mass of strontium carbonate, the balance being Fe and inevitable impurities,

(30) an iron-based sintered alloy having excellent machinability with the composition consisting of 0.05 to 3% by mass of strontium carbonate and 0.1 to 1.5% by mass of P, the balance being Fe and inevitable impurities,

(31) an iron-based sintered alloy having excellent machinability with the composition consisting of 0.05 to 3% by mass of strontium carbonate and 0.1 to 1.2% by mass of C, the balance being Fe and inevitable impurities,

(32) an iron-based sintered alloy having excellent machinability with the composition consisting of 0.05 to 3% by mass of strontium carbonate, 0.1 to 1.2% by mass of C and 10 to 25% by mass of Cu, the balance being Fe and inevitable impurities,

(33) an iron-based sintered alloy having excellent machinability with the composition consisting of 0.05 to 3% by mass of strontium carbonate, 0.1 to 1.2% by mass of C and 0.1 to 6% by mass of Cu, the balance being Fe and inevitable impurities,

(34) an iron-based sintered alloy having excellent machinability with the composition consisting of 0.05 to 3% by mass of strontium carbonate, 0.1 to 1.2% by mass of C, 0.1 to 6% by mass of Cu, 0.1 to 10% by mass of Ni and 0.1 to 6% by mass of Mo, the balance being Fe and inevitable impurities,

(35) an iron-based sintered alloy having excellent machinability with the composition consisting of 0.05 to 3% by mass of strontium carbonate, 0.1 to 1.2% by mass of C and 0.1 to 6% by mass of Mo, the balance being Fe and inevitable impurities,

(36) an iron-based sintered alloy having excellent machinability with the composition consisting of 0.05 to 3% by mass of strontium carbonate, 0.1 to 1.2% by mass of C, 0.1 to 10% by mass of Cr and 0.1 to 6% by mass of Mo, the balance being Fe and inevitable impurities,

(37) an iron-based sintered alloy having excellent machinability with the composition consisting of 0.05 to 3% by mass of strontium carbonate, 0.1 to 1.2% by mass of C, 0.1 to 10% by mass of Ni, 0.1 to 10% by mass of Cr and 0.1 to 6% by mass of Mo, the balance being Fe and inevitable impurities,

(38) an iron-based sintered alloy having excellent machinability with the composition consisting of 0.05 to 3% by mass of strontium carbonate, 0.1 to 1.2% by mass of C, 0.1 to 6% by mass of Cu, 0.1 to 10% by mass of Ni, 0.1 to 10% by mass of Cr and 0.1 to 6% by mass of Mo, the balance being Fe and inevitable impurities,

(39) an iron-based sintered alloy having excellent machinability with the composition consisting of 0.05 to 3% by mass of strontium carbonate, 0.1 to 1.2% by mass of C and 0.1 to 10% by mass of Ni, the balance being Fe and inevitable impurities,

(40) an iron-based sintered alloy having excellent machinability with the composition consisting of 0.05 to 3% by mass of strontium carbonate, 0.1 to 1.2% by mass of C, 0.1 to 10% by mass of Ni and 0.1 to 6% by mass of Mo, the balance being Fe and inevitable impurities,

(41) an iron-based sintered alloy having excellent machinability with the composition consisting of 0.05 to 3% by mass of strontium carbonate, 0.1 to 1.2% by mass of C, 0.1 to 6% by mass of Cu and 0.1 to 10% by mass of Ni, the balance being Fe and inevitable impurities,

(42) an iron-based sintered alloy having excellent machinability with the composition consisting of 0.05 to 3% by mass of strontium carbonate, 1.0 to 3.0% by mass of C, 0.5 to 8% by mass of Cu and 0.1 to 0.8% by mass of P, the balance being Fe and inevitable impurities,

(43) an iron-based sintered alloy having excellent machinability with the composition consisting of 0.05 to 3% by mass of strontium carbonate, 0.3 to 2.5% by mass of C, 0.5 to 12% by mass of Cr, 0.3 to 9% by mass of Mo, 3 to 14% by mass of W and 1 to 6% by mass of V, the balance being Fe and inevitable impurities,

(44) an iron-based sintered alloy having excellent machinability with the composition consisting of 0.05 to 3% by mass of strontium carbonate, 0.3 to 2.5% by mass of C, 0.5 to 12% by mass of Cr, 0.3 to 9% by mass of Mo, 3 to 14% by mass of W, 1 to 6% by mass of V and 5 to 14% by mass of Co, the balance being Fe and inevitable impurities,

(45) an iron-based sintered alloy having excellent machinability with the composition consisting of 0.05 to 3% by mass of strontium carbonate, 0.3 to 2% by mass of C, 0.5 to 10% by mass of Cr, 0.3 to 16% by mass of Mo and 0.1 to 5% by mass of Ni, and one or more kinds selected from among 1 to 5% by mass of W, 0.05 to 1% by mass of Si, 0.5 to 18% by mass of Co and 0.05 to 2% by mass of Nb, the balance being Fe and inevitable impurities,

(46) an iron-based sintered alloy having excellent machinability with the composition consisting of 0.05 to 3% by mass of strontium carbonate, 0.3 to 2% by mass of C, 0.5 to 10% by mass of Cr, 0.3 to 16% by mass of Mo and 0.1 to 5% by mass of Ni, one or more kinds selected from among 1 to 5% by mass of W, 0.05 to 1% by mass of Si, 0.5 to 18% by mass of Co and 0.05 to 2% by mass of Nb, and 10 to 20% by mass of Cu, the balance being Fe and inevitable impurities,

(47) an iron-based sintered alloy having excellent machinability with the composition consisting of 0.05 to 3% by mass of strontium carbonate, 0.3 to 2% by mass of C, 0.1 to 3% by mass of Mo, 0.05 to 5% by mass of Ni and 0.1 to 2% by mass of Co, the balance being Fe and inevitable impurities,

(48) an iron-based sintered alloy having excellent machinability with the composition consisting of 0.05 to 3% by mass of strontium carbonate, 15 to 27% by mass of Cr and 3 to 29% by mass of Ni, the balance being Fe and inevitable impurities,

(49) an iron-based sintered alloy having excellent machinability with the composition consisting of one or more kinds selected from among 0.05 to 3% by mass of strontium carbonate, 15 to 27% by mass of Cr, 3 to 29% by mass of Ni, 0.5 to 7% by mass of Mo and 0.5 to 4% by mass of Cu, the balance being Fe and inevitable impurities,

(50) an iron-based sintered alloy having excellent machinability with the composition consisting of 0.05 to 3% by mass of strontium carbonate and 10 to 33% by mass of Cr, the balance being Fe and inevitable impurities,

(51) an iron-based sintered alloy having excellent machinability with the composition consisting of 0.05 to 3% by mass of strontium carbonate, 10 to 33% by mass of Cr and 0.5 to 3% by mass of Mo, the balance being Fe and inevitable impurities,

(52) an iron-based sintered alloy having excellent machinability with the composition consisting of 0.05 to 3% by mass of strontium carbonate, 10 to 19% by mass of Cr and 0.05 to 1.3% by mass of C, the balance being Fe and inevitable impurities,

(53) an iron-based sintered alloy having excellent machinability with the composition consisting of 0.05 to 3% by mass of strontium carbonate, 14 to 19% by mass of Cr and 2 to 8% by mass of Ni, the balance being Fe and inevitable impurities, and

(54) an iron-based sintered alloy having excellent machinability with the composition consisting of 0.05 to 3% by mass of strontium carbonate, 14 to 19% by mass of Cr and 2 to 8% by mass of Ni, and one or more kinds selected from among 2 to 6% by mass of Cu, 0.1 to 0.5% by mass of Nb and 0.5 to 1.5% by mass of Al, the balance being Fe and inevitable impurities.

The iron-based sintered alloys having excellent machinability, which contain 0.05 to 3% by mass of calcium carbonate, according to (1) to (27) of the present invention are produced by blending a calcium carbonate powder having an average particle size of 0.1 to 30 μm with raw powders, mixing these powders and compacting the powder mixture to obtain a green compact, and sintering the resulting green compact in an atmosphere of a nonoxidizing gas such as vacuum, dissociated ammonia gas, $N_2$+5% $H_2$ gas mixture, endothermic gas or exothermic gas. The green compact is particularly preferably sintered in an atmosphere of the nonoxidizing gas such as endothermic gas or exothermic gas. The iron-based sintered alloy thus obtained has a structure in which $CaCO_3$ is dispersed at grain boundary in a basis material of the iron-based sintered alloy. The presence of $CaCO_3$ in the sintered compact obtained by sintering the green compact can be confirmed by X-ray diffraction.

The iron-based sintered alloys having excellent machinability, which contain 0.05 to 3% by mass of strontium carbonate, according to (28) to (54) of the present invention are produced by blending a strontium carbonate powder having an average particle size of 0.1 to 30 μm with raw powders, mixing these powders and compacting the powder mixture to obtain a green compact, and sintering the resulting green compact in an atmosphere of a nonoxidizing gas such as vacuum, dissociated ammonia gas, $N_2$+5% $H_2$ gas mixture, endothermic gas or exothermic gas. The green compact is particularly preferably sintered in an atmosphere of the nonoxidizing gas such as endothermic gas or exothermic gas. The iron-based sintered alloy thus obtained has a structure in which $SrCO_3$ is dispersed at grain boundary in a basis material of the iron-based sintered alloy. The presence of $SrCO_3$ in the sintered compact obtained by sintering the green compact can be confirmed by X-ray diffraction.

Therefore, the present invention is characterized by the followings: (55) a method for preparing the iron-based sintered alloy having excellent machinability according to any one of (1) to (27), which comprises compacting a raw powder mixture containing 0.05 to 3% by mass of a calcium carbonate powder having an average particle size of 0.1 to 30 μm as a raw powder to obtain a green compact and sintering the resulting green compact in a nonoxidizing gas atmosphere, and (56) a method for preparing the iron-based sintered alloy having excellent machinability according to any one of (28) to (54), which comprises compacting a raw powder mixture containing 0.05 to 3% by mass of a strontium carbonate powder having an average particle size of 0.1 to 30 μm as a raw powder to obtain a green compact and sintering the resulting green compact in a nonoxidizing gas atmosphere.

The average particle size of the calcium carbonate powder as the raw powder was defined within a range from 0.1 to 30 μm by the following reason. That is, when the average particle size of the calcium carbonate powder exceeds 30 μm, a contact area between the calcium carbonate powder and the basis material decreases and sufficient machinability improving effect is not exerted. On the other hand, when the average particle size of the calcium carbonate powder is less than 0.1 μm, a force of agglomeration increases, and thus the calcium carbonate powder is not uniformly dispersed in the basis material and further machinability improving effect is not exerted, and it is not preferred.

The average particle size of the strontium carbonate powder as the raw powder was defined within a range from 0.1 to 30 μm by the following reason. That is, when the average particle size of the strontium carbonate powder exceeds 30 μm, a contact area between the strontium carbonate powder and the basis material decreases and sufficient machinability improving effect is not exerted. On the other hand, when the average particle size of the strontium carbonate powder is less than 0.1 μm, a force of agglomeration increases, and thus the strontium carbonate powder is not uniformly dispersed in the basis material and further machinability improving effect is not exerted, and it is not preferred.

The endothermic gas is a gas containing, as a main component, hydrogen, carbon monoxide and nitrogen, which is obtained by mixing a natural gas, propane, butane or coke oven gas with an air to obtain a gas mixture, and decomposing and converting the gas mixture while passing through a heated catalyst composed mainly of nickel. In this case, since this reaction is an endothermic reaction, a catalyst layer must be heated. The exothermic gas is a gas containing nitrogen as a main component, hydrogen and carbon monoxide, which is obtained by semicombusting a natural gas, propane, butane or coke oven gas with air, and decomposing and converting the combustion gas while passing through a nickel catalyst layer or charcoal layer. In this case, since the temperature of the catalyst increases due to combustion heat of the raw gas, it is not necessary to externally heat the catalyst layer.

The sintering temperature, at which the iron-based sintered alloy having excellent machinability is sintered, is preferably from 1100 to 1300° C. (more preferably from 1110 to 1250° C.) and this sintering temperature is the temperature which is generally known as a temperature at which the iron-based sintered alloy is sintered.

The reason why the composition of the $CaCO_3$ component and the composition of the $SrCO_3$ component in the iron-based sintered alloy having excellent machinability of the present invention were as limited as described above will now be described.

$CaCO_3$ has such an effect that it exists at grain boundary and is uniformly dispersed in a basis material, thereby to improve machinability. When the content is less than 0.05% by mass, sufficient machinability improving effect is not exerted. On the other hand, even when the content exceeds 3.0% by mass, further machinability improving effect is not exerted and the strength of the iron-based sintered alloy rather decreases, and therefore it is not preferred. Therefore, the content of $CaCO_3$ in the iron-based sintered alloy of the present invention was defined within a range from 0.05 to 3.0% by mass. The content of $CaCO_3$ is more preferably within a range from 0.1 to 2% by mass.

$SrCO_3$ has such an effect that it exists at grain boundary and is uniformly dispersed in a basis material, thereby to improve machinability. When the content is less than 0.05% by mass, sufficient machinability improving effect is not exerted. On the other hand, even when the content exceeds 3.0% by mass, further machinability improving effect is not exerted and the strength of the iron-based sintered alloy rather decreases, and therefore it is not preferred. Therefore, the content of $SrCO_3$ in the iron-based sintered alloy of the present invention was defined within a range from 0.05 to 3.0% by mass. The content of $SrCO_3$ is more preferably within a range from 0.1 to 2% by mass.

BEST MODE FOR CARRYING OUT THE INVENTION

Preferred examples of the present invention will now be described with reference to the accompanying drawings. The present invention is not limited to the following examples and, for example, constituent features of these examples may be appropriately combined with each other.

EXAMPLE 1

As raw powders, a $CaCO_3$ powder having an average particle size shown in Table 1, a $CaMgSiO_4$ powder having an average particle size of 10 μm, a MnS powder having an average particle size of 20 μm, a $CaF_2$ powder having an average particle size of 36 μm and a pure Fe powder having an average particle size of 80 μm were prepared. These raw powders were blended according to the formulation shown in Table 1, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 1 to 10 of the present invention, comparative sintered alloys 1 to 2, and conventional sintered alloys 1 to 3.

Cylindrical sintered alloy blocks for piercing test each having a diameter of 30 mm and a height of 10 mm, made of the sintered alloys 1 to 10 of the present invention, the comparative sintered alloys 1 to 2, and the conventional sintered alloys 1 to 3 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.030 mm/rev.

Cutting oil: none (dry).

The number of piercing (maximum number of piercing, lifetime) of one new drill was measured. The results are shown in Table 1. Machinability was evaluated by the results.

TABLE 1

| | | Component ratio of raw powder (mass %) | | Component ratio of iron-based sintered alloy (mass %) | | | |
|---|---|---|---|---|---|---|---|
| Iron-based sintered alloy | | $CaCO_3$ powder Average particle size is described in parenthesis. | Fe powder | $CaCO_3$ | Fe and inevitable impurities | Number of piercing (times) | Remarks |
| Products of the present invention | 1 | 0.05 (0.1 μm) | balance | 0.03 | balance | 59 | — |
| | 2 | 0.2 (0.1 μm) | balance | 0.18 | balance | 137 | — |
| | 3 | 0.5 (0.6 μm) | balance | 0.48 | balance | 155 | — |
| | 4 | 1.0 (2 μm) | balance | 0.95 | balance | 203 | — |
| | 5 | 1.3 (0.6 μm) | balance | 1.26 | balance | 196 | — |
| | 6 | 1.5 (2 μm) | balance | 1.48 | balance | 236 | — |

TABLE 1-continued

| Iron-based sintered alloy | | Component ratio of raw powder (mass %) $CaCO_3$ powder Average particle size is described in parenthesis. | Fe powder | Component ratio of iron-based sintered alloy (mass %) $CaCO_3$ | Fe and inevitable impurities | Number of piercing (times) | Remarks |
|---|---|---|---|---|---|---|---|
| | 7 | 1.8 (18 μm) | balance | 1.76 | balance | 213 | — |
| | 8 | 2.1 (2 μm) | balance | 1.99 | balance | 176 | — |
| | 9 | 2.5 (18 μm) | balance | 2.43 | balance | 222 | — |
| | 10 | 3.0 (30 μm) | balance | 2.97 | balance | 310 | — |
| Comparative products | 1 | 0.02* (40 μm*) | balance | 0.01 | balance | 23 | — |
| | 2 | 3.5* (0.01 μm*) | balance | 3.45* | balance | 114 | decrease in strength |
| Conventional products | 1 | $CaMgSi_4$: 1 | balance | $CaMgSi_4$: 1 | balance | 38 | — |
| | 2 | MnS: 1 | balance | MnS: 0.97 | balance | 27 | — |
| | 3 | $CaF_2$: 1 | balance | $CaF_2$: 1 | balance | 25 | — |

The symbol * means the value which is not within the scope of the present invention.

As is apparent from the results shown in Table 1, the number of piercing of the cylindrical sintered alloy blocks for piercing test made of the sintered alloys 1 to 10 of the present invention is larger than that of the cylindrical sintered alloy blocks for piercing test made of the conventional sintered alloys 1 to 3 and therefore the sintered alloys of the present invention are excellent in machinability. However, the comparative sintered alloy 1 containing $CaCO_3$ in the content of less than the range defined in the present invention is inferior in machinability because of small number of piercing, while the comparative sintered alloy 2 containing $CaCO_3$ in the content of more than the range defined in the present invention is excellent in machinability because of large number of piercing, but shows drastically decreased deflection strength, and therefore it is not preferred.

EXAMPLE 2

As raw powders, a $CaCO_3$ powder having an average particle size shown in Table 2, a $CaMgSiO_4$ powder having an average particle size of 10 μm, a MnS powder having an average particle size of 20 μm, a $CaF_2$ powder having an average particle size of 36 μm and a Fe-0.6 mass % P powder having an average particle size of 80 μm were prepared. These raw powders were blended according to the formulation shown in Table 2, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 11 to 20 of the present invention, comparative sintered alloys 3 to 4, and conventional sintered alloys 4 to 6.

Cylindrical sintered alloy blocks for piercing test each having a diameter of 30 mm and a height of 10 mm, made of the sintered alloys 11 to 20 of the present invention, the comparative sintered alloys 3 to 4, and the conventional sintered alloys 4 to 6 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.030 mm/rev.

Cutting oil: none (dry).

The number of piercing (maximum number of piercing, lifetime) of one new drill was measured. The results are shown in Table 2. Machinability was evaluated by the results.

TABLE 2

| Iron-based sintered alloy | | Component ratio of raw powder (mass %) $CaCO_3$ powder Average particle size is described in parenthesis. | Fe-based alloy powder# | Component ratio of iron-based sintered alloy (mass %) $CaCO_3$ | P | Fe and inevitable impurities | Number of piercing (times) | Remarks |
|---|---|---|---|---|---|---|---|---|
| Products of the present invention | 11 | 0.05 (0.1 μm) | balance | 0.03 | 0.55 | balance | 51 | — |
| | 12 | 0.2 (0.1 μm) | balance | 0.18 | 0.58 | balance | 119 | — |
| | 13 | 0.5 (0.6 μm) | balance | 0.48 | 0.53 | balance | 158 | — |
| | 14 | 1.0 (2 μm) | balance | 0.95 | 0.53 | balance | 176 | — |
| | 15 | 1.3 (0.6 μm) | balance | 1.28 | 0.57 | balance | 140 | — |
| | 16 | 1.5 (2 μm) | balance | 1.48 | 0.57 | balance | 131 | — |
| | 17 | 1.8 (18 μm) | balance | 1.76 | 0.54 | balance | 167 | — |
| | 18 | 2.1 (2 μm) | balance | 1.99 | 0.53 | balance | 121 | — |
| | 19 | 2.5 (18 μm) | balance | 2.42 | 0.55 | balance | 137 | — |
| | 20 | 3.0 (30 μm) | balance | 2.97 | 0.55 | balance | 186 | — |

TABLE 2-continued

| Iron-based sintered alloy | | Component ratio of raw powder (mass %) $CaCO_3$ powder Average particle size is described in parenthesis. | Fe-based alloy powder# | Component ratio of iron-based sintered alloy (mass %) $CaCO_3$ | P | Fe and inevitable impurities | Number of piercing (times) | Remarks |
|---|---|---|---|---|---|---|---|---|
| Comparative products | 3 | 0.02* (40 μm*) | balance | 0.01* | 0.56 | balance | 27 | — |
| | 4 | 3.5* (0.01 μm*) | balance | 3.42* | 0.54 | balance | 125 | decrease in strength |
| Conventional products | 4 | $CaMgSi_4$: 1 | balance | $CaMgSi_4$: 1 | 0.55 | balance | 33 | — |
| | 5 | MnS: 1 | balance | MnS: 0.97 | 0.55 | balance | 35 | — |
| | 6 | $CaF_2$: 1 | balance | $CaF_2$: 1 | 0.55 | balance | 22 | — |

The symbol * means the value which is not within the scope of the present invention.
#Fe-based alloy powder with the composition of Fe-0.6 mass % P As is apparent from the results shown in Table 2, the number of piercing of the cylindrical sintered alloy blocks for piercing test made of the sintered alloys 11 to 20 of the present invention is larger than that of the cylindrical sintered alloy blocks for piercing test made of the conventional sintered alloys 4 to 6 and therefore the sintered alloys of the present invention are excellent in machinability. However, the comparative sintered alloy 3 containing $CaCO_3$ in the content of less than the range defined in the present invention is inferior in machinability because of small number of piercing, while the comparative sintered alloy 4 containing $CaCO_3$ in the content of more than the range defined in the present invention is excellent in machinability because of large number of piercing, but shows drastically decreased deflection strength, and therefore it is not preferred.

EXAMPLE 3

As raw powders, a $CaCO_3$ powder having an average particle size shown in Table 3, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm and a C powder having an average particle size of 18 μm were prepared. These raw powders were blended according to the formulation shown in Table 3, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 21 to 30 of the present invention, comparative sintered alloys 5 to 6, and conventional sintered alloys 7 to 9.

Cylindrical sintered alloy blocks for piercing test each having a diameter of 30 mm and a height of 10 mm, made of the sintered alloys 21 to 30 of the present invention, the comparative sintered alloys 5 to 6, and the conventional sintered alloys 7 to 9 were produced and these cylindrical sintered alloy blocks for piercing test were repeatedly pierced until the drill is damaged, using a high-speed steel drill having a diameter of 1.2 mm, under the following conditions:

Rotating speed: 10000 rpm
Feed speed: 0.018 mm/rev.
Cutting oil: none (dry).

The number of piercing (maximum number of piercing, lifetime) of one new drill was measured. The results are shown in Table 3. Machinability was evaluated by the results.

TABLE 3

| Iron-based sintered alloy | | Component ratio of raw powder (mass %) $CaCO_3$ powder Average particle size is described in parenthesis. | C powder | Fe powder | Component ratio of iron-based sintered alloy (mass %) $CaCO_3$ | C | Fe and inevitable impurities | Number of piercing (times) | Remarks |
|---|---|---|---|---|---|---|---|---|---|
| Products of the present invention | 21 | 0.05 (0.1 μm) | 0.13 | balance | 0.03 | 0.11 | balance | 80 | — |
| | 22 | 0.2 (0.1 μm) | 0.3 | balance | 0.17 | 0.24 | balance | 102 | — |
| | 23 | 0.5 (0.6 μm) | 0.6 | balance | 0.47 | 0.54 | balance | 95 | — |
| | 24 | 1.0 (2 μm) | 0.8 | balance | 0.94 | 0.55 | balance | 135 | — |
| | 25 | 1.3 (0.6 μm) | 1.1 | balance | 1.22 | 1.02 | balance | 197 | — |
| | 26 | 1.5 (2 μm) | 1.1 | balance | 1.43 | 0.99 | balance | 208 | — |
| | 27 | 1.8 (18 μm) | 1.1 | balance | 1.69 | 1.05 | balance | 191 | — |
| | 28 | 2.1 (2 μm) | 1.1 | balance | 2.09 | 1.03 | balance | 220 | — |
| | 29 | 2.5 (18 μm) | 1.1 | balance | 2.3 | 1.03 | balance | 174 | — |
| | 30 | 3.0 (30 μm) | 1.2 | balance | 2.91 | 1.15 | balance | 180 | — |
| Comparative products | 5 | 0.02* (40 μm*) | 1.1 | balance | 0.01* | 1.04 | balance | 22 | — |
| | 6 | 3.5* (0.01 μm*) | 1.1 | balance | 3.38* | 1.01 | balance | 126 | decrease in strength |
| Conventional products | 7 | $CaMgSi_4$: 1 (10 μm) | 1.1 | balance | $CaMgSi_4$: 1 | 1.04 | balance | 37 | — |
| | 8 | MnS: 1 (20 μm) | 1.1 | balance | MnS: 0.97 | 1.04 | balance | 45 | — |
| | 9 | $CaF_2$: 1 (36 μm) | 1.1 | balance | $CaF_2$: 1 | 1.04 | balance | 29 | — |

The symbol * means the value which is not within the scope of the present invention.

As is apparent from the results shown in Table 3, the number of piercing of the cylindrical sintered alloy blocks for piercing test made of the sintered alloys 21 to 30 of the present invention is larger than that of the cylindrical sintered alloy blocks for piercing test made of the conventional sintered alloys 7 to 9 and therefore the sintered alloys of the present invention are excellent in machinability. However, the comparative sintered alloy 5 containing $CaCO_3$ in the content of less than the range defined in the present invention is inferior in machinability because of small number of piercing, while the comparative sintered alloy 6 containing $CaCO_3$ in the content of more than the range defined in the present invention is excellent in machinability because of large number of piercing, but shows drastically decreased deflection strength, and therefore it is not preferred.

EXAMPLE 4

As raw powders, a $CaCO_3$ powder having an average particle size shown in Table 4, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm and a C powder having an average particle size of 18 μm were prepared. These raw powders were blended according to the formulation shown in Table 4, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes and subjected to 20% Cu infiltration to obtain iron-based sintered alloys 31 to 40 of the present invention, comparative sintered alloys 7 to 8, and conventional sintered alloys 10 to 12.

Cylindrical sintered alloy blocks for piercing test each having a diameter of 30 mm and a height of 10 mm, made of the sintered alloys 31 to 40 of the present invention, the comparative sintered alloys 7 to 8, and the conventional sintered alloys 10 to 12 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.018 mm/rev.

Cutting oil: none (dry).

The number of piercing (maximum number of piercing, lifetime) of one new drill was measured. The results are shown in Table 4. Machinability was evaluated by the results.

TABLE 4

| Iron-based sintered alloy | | Component ratio of raw powder (mass %): $CaCO_3$ powder Average particle size is described in parenthesis. | C powder | Fe powder | Infiltration Cu | Component ratio of iron-based sintered alloy (mass %): $CaCO_3$ | C | Cu | Fe and inevitable impurities | Number of piercing (times) | Remarks |
|---|---|---|---|---|---|---|---|---|---|---|---|
| Products of the present invention | 31 | 0.05 (0.1 μm) | 0.13 | balance | 20 | 0.05 | 0.12 | 19.5 | balance | 78 | — |
| | 32 | 0.2 (0.5 μm) | 0.3 | balance | 20 | 0.20 | 0.24 | 20.2 | balance | 126 | — |
| | 33 | 0.5 (1 μm) | 0.6 | balance | 20 | 0.49 | 0.54 | 20.1 | balance | 186 | — |
| | 34 | 1.0 (2 μm) | 0.8 | balance | 20 | 0.97 | 0.75 | 19.6 | balance | 201 | — |
| | 35 | 1.3 (0.5 μm) | 1.1 | balance | 20 | 1.28 | 1.05 | 19.9 | balance | 210 | — |
| | 36 | 1.5 (2 μm) | 1.1 | balance | 20 | 1.46 | 0.99 | 20.4 | balance | 176 | — |
| | 37 | 1.8 (18 μm) | 1.1 | balance | 20 | 1.77 | 1.05 | 19.8 | balance | 197 | — |
| | 38 | 2.1 (2 μm) | 1.1 | balance | 20 | 2.09 | 1.07 | 20.0 | balance | 189 | — |
| | 39 | 2.5 (18 μm) | 1.1 | balance | 20 | 2.45 | 1.07 | 19.7 | balance | 160 | — |
| | 40 | 3.0 (30 μm) | 1.2 | balance | 20 | 2.96 | 1.15 | 19.9 | balance | 152 | — |
| Comparative products | 7 | 0.02* (40 μm*) | 1.1 | balance | 20 | 0.01* | 1.04 | 20.3 | balance | 23 | — |
| | 8 | 3.5* (0.01 μm*) | 1.1 | balance | 20 | 3.45* | 1.06 | 19.6 | balance | 112 | decrease in strength |
| Conventional products | 10 | $CaMgSi_4$: 1 (10 μm) | 1.1 | balance | 20 | $CaMgSi_4$: 1 | 1.04 | 19.8 | balance | 41 | — |
| | 11 | MnS: 1 (20 μm) | 1.1 | balance | 20 | MnS: 0.97 | 1.04 | 19.8 | balance | 48 | — |
| | 12 | $CaF_2$: 1 (36 μm) | 1.1 | balance | 20 | $CaF_2$: 1 | 1.04 | 19.9 | balance | 32 | — |

The symbol * means the value which is not within the scope of the present invention.

As is apparent from the results shown in Table 4, the number of piercing of the cylindrical sintered alloy blocks for piercing test made of the sintered alloys 31 to 40 of the present invention is larger than that of the cylindrical sintered alloy blocks for piercing test made of the conventional sintered alloys 10 to 12 and therefore the sintered alloys of the present invention are excellent in machinability. However, the comparative sintered alloy 7 containing $CaCO_3$ in the content of less than the range defined in the present invention is inferior in machinability because of small number of piercing, while the comparative sintered alloy 8 containing $CaCO_3$ in the content of more than the range defined in the present invention is excellent in machinability because of large number of piercing, but shows drastically decreased deflection strength, and therefore it is not preferred.

EXAMPLE 5

As raw powders, a $CaCO_3$ powder having an average particle size shown in Table 5, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm, a Cu powder having an average particle size of 25 μm and a C powder having an average particle size of 18 μm were prepared. These raw powders were blended according to the formulation shown in Table 5, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 41 to 50 of the present invention, comparative sintered alloys 9 to 10, and conventional sintered alloys 13 to 15.

Cylindrical sintered alloy blocks for piercing test each having a diameter of 30 mm and a height of 10 mm, made of the sintered alloys 41 to 50 of the present invention, the comparative sintered alloys 9 to 10, and the conventional sintered alloys 13 to 15 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.030 mm/rev.

Cutting oil: none (dry).

The number of piercing (maximum number of piercing, lifetime) of one new drill was measured. The results are shown in Table 5. Machinability was evaluated by the results.

EXAMPLE 6

As raw powders, a $CaCO_3$ powder having an average particle size shown in Table 6, a $CaMgSiO_4$ powder having an average particle size of 10 μm, a MnS powder having an average particle size of 20 μm, a $CaF_2$ powder having an average particle size of 36 μm, a partially diffused Fe-based alloy powder having an average particle size of 80 μm with the composition of Fe-1.5% Cu-4.0% Ni-0.5% Mo and a C powder having an average particle size of 18 μm were prepared. These raw powders were blended according to the formulation shown in Table 6, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 51 to 60 of the present invention, comparative sintered alloys 11 to 12, and conventional sintered alloys 16 to 18.

TABLE 5

| | | Component ratio of raw powder (mass %) | | | | Component ratio of iron-based sintered alloy (mass %) | | | | | |
|---|---|---|---|---|---|---|---|---|---|---|---|
| Iron-based sintered alloy | | $CaCO_3$ powder Average particle size is described in parenthesis. | Cu powder | C powder | Fe powder | $CaCO_3$ | Cu | C | Fe and inevitable impurities | Number of piercing (times) | Remarks |
| Products of the present invention | 41 | 0.05 (0.1 μm) | 0.2 | 0.13 | balance | 0.03 | 2.0 | 0.11 | balance | 53 | — |
| | 42 | 0.2 (0.1 μm) | 2 | 0.25 | balance | 0.17 | 2.1 | 0.22 | balance | 122 | — |
| | 43 | 0.5 (0.6 μm) | 2 | 0.98 | balance | 0.47 | 1.9 | 0.87 | balance | 129 | — |
| | 44 | 1.0 (2 μm) | 2 | 0.7 | balance | 0.94 | 2.0 | 0.66 | balance | 235 | — |
| | 45 | 1.3 (0.6 μm) | 2 | 0.7 | balance | 1.22 | 2.0 | 0.64 | balance | 250 | — |
| | 46 | 1.5 (2 μm) | 4 | 0.7 | balance | 1.43 | 4.0 | 0.65 | balance | 220 | — |
| | 47 | 1.8 (18 μm) | 5.8 | 0.7 | balance | 1.69 | 5.7 | 0.65 | balance | 203 | — |
| | 48 | 2.1 (2 μm) | 4 | 0.7 | balance | 2.09 | 3.9 | 0.64 | balance | 190 | — |
| | 49 | 2.5 (18 μm) | 2 | 0.98 | balance | 2.3 | 2.0 | 0.88 | balance | 145 | — |
| | 50 | 3.0 (30 μm) | 2 | 1.2 | balance | 2.91 | 2.0 | 1.15 | balance | 179 | — |
| Comparative products | 9 | 0.02* (40 μm*) | 2 | 0.7 | balance | 0.01* | 1.9 | 0.65 | balance | 10 | — |
| | 10 | 3.5* (0.01 μm*) | 2 | 0.7 | balance | 3.45* | 2.0 | 0.64 | balance | 108 | decrease in strength |
| Conventional products | 13 | $CaMgSi_4$: 1 | 2 | 0.7 | balance | $CaMgSi_4$: 1 | 2.0 | 0.66 | balance | 20 | — |
| | 14 | MnS: 1 | 2 | 0.7 | balance | MnS: 0.97 | 2.0 | 0.64 | balance | 14 | — |
| | 15 | $CaF_2$: 1 | 2 | 0.7 | balance | $CaF_2$: 1 | 2.0 | 0.64 | balance | 9 | — |

The symbol * means the value which is not within the scope of the present invention.

As is apparent from the results shown in Table 5, the number of piercing of the cylindrical sintered alloy blocks for piercing test made of the sintered alloys 41 to 50 of the present invention is larger than that of the cylindrical sintered alloy blocks for piercing test made of the conventional sintered alloys 13 to 15 and therefore the sintered alloys of the present invention are excellent in machinability. However, the comparative sintered alloy 9 containing $CaCO_3$ in the content of less than the range defined in the present invention is inferior in machinability because of small number of piercing, while the comparative sintered alloy 10 containing $CaCO_3$ in the content of more than the range defined in the present invention is excellent in machinability because of large number of piercing, but shows drastically decreased deflection strength, and therefore it is not preferred.

Cylindrical sintered alloy blocks for piercing test each having a diameter of 30 mm and a height of 10 mm, made of the sintered alloys 51 to 60 of the present invention, the comparative sintered alloys 11 to 12, and the conventional sintered alloys 16 to 18 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 6. Machinability was evaluated by the results.

TABLE 6

| Iron-based sintered alloy | | Component ratio of raw powder (mass %): $CaCO_3$ powder Average particle size is described in parenthesis. | C powder | Fe-based alloy powder# | Component ratio of iron-based sintered alloy (mass %): $CaCO_3$ | Cu | C | Ni | Mo | Fe and inevitable impurities | Number of piercing (times) | Remarks |
|---|---|---|---|---|---|---|---|---|---|---|---|---|
| Products of the present invention | 51 | 0.05 (0.1 μm) | 0.13 | balance | 0.03 | 1.5 | 0.11 | 3.9 | 0.50 | balance | 48 | — |
| | 52 | 0.2 (0.1 μm) | 0.25 | balance | 0.18 | 1.5 | 0.19 | 4.0 | 0.50 | balance | 153 | — |
| | 53 | 0.5 (0.6 μm) | 0.98 | balance | 0.46 | 1.5 | 0.85 | 4.0 | 0.50 | balance | 214 | — |
| | 54 | 1.0 (2 μm) | 0.5 | balance | 0.96 | 1.4 | 0.47 | 4.1 | 0.52 | balance | 300 | — |
| | 55 | 1.3 (0.6 μm) | 0.5 | balance | 1.25 | 1.5 | 0.45 | 4.0 | 0.50 | balance | 287 | — |
| | 56 | 1.5 (2 μm) | 0.5 | balance | 1.45 | 1.5 | 0.45 | 4.0 | 0.50 | balance | 324 | — |
| | 57 | 1.8 (18 μm) | 0.5 | balance | 1.72 | 1.5 | 0.47 | 4.0 | 0.49 | balance | 274 | — |
| | 58 | 2.1 (2 μm) | 0.5 | balance | 1.89 | 1.6 | 0.47 | 3.8 | 0.50 | balance | 257 | — |
| | 59 | 2.5 (18 μm) | 1.0 | balance | 2.32 | 1.5 | 0.90 | 4.0 | 0.50 | balance | 231 | — |
| | 60 | 3.0 (30 μm) | 1.2 | balance | 2.89 | 1.5 | 1.17 | 4.0 | 0.50 | balance | 267 | — |
| Comparative products | 11 | 0.02* (40 μm*) | 0.5 | balance | 0.01* | 1.5 | 0.43 | 4.1 | 0.50 | balance | 5 | — |
| | 12 | 3.5* (0.01 μm*) | 0.5 | balance | 3.45* | 1.5 | 0.44 | 4.0 | 0.51 | balance | 87 | decrease in strength |
| Conventional products | 16 | $CaMgSi_4$: 1 | 0.5 | balance | $CaMgSi_4$: 1 | 1.5 | 0.46 | 4.0 | 0.50 | balance | 17 | — |
| | 17 | MnS: 1 | 0.5 | balance | MnS: 0.97 | 1.5 | 0.47 | 4.0 | 0.50 | balance | 35 | — |
| | 18 | $CaF_2$: 1 | 0.5 | balance | $CaF_2$: 1 | 1.5 | 0.45 | 4.0 | 0.48 | balance | 8 | — |

The symbol * means the value which is not within the scope of the present invention.
#partially diffused Fe-based alloy powder having an average particle size of 80 μm with the composition of Fe-1.5% Cu-4.0% Ni-0.5% Mo As is apparent from the results shown in Table 6, the number of piercing of the cylindrical sintered alloy blocks for piercing test made of the sintered alloys 51 to 60 of the present invention is larger than that of the cylindrical sintered alloy blocks for piercing test made of the conventional sintered alloys 16 to 18 and therefore the sintered alloys of the present invention are excellent in machinability. However, the comparative sintered alloy 11 containing $CaCO_3$ in the content of less than the range defined in the present invention is inferior in machinability because of small number of piercing, while the comparative sintered alloy 12 containing $CaCO_3$ in the content of more than the range defined in the present invention is excellent in machinability because of large number of piercing, but shows drastically decreased deflection strength, and therefore it is not preferred.

EXAMPLE 7

As raw powders, a $CaCO_3$ powder having an average particle size shown in Table 7, a $CaMgSiO_4$ powder having an average particle size of 10 μm, a MnS powder having an average particle size of 20 μm, a $CaF_2$ powder having an average particle size of 36 μm, a Fe-based alloy powder having an average particle size of 80 μm with the composition of Fe-1.5% Mo and a C powder having an average particle size of 18 μm were prepared. These raw powders were blended according to the formulation shown in Table 7, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 61 to 70 of the present invention, comparative sintered alloys 13 to 14, and conventional sintered alloys 19 to 21.

Cylindrical sintered alloy blocks for piercing test each having a diameter of 30 mm and a height of 10 mm, made of the sintered alloys 61 to 70 of the present invention, the comparative sintered alloys 13 to 14, and the conventional sintered alloys 19 to 21 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 7. Machinability was evaluated by the results.

TABLE 7

| Iron-based sintered alloy | | Component ratio of raw powder (mass %): $CaCO_3$ powder Average particle size is described in parenthesis. | C powder | Fe-based alloy powder# | Component ratio of iron-based sintered alloy (mass %): $CaCO_3$ | C | Mo | Fe and inevitable impurities | Number of piercing (times) | Remarks |
|---|---|---|---|---|---|---|---|---|---|---|
| Products of the present invention | 61 | 0.05 (0.1 μm) | 0.13 | balance | 0.03 | 0.11 | 1.50 | balance | 48 | — |
| | 62 | 0.2 (0.1 μm) | 0.25 | balance | 0.19 | 0.19 | 1.48 | balance | 85 | — |
| | 63 | 0.5 (0.6 μm) | 0.98 | balance | 0.48 | 0.85 | 1.50 | balance | 71 | — |
| | 64 | 1.0 (2 μm) | 0.5 | balance | 0.97 | 0.46 | 1.50 | balance | 214 | — |
| | 65 | 1.3 (0.6 μm) | 0.5 | balance | 1.27 | 0.47 | 1.50 | balance | 225 | — |
| | 66 | 1.5 (2 μm) | 0.5 | balance | 1.44 | 0.45 | 1.51 | balance | 201 | — |
| | 67 | 1.8 (18 μm) | 0.5 | balance | 1.72 | 0.45 | 1.46 | balance | 228 | — |

TABLE 7-continued

| Iron-based sintered alloy | | Component ratio of raw powder (mass %): $CaCO_3$ powder Average particle size is described in parenthesis. | C powder | Fe-based alloy powder# | Component ratio of iron-based sintered alloy (mass %): $CaCO_3$ | C | Mo | Fe and inevitable impurities | Number of piercing (times) | Remarks |
|---|---|---|---|---|---|---|---|---|---|---|
| | 68 | 2.1 (2 μm) | 0.5 | balance | 1.95 | 0.44 | 1.50 | balance | 219 | — |
| | 69 | 2.5 (18 μm) | 1.0 | balance | 2.39 | 0.90 | 1.50 | balance | 170 | — |
| | 70 | 3.0 (30 μm) | 1.2 | balance | 2.91 | 1.17 | 1.53 | balance | 148 | — |
| Comparative products | 13 | 0.02* (40 μm*) | 0.5 | balance | 0.01* | 0.43 | 1.51 | balance | 12 | — |
| | 14 | 3.5* (0.01 μm*) | 0.5 | balance | 3.45* | 0.44 | 1.50 | balance | 81 | decrease in strength |
| Conventional products | 19 | $CaMgSi_4$: 1 | 0.5 | balance | $CaMgSi_4$: 1 | 0.46 | 1.51 | balance | 20 | — |
| | 20 | MnS: 1 | 0.5 | balance | MnS: 0.97 | 0.47 | 1.50 | balance | 23 | — |
| | 21 | $CaF_2$: 1 | 0.5 | balance | $CaF_2$: 1 | 0.44 | 1.48 | balance | 16 | — |

The symbol * means the value which is not within the scope of the present invention.
#Fe-based alloy powder having an average particle size of 80 μm with the composition of Fe-1.5% Mo As is apparent from the results shown in Table 7, the number of piercing of the cylindrical sintered alloy blocks for piercing test made of the sintered alloys 61 to 70 of the present invention is larger than that of the cylindrical sintered alloy blocks for piercing test made of the conventional sintered alloys 19 to 21 and therefore the sintered alloys of the present invention are excellent in machinability. However, the comparative sintered alloy 13 containing $CaCO_3$ in the content of less than the range defined in the present invention is inferior in machinability because of small number of piercing, while the comparative sintered alloy 14 containing $CaCO_3$ in the content of more than the range defined in the present invention is excellent in machinability because of large number of piercing, but shows drastically decreased deflection strength, and therefore it is not preferred.

EXAMPLE 8

As raw powders, a $CaCO_3$ powder having an average particle size shown in Table 8, a $CaMgSiO_4$ powder having an average particle size of 10 μm, a MnS powder having an average particle size of 20 μm, a $CaF_2$ powder having an average particle size of 36 μm, a Fe-based alloy powder having an average particle size of 80 μm with the composition of Fe-3.0% Cr-0.5% Mo and a C powder having an average particle size of 18 μm were prepared. These raw powders were blended according to the formulation shown in Table 8, mixed in a double corn mixer and compacted to obtain a green compact, and then the resulting green compact was sintered in an $N_2$+5% $H_2$ gas mixture atmosphere under the conditions of a temperature of 1120° C. and a retention time of 20 minutes to obtain iron-based sintered alloys 71 to 80 of the present invention, comparative sintered alloys 15 to 16, and conventional sintered alloys 22 to 24.

Cylindrical sintered alloy blocks for piercing test each having a diameter of 30 mm and a height of 10 mm, made of the sintered alloys 71 to 80 of the present invention, the comparative sintered alloys 15 to 16, and the conventional sintered alloys 22 to 24 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.006 mm/rev.

Cutting oil: none (dry).

The number of piercing (maximum number of piercing, lifetime) of one new drill was measured. The results are shown in Table 8. Machinability was evaluated by the results.

TABLE 8

| Iron-based sintered alloy | | Component ratio of raw powder (mass %): $CaCO_3$ powder Average particle size is described in parenthesis. | C powder | Fe-based alloy powder# | Component ratio of iron-based sintered alloy (mass %): $CaCO_3$ | C | Cr | Mo | Fe and inevitable impurities | Number of piercing (times) | Remarks |
|---|---|---|---|---|---|---|---|---|---|---|---|
| Products of the present invention | 71 | 0.05 (0.1 μm) | 0.13 | balance | 0.03 | 0.11 | 3.0 | 0.50 | balance | 31 | — |
| | 72 | 0.2 (0.1 μm) | 0.25 | balance | 0.19 | 0.19 | 3.0 | 0.50 | balance | 105 | — |
| | 73 | 0.5 (0.6 μm) | 0.98 | balance | 0.48 | 0.85 | 3.0 | 0.49 | balance | 121 | — |
| | 74 | 1.0 (2 μm) | 0.5 | balance | 0.97 | 0.47 | 3.0 | 0.50 | balance | 163 | — |
| | 75 | 1.3 (0.6 μm) | 0.5 | balance | 1.27 | 0.45 | 2.9 | 0.50 | balance | 186 | — |
| | 76 | 1.5 (2 μm) | 0.5 | balance | 1.44 | 0.45 | 3.0 | 0.51 | balance | 151 | — |
| | 77 | 1.8 (18 μm) | 0.5 | balance | 1.72 | 0.44 | 3.0 | 0.49 | balance | 185 | — |
| | 78 | 2.1 (2 μm) | 0.5 | balance | 1.95 | 0.44 | 3.1 | 0.50 | balance | 196 | — |
| | 79 | 2.5 (18 μm) | 1.0 | balance | 2.39 | 0.90 | 3.0 | 0.50 | balance | 103 | — |
| | 80 | 3.0 (30 μm) | 1.2 | balance | 2.91 | 1.17 | 3.0 | 0.50 | balance | 88 | — |
| Comparative products | 15 | 0.02* (40 μm*) | 0.5 | balance | 0.01* | 0.43 | 3.1 | 0.50 | balance | 3 | — |
| | 16 | 3.5* (0.01 μm*) | 0.5 | balance | 3.45* | 0.45 | 3.0 | 0.51 | balance | 89 | decrease in |

TABLE 8-continued

| Iron-based sintered alloy | | Component ratio of raw powder (mass %) | | | Component ratio of iron-based sintered alloy (mass %) | | | | | | Remarks |
|---|---|---|---|---|---|---|---|---|---|---|---|
| | | $CaCO_3$ powder Average particle size is described in parenthesis. | C powder | Fe-based alloy powder# | $CaCO_3$ | C | Cr | Mo | Fe and inevitable impurities | Number of piercing (times) | |
| | | | | | | | | | | | strength |
| Conventional products | 22 | $CaMgSi_4$: 1 | 0.5 | balance | $CaMgSi_4$: 1 | 0.46 | 3.0 | 0.50 | balance | 16 | — |
| | 23 | MnS: 1 | 0.5 | balance | MnS: 0.97 | 0.47 | 3.1 | 0.50 | balance | 13 | — |
| | 24 | $CaF_2$: 1 | 0.5 | balance | $CaF_2$: 1 | 0.44 | 3.0 | 0.50 | balance | 8 | — |

The symbol * means the value which is not within the scope of the present invention.
#Fe-based alloy powder having a particle size of 80 μm with the composition of Fe-3.0% Cr-0.5% Mo As is apparent from the results shown in Table 8, the number of piercing of the cylindrical sintered alloy blocks for piercing test made of the sintered alloys 71 to 80 of the present invention is larger than that of the cylindrical sintered alloy blocks for piercing test made of the conventional sintered alloys 22 to 24 and therefore the sintered alloys of the present invention are excellent in machinability. However, the comparative sintered alloy 15 containing $CaCO_3$ in the content of less than the range defined in the present invention is inferior in machinability because of small number of piercing, while the comparative sintered alloy 16 containing $CaCO_3$ in the content of more than the range defined in the present invention is excellent in machinability because of large number of piercing, but shows drastically decreased deflection strength, and therefore it is not preferred.

EXAMPLE 9

As raw powders, a $CaCO_3$ powder having an average particle size shown in Table 9, a $CaMgSiO_4$ powder having an average particle size of 10 μm, a MnS powder having an average particle size of 20 μm, a $CaF_2$ powder having an average particle size of 36 μm, a Fe-based alloy powder having an average particle size of 80 μm with the composition of Fe-3.0% Cr-0.5% Mo, a Ni powder having an average particle size of 3 μm and a C powder having an average particle size of 18 μm were prepared. These raw powders were blended according to the formulation shown in Table 9, mixed in a double corn mixer and compacted to obtain a green compact, and then the resulting green compact was sintered in an $N_2$+5% $H_2$ gas mixture atmosphere under the conditions of a temperature of 1120° C. and a retention time of 20 minutes to obtain iron-based sintered alloys 81 to 90 of the present invention, comparative sintered alloys 17 to 18, and conventional sintered alloys 25 to 27.

Cylindrical sintered alloy blocks for piercing test each having a diameter of 30 mm and a height of 10 mm, made of the sintered alloys 81 to 90 of the present invention, the comparative sintered alloys 17 to 18, and the conventional sintered alloys 25 to 27 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 9. Machinability was evaluated by the results.

TABLE 9

| Iron-based sintered alloy | | Component ratio of raw powder (mass %) | | | | Component ratio of iron-based sintered alloy (mass %) | | | | | | | Remarks |
|---|---|---|---|---|---|---|---|---|---|---|---|---|---|
| | | $CaCO_3$ powder Average particle size is described in parenthesis. | C powder | Ni powder | Fe-based alloy powder# | $CaCO_3$ | C | Ni | Cr | Mo | Fe and inevitable impurities | Number of piercing (times) | |
| Products of the present invention | 81 | 0.05 (0.1 μm) | 0.13 | 0.2 | balance | 0.03 | 0.11 | 0.2 | 3.0 | 0.50 | balance | 65 | — |
| | 82 | 0.2 (0.1 μm) | 0.25 | 2 | balance | 0.19 | 0.19 | 2.0 | 3.0 | 0.50 | balance | 93 | — |
| | 83 | 0.5 (0.6 μm) | 0.98 | 4 | balance | 0.48 | 0.85 | 4.0 | 3.0 | 0.49 | balance | 89 | — |
| | 84 | 1.0 (2 μm) | 0.5 | 4 | balance | 0.97 | 0.47 | 4.0 | 3.0 | 0.50 | balance | 135 | — |
| | 85 | 1.3 (0.6 μm) | 0.5 | 4 | balance | 1.27 | 0.45 | 3.9 | 2.9 | 0.50 | balance | 112 | — |
| | 86 | 1.5 (2 μm) | 0.5 | 4 | balance | 1.44 | 0.45 | 4.0 | 3.0 | 0.51 | balance | 125 | — |
| | 87 | 1.8 (18 μm) | 0.5 | 4 | balance | 1.72 | 0.44 | 4.0 | 3.0 | 0.49 | balance | 140 | — |
| | 88 | 2.1 (2 μm) | 0.5 | 6 | balance | 1.95 | 0.44 | 6.0 | 3.1 | 0.50 | balance | 177 | — |
| | 89 | 2.5 (18 μm) | 1.0 | 8 | balance | 2.39 | 0.90 | 7.9 | 3.0 | 0.50 | balance | 133 | — |
| | 90 | 3.0 (30 μm) | 1.2 | 9.8 | balance | 2.91 | 1.17 | 9.8 | 3.0 | 0.50 | balance | 109 | — |
| Comparative products | 17 | 0.02* (40 μm*) | 0.5 | 4 | balance | 0.01* | 0.43 | 4.1 | 3.1 | 0.50 | balance | 3 | — |
| | 18 | 3.5* (0.01 μm*) | 0.5 | 4 | balance | 3.45* | 0.45 | 4.0 | 3.0 | 0.51 | balance | 101 | decrease in strength |
| Conventional products | 25 | $CaMgSi_4$: 1 | 0.5 | 4 | balance | $CaMgSi_4$: 1 | 0.46 | 4.0 | 3.0 | 0.50 | balance | 6 | — |
| | 26 | MnS: 1 | 0.5 | 4 | balance | MnS: 0.97 | 0.47 | 4.0 | 3.1 | 0.50 | balance | 8 | — |
| | 27 | $CaF_2$: 1 | 0.5 | 4 | balance | $CaF_2$: 1 | 0.44 | 4.0 | 3.0 | 0.50 | balance | 8 | — |

The symbol * means the value which is not within the scope of the present invention.
#Fe-based alloy powder having a particle size of 80 μm with the composition of Fe-3.0% Cr-0.5% Mo As is apparent from the results shown in Table 9, the number of piercing of the cylindrical sintered alloy blocks for piercing test made of the sintered alloys 81 to 90 of the present invention is larger than that of the cylindrical sintered alloy blocks for piercing test made of the conventional sintered alloys 25 to 27 and therefore the sintered alloys of the present invention are excellent in machinability. However, the comparative sintered alloy 17 containing $CaCO_3$ in the content of less than the range defined in the present invention is inferior in machinability because of small number of piercing, while the comparative sintered alloy 18 containing $CaCO_3$ in the content of more than the range defined in the present invention is excellent in machinability because of large number of piercing, but shows drastically decreased deflection strength, and therefore it is not preferred.

EXAMPLE 10

As raw powders, a $CaCO_3$ powder having an average particle size shown in Table 10, a $CaMgSiO_4$ powder having an average particle size of 10 μm, a MnS powder having an average particle size of 20 μm, a $CaF_2$ powder having an average particle size of 36 μm, a Fe-based alloy powder having an average particle size of 80 μm with the composition of Fe-3.0% Cr-0.5% Mo, a Cu powder having an average particle size of 25 μm, a Ni powder having an average particle size of 3 μm and a C powder having an average particle size of 18 μm were prepared. These raw powders were blended according to the formulation shown in Table 10, mixed in a double corn mixer and compacted to obtain a green compact, and then the resulting green compact was sintered in an $N_2$+5% $H_2$ gas mixture atmosphere under the conditions of a temperature of 1120° C. and a retention time of 20 minutes to obtain iron-based sintered alloys 91 to 100 of the present invention, comparative sintered alloys 19 to 20, and conventional sintered alloys 28 to 30.

Cylindrical sintered alloy blocks for piercing test each having a diameter of 30 mm and a height of 10 mm, made of the sintered alloys 91 to 100 of the present invention, the comparative sintered alloys 19 to 20, and the conventional sintered alloys 28 to 30 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 10. Machinability was evaluated by the results.

TABLE 10

| Iron-based sintered alloy | | Component ratio of raw powder (mass %): $CaCO_3$ powder: Average particle size is described in parenthesis. | Cu powder | C powder | Ni powder | Fe-based alloy # | Component ratio of iron-based sintered alloy (mass %): $CaCO_3$ | Cu | C | Ni | Cr | Mo | Fe and inevitable impurities | Number of piercing (times) | Remarks |
|---|---|---|---|---|---|---|---|---|---|---|---|---|---|---|---|
| Products of the present invention | 91 | 0.05 (0.1 μm) | 0.2 | 0.13 | 0.2 | balance | 0.03 | 0.2 | 0.11 | 0.2 | 3.0 | 0.50 | balance | 34 | — |
| | 92 | 0.2 (0.1 μm) | 2 | 0.25 | 2 | balance | 0.19 | 2.1 | 0.19 | 2.0 | 3.0 | 0.50 | balance | 87 | — |
| | 93 | 0.5 (0.6 μm) | 2 | 0.98 | 4 | balance | 0.48 | 1.9 | 0.85 | 4.0 | 3.0 | 0.49 | balance | 95 | — |
| | 94 | 1.0 (2 μm) | 2 | 0.5 | 4 | balance | 0.97 | 2.0 | 0.47 | 4.0 | 3.0 | 0.50 | balance | 150 | — |
| | 95 | 1.3 (0.6 μm) | 2 | 0.5 | 4 | balance | 1.27 | 2.0 | 0.45 | 3.9 | 2.9 | 0.50 | balance | 138 | — |
| | 96 | 1.5 (2 μm) | 4 | 0.5 | 4 | balance | 1.44 | 4.0 | 0.45 | 4.0 | 3.0 | 0.51 | balance | 143 | — |
| | 97 | 1.8 (18 μm) | 5.8 | 0.5 | 4 | balance | 1.72 | 5.8 | 0.44 | 4.0 | 3.0 | 0.49 | balance | 139 | — |
| | 98 | 2.1 (2 μm) | 4 | 0.5 | 6 | balance | 1.95 | 4.0 | 0.44 | 6.0 | 3.1 | 0.50 | balance | 155 | — |
| | 99 | 2.5 (18 μm) | 2 | 1.0 | 8 | balance | 2.39 | 2.0 | 0.90 | 7.9 | 3.0 | 0.50 | balance | 132 | — |
| | 100 | 3.0 (30 μm) | 2 | 1.2 | 9.8 | balance | 2.91 | 2.0 | 1.17 | 9.8 | 3.0 | 0.50 | balance | 129 | — |
| Comparative products | 19 | 0.02* (40 μm*) | 2 | 0.5 | 4 | balance | 0.01* | 1.9 | 0.43 | 4.1 | 3.0 | 0.50 | balance | 2 | — |
| | 20 | 3.5* (0.01 μm*) | 2 | 0.5 | 4 | balance | 3.45* | 2.0 | 0.45 | 4.0 | 3.0 | 0.51 | balance | 119 | decrease in strength |
| Conventional products | 28 | $CaMgSi_4$: 1 | 2 | 0.5 | 4 | balance | $CaMgSi_4$: 1 | 2.0 | 0.46 | 4.0 | 3.0 | 0.50 | balance | 8 | — |
| | 29 | MnS: 1 | 2 | 0.5 | 4 | balance | MnS: 0.97 | 2.0 | 0.47 | 4.0 | 3.1 | 0.50 | balance | 4 | — |
| | 30 | $CaF_2$: 1 | 2 | 0.5 | 4 | balance | $CaF_2$: 1 | 2.0 | 0.44 | 4.0 | 3.0 | 0.50 | balance | 11 | — |

The symbol * means the value which is not within the scope of the present invention.
*Fe-based alloy powder having a particle size of 80 μm with the composition of Fe-3.0% Cr-0.5% Mo As is apparent from the results shown in Table 10, the number of piercing of the cylindrical sintered alloy blocks for piercing test made of the sintered alloys 91 to 100 of the present invention is larger than that of the cylindrical sintered alloy blocks for piercing test made of the conventional sintered alloys 28 to 30 and therefore the sintered alloys of the present invention are excellent in machinability. However, the comparative sintered alloy 19 containing $CaCO_3$ in the content of less than the range defined in the present invention is inferior in machinability because of small number of piercing, while the comparative sintered alloy 20 containing $CaCO_3$ in the content of more than the range defined in the present invention is excellent in machinability because of large number of piercing, but shows drastically decreased deflection strength, and therefore it is not preferred.

EXAMPLE 11

As raw powders, a $CaCO_3$ powder having an average particle size shown in Table 11, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm, a Ni powder having an average particle size of 3 μm and a C powder having an average particle size of 18 μm were prepared. These raw powders were blended according to the formulation shown in Table 11, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 101 to 110 of the present invention, comparative sintered alloys 21 to 22, and conventional sintered alloys 31 to 33.

Cylindrical sintered alloy blocks for piercing test each having a diameter of 30 mm and a height of 10 mm, made of the sintered alloys 101 to 110 of the present invention, the comparative sintered alloys 21 to 22, and the conventional sintered alloys 31 to 33 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.009 mm/rev.

Cutting oil: none (dry).

The number of piercing (maximum number of piercing, lifetime) of one new drill was measured. The results are shown in Table 11. Machinability was evaluated by the results.

EXAMPLE 12

As raw powders, a $CaCO_3$ powder having an average particle size shown in Table 12, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm, a Ni powder having an average particle size of 3 μm, a Mo powder having an average particle size of 3 μm and a C powder having an average particle size of 18 μm were prepared. These raw powders were blended according to the formulation shown in Table 12, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 111 to 120 of the present invention, comparative sintered alloys 23 to 24, and conventional sintered alloys 34 to 36.

TABLE 11

| | | Component ratio of raw powder (mass %) | | | | Component ratio of iron-based sintered alloy (mass %) | | | | | |
|---|---|---|---|---|---|---|---|---|---|---|---|
| | | $CaCO_3$ powder | | | | | | | | | |
| Iron-based sintered alloy | | Average particle size is described in parenthesis. | C powder | Ni powder | Fe powder | $CaCO_3$ | C | Ni | Fe and inevitable impurities | Number of piercing (times) | Remarks |
| Products of the present invention | 101 | 0.05 (0.1 μm) | 0.13 | 0.2 | balance | 0.03 | 0.11 | 0.2 | balance | 43 | — |
| | 102 | 0.2 (0.1 μm) | 0.25 | 1 | balance | 0.19 | 0.19 | 1.0 | balance | 84 | — |
| | 103 | 0.5 (0.6 μm) | 0.98 | 3 | balance | 0.48 | 0.93 | 2.9 | balance | 79 | — |
| | 104 | 1.0 (2 μm) | 0.5 | 3 | balance | 0.97 | 0.44 | 3.0 | balance | 128 | — |
| | 105 | 1.3 (0.6 μm) | 0.5 | 3 | balance | 1.27 | 0.44 | 3.0 | balance | 114 | — |
| | 106 | 1.5 (2 μm) | 0.5 | 3 | balance | 1.44 | 0.45 | 3.0 | balance | 202 | — |
| | 107 | 1.8 (18 μm) | 0.5 | 3 | balance | 1.72 | 0.45 | 3.0 | balance | 187 | — |
| | 108 | 2.1 (2 μm) | 0.5 | 6 | balance | 1.95 | 0.45 | 6.0 | balance | 168 | — |
| | 109 | 2.5 (18 μm) | 1.0 | 8 | balance | 2.39 | 0.90 | 8.0 | balance | 126 | — |
| | 110 | 3.0 (30 μm) | 1.2 | 9.8 | balance | 2.91 | 1.11 | 9.8 | balance | 99 | — |
| Comparative products | 21 | 0.02* (40 μm*) | 0.5 | 3 | balance | 0.01* | 0.45 | 3.0 | balance | 5 | — |
| | 22 | 3.5* (0.01 μm*) | 0.5 | 3 | balance | 3.45* | 0.45 | 3.0 | balance | 143 | decrease in strength |
| Conventional products | 31 | $CaMgSi_4$: 1 | 0.5 | 3 | balance | $CaMgSi_4$: 1 | 0.44 | 2.9 | balance | 17 | — |
| | 32 | MnS: 1 | 0.5 | 4 | balance | MnS: 0.97 | 0.45 | 3.0 | balance | 20 | — |
| | 33 | $CaF_2$: 1 | 0.5 | 4 | balance | $CaF_2$: 1 | 0.44 | 3.0 | balance | 12 | — |

The symbol * means the value which is not within the scope of the present invention.

As is apparent from the results shown in Table 11, the number of piercing of the cylindrical sintered alloy blocks for piercing test made of the sintered alloys 101 to 110 of the present invention is larger than that of the cylindrical sintered alloy blocks for piercing test made of the conventional sintered alloys 31 to 33 and therefore the sintered alloys of the present invention are excellent in machinability. However, the comparative sintered alloy 21 containing $CaCO_3$ in the content of less than the range defined in the present invention is inferior in machinability because of small number of piercing, while the comparative sintered alloy 22 containing $CaCO_3$ in the content of more than the range defined in the present invention is excellent in machinability because of large number of piercing, but shows drastically decreased deflection strength, and therefore it is not preferred.

Cylindrical sintered alloy blocks for piercing test each having a diameter of 30 mm and a height of 10 mm, made of the sintered alloys 111 to 120 of the present invention, the comparative sintered alloys 23 to 24, and the conventional sintered alloys 34 to 36 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.009 mm/rev.

Cutting oil: none (dry).

The number of piercing (maximum number of piercing, lifetime) of one new drill was measured. The results are shown in Table 12. Machinability was evaluated by the results.

TABLE 12

| Iron-based sintered alloy | | Component ratio of raw powder (mass %): $CaCO_3$ powder Average particle size is described in parenthesis. | C powder | Ni powder | Mo powder | Fe powder | Component ratio of iron-based sintered alloy (mass %): $CaCO_3$ | C | Ni | Mo | Fe and inevitable impurities | Number of piercing (times) | Remarks |
|---|---|---|---|---|---|---|---|---|---|---|---|---|---|
| Products of the present invention | 111 | 0.05 (0.1 μm) | 0.13 | 0.2 | 0.2 | balance | 0.03 | 0.11 | 0.2 | 0.2 | balance | 55 | — |
| | 112 | 0.2 (0.1 μm) | 0.25 | 1 | 0.3 | balance | 0.19 | 0.19 | 1.0 | 0.3 | balance | 91 | — |
| | 113 | 0.5 (0.6 μm) | 0.98 | 4 | 0.5 | balance | 0.48 | 0.91 | 4.0 | 0.5 | balance | 103 | — |
| | 114 | 1.0 (2 μm) | 0.6 | 4 | 0.5 | balance | 0.97 | 0.55 | 4.0 | 0.5 | balance | 170 | — |
| | 115 | 1.3 (0.6 μm) | 0.6 | 4 | 0.5 | balance | 1.27 | 0.56 | 4.0 | 0.5 | balance | 227 | — |
| | 116 | 1.5 (2 μm) | 0.6 | 4 | 1 | balance | 1.44 | 0.54 | 3.9 | 1.0 | balance | 198 | — |
| | 117 | 1.8 (18 μm) | 0.6 | 4 | 3 | balance | 1.72 | 0.54 | 3.9 | 2.7 | balance | 164 | — |
| | 118 | 2.1 (2 μm) | 0.6 | 6 | 4.8 | balance | 1.95 | 0.55 | 6.0 | 4.8 | balance | 144 | — |
| | 119 | 2.5 (18 μm) | 1.0 | 8 | 0.5 | balance | 2.39 | 0.92 | 8.0 | 0.5 | balance | 159 | — |
| | 120 | 3.0 (30 μm) | 1.2 | 9.8 | 0.5 | balance | 2.91 | 1.14 | 9.8 | 0.5 | balance | 166 | — |
| Comparative products | 23 | 0.02* (40 μm*) | 0.6 | 4 | 0.5 | balance | 0.01* | 0.54 | 4.0 | 0.5 | balance | 11 | — |
| | 24 | 3.5* (0.01 μm*) | 0.6 | 4 | 0.5 | balance | 3.45* | 0.54 | 4.0 | 0.5 | balance | 91 | decrease in strength |
| Conventional products | 34 | $CaMgSi_4$: 1 | 0.6 | 4 | 0.5 | balance | $CaMgSi_4$: 1 | 0.54 | 4.0 | 0.5 | balance | 22 | — |
| | 35 | MnS: 1 | 0.6 | 4 | 0.5 | balance | MnS: 0.97 | 0.55 | 4.0 | 0.5 | balance | 31 | — |
| | 36 | $CaF_2$: 1 | 0.6 | 4 | 0.5 | balance | $CaF_2$: 1 | 0.55 | 4.0 | 0.5 | balance | 28 | — |

The symbol * means the value which is not within the scope of the present invention.

As is apparent from the results shown in Table 12, the number of piercing of the cylindrical sintered alloy blocks for piercing test made of the sintered alloys 111 to 120 of the present invention is larger than that of the cylindrical sintered alloy blocks for piercing test made of the conventional sintered alloys 34 to 36 and therefore the sintered alloys of the present invention are excellent in machinability. However, the comparative sintered alloy 23 containing $CaCO_3$ in the content of less than the range defined in the present invention is inferior in machinability because of small number of piercing, while the comparative sintered alloy 24 containing $CaCO_3$ in the content of more than the range defined in the present invention is excellent in machinability because of large number of piercing, but shows drastically decreased deflection strength, and therefore it is not preferred.

EXAMPLE 13

As raw powders, a $CaCO_3$ powder having an average particle size shown in Table 13, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm, a Ni powder having an average particle size of 3 μm, a Cu powder having an average particle size of 25 μm and a C powder having an average particle size of 18 μm were prepared. These raw powders were blended according to the formulation shown in Table 13, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 121 to 130 of the present invention, comparative sintered alloys 25 to 26, and conventional sintered alloys 37 to 39.

Cylindrical sintered alloy blocks for piercing test each having a diameter of 30 mm and a height of 10 mm, made of the sintered alloys 121 to 130 of the present invention, the comparative sintered alloys 25 to 26, and the conventional sintered alloys 37 to 39 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.009 mm/rev.

Cutting oil: none (dry).

The number of piercing (maximum number of piercing, lifetime) of one new drill was measured. The results are shown in Table 13. Machinability was evaluated by the results.

TABLE 13

| Iron-based sintered alloy | | Component ratio of raw powder (mass %): $CaCO_3$ powder Average particle size is described in parenthesis. | Cu powder | C powder | Ni powder | Fe powder | Component ratio of iron-based sintered alloy (mass %): $CaCO_3$ | Cu | C | Ni | Fe and inevitable impurities | Number of piercing (times) | Remarks |
|---|---|---|---|---|---|---|---|---|---|---|---|---|---|
| Products of the present invention | 121 | 0.05 (0.1 μm) | 0.2 | 0.13 | 0.2 | balance | 0.03 | 0.2 | 0.11 | 0.2 | balance | 46 | — |
| | 122 | 0.2 (0.1 μm) | 1 | 0.25 | 1 | balance | 0.17 | 1.0 | 0.21 | 1.0 | balance | 104 | — |
| | 123 | 0.5 (0.6 μm) | 1 | 0.98 | 3 | balance | 0.47 | 1.0 | 0.91 | 3.0 | balance | 136 | — |
| | 124 | 1.0 (2 μm) | 1 | 0.6 | 3 | balance | 0.94 | 0.99 | 0.55 | 3.0 | balance | 157 | — |

TABLE 13-continued

| Iron-based sintered alloy | | Component ratio of raw powder (mass %): $CaCO_3$ powder Average particle size is described in parenthesis. | Cu powder | C powder | Ni powder | Fe powder | Component ratio of iron-based sintered alloy (mass %): $CaCO_3$ | Cu | C | Ni | Fe and inevitable impurities | Number of piercing (times) | Remarks |
|---|---|---|---|---|---|---|---|---|---|---|---|---|---|
| | 125 | 1.3 (0.6 μm) | 2 | 0.8 | 3 | balance | 1.22 | 1.0 | 0.54 | 3.0 | balance | 180 | — |
| | 126 | 1.5 (2 μm) | 4 | 0.6 | 3 | balance | 1.43 | 4.0 | 0.55 | 2.9 | balance | 166 | — |
| | 127 | 1.8 (18 μm) | 5.8 | 0.6 | 3 | balance | 1.69 | 5.7 | 0.56 | 3.0 | balance | 192 | — |
| | 128 | 2.1 (2 μm) | 1 | 0.6 | 6 | balance | 1.09 | 1.0 | 0.55 | 6.0 | balance | 153 | — |
| | 129 | 2.5 (18 μm) | 1 | 1.0 | 8 | balance | 2.3 | 1.0 | 0.91 | 8.0 | balance | 193 | — |
| | 130 | 3.0 (30 μm) | 1 | 1.2 | 9.8 | balance | 2.91 | 1.0 | 1.13 | 9.8 | balance | 179 | — |
| Comparative products | 25 | 0.02* (40 μm*) | 1 | 0.6 | 3 | balance | 0.01* | 1.0 | 0.55 | 3.0 | balance | 7 | — |
| | 26 | 3.5* (0.01 μm*) | 1 | 0.6 | 3 | balance | 3.45* | 1.0 | 0.55 | 3.0 | balance | 79 | decrease in strength |
| Conventional products | 37 | $CaMgSi_4$: 1 | 1 | 0.6 | 3 | balance | $CaMgSi_4$: 1 | 1.0 | 0.55 | 3.0 | balance | 12 | — |
| | 38 | MnS: 1 | 1 | 0.6 | 3 | balance | MnS: 0.97 | 1.0 | 0.54 | 3.0 | balance | 15 | — |
| | 39 | $CaF_2$: 1 | 1 | 0.6 | 3 | balance | $CaF_2$: 1 | 1.0 | 0.55 | 3.0 | balance | 9 | — |

The symbol * means the value which is not within the scope of the present invention.

As is apparent from the results shown in Table 13, the number of piercing of the cylindrical sintered alloy blocks for piercing test made of the sintered alloys 121 to 130 of the present invention is larger than that of the cylindrical sintered alloy blocks for piercing test made of the conventional sintered alloys 37 to 39 and therefore the sintered alloys of the present invention are excellent in machinability. However, the comparative sintered alloy 25 containing $CaCO_3$ in the content of less than the range defined in the present invention is inferior in machinability because of small number of piercing, while the comparative sintered alloy 26 containing $CaCO_3$ in the content of more than the range defined in the present invention is excellent in machinability because of large number of piercing, but shows drastically decreased deflection strength, and therefore it is not preferred.

EXAMPLE 14

As raw powders, a $CaCO_3$ powder having an average particle size shown in Table 14, a $CaMgSiO_4$ powder having an average particle size of 10 μm, a MnS powder having an average particle size of 20 μm, a $CaF_2$ powder having an average particle size of 36 μm, a Fe powder having an average particle size of 80 μm, a Cu—P powder having an average particle size of 25 μm and a C powder having an average particle size of 18 μm were prepared. These raw powders were blended according to the formulation shown in Table 14, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 131 to 140 of the present invention, comparative sintered alloys 27 to 28, and conventional sintered alloys 40 to 42.

Cylindrical sintered alloy blocks for piercing test each having a diameter of 30 mm and a height of 10 mm, made of the sintered alloys 131 to 140 of the present invention, the comparative sintered alloys 27 to 28, and the conventional sintered alloys 40 to 42 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.009 mm/rev.

Cutting oil: none (dry).

The number of piercing (maximum number of piercing, lifetime) of one new drill was measured. The results are shown in Table 14. Machinability was evaluated by the results.

TABLE 14

| Iron-based sintered alloy | | Component ratio of raw powder (mass %): $CaCO_3$ powder Average particle size is described in parenthesis. | C powder | Cu-P powder | Fe powder | Component ratio of iron-based sintered alloy (mass %): $CaCO_3$ | C | Cu | P | Fe and inevitable impurities | Number of piercing (times) | Remarks |
|---|---|---|---|---|---|---|---|---|---|---|---|---|
| Products of the present invention | 131 | 0.05 (0.1 μm) | 1.0 | 0.7 | balance | 0.03 | 0.91 | 0.6 | 0.1 | balance | 77 | — |
| | 132 | 0.2 (0.1 μm) | 1.5 | 1.2 | balance | 0.19 | 1.44 | 1.1 | 0.1 | balance | 73 | — |
| | 133 | 0.5 (0.6 μm) | 1.5 | 1.8 | balance | 0.48 | 1.46 | 1.6 | 0.2 | balance | 114 | — |
| | 134 | 1.0 (2 μm) | 2.0 | 1.8 | balance | 0.97 | 1.95 | 1.6 | 0.2 | balance | 203 | — |
| | 135 | 1.3 (0.6 μm) | 2.0 | 2.8 | balance | 1.27 | 1.93 | 2.5 | 0.3 | balance | 231 | — |
| | 136 | 1.5 (2 μm) | 2.0 | 2.8 | balance | 1.44 | 1.93 | 2.5 | 0.3 | balance | 211 | — |
| | 137 | 1.8 (18 μm) | 2.0 | 3.3 | balance | 1.72 | 1.96 | 3 | 0.3 | balance | 274 | — |
| | 138 | 2.1 (2 μm) | 2.5 | 6.0 | balance | 1.95 | 2.48 | 5.4 | 0.6 | balance | 177 | — |

TABLE 14-continued

| Iron-based sintered alloy | | Component ratio of raw powder (mass %) $CaCO_3$ powder Average particle size is described in parenthesis. | C powder | Cu-P powder | Fe powder | Component ratio of iron-based sintered alloy (mass %) $CaCO_3$ | C | Cu | P | Fe and inevitable impurities | Number of piercing (times) | Remarks |
|---|---|---|---|---|---|---|---|---|---|---|---|---|
| | 139 | 2.5 (18 μm) | 2.5 | 8.0 | balance | 2.39 | 2.45 | 5 | 0.6 | balance | 229 | — |
| | 140 | 3.0 (30 μm) | 3.0 | 9.0 | balance | 2.91 | 2.99 | 8.2 | 0.8 | balance | 310 | — |
| Comparative products | 27 | 0.02* (40 μm*) | 1 | 2.8 | balance | 0.01* | 0.45 | 2.5 | 0.3 | balance | 2 | — |
| | 28 | 3.5* (0.01 μm*) | 1 | 2.8 | balance | 3.43* | 0.45 | 2.5 | 0.3 | balance | 198 | decrease in strength |
| Conventional products | 40 | $CaMgSi_4$: 1 | 1 | 2.8 | balance | $CaMgSi_4$: 1 | 0.44 | 2.9 | 0.3 | balance | 32 | — |
| | 41 | MnS: 1 | 1 | 2.8 | balance | MnS: 0.97 | 0.45 | 3.0 | 0.3 | balance | 53 | — |
| | 42 | $CaF_2$: 1 | 1 | 2.8 | balance | $CaF_2$: 1 | 0.44 | 3.0 | 0.3 | balance | 40 | — |

The symbol * means the value which is not within the scope of the present invention.

As is apparent from the results shown in Table 14, the number of piercing of the cylindrical sintered alloy blocks for piercing test made of the sintered alloys 131 to 140 of the present invention is larger than that of the cylindrical sintered alloy blocks for piercing test made of the conventional sintered alloys 40 to 42 and therefore the sintered alloys of the present invention are excellent in machinability. However, the comparative sintered alloy 27 containing $CaCO_3$ in the content of less than the range defined in the present invention is inferior in machinability because of small number of piercing, while the comparative sintered alloy 28 containing $CaCO_3$ in the content of more than the range defined in the present invention is excellent in machinability because of large number of piercing, but shows drastically decreased deflection strength, and therefore it is not preferred.

EXAMPLE 15

As raw powders, a $CaCO_3$ powder having an average particle size of 0.6 μm, a $CaF_2$ powder having an average particle size of 36 μm and a Fe-6% Cr-6% Mo-9% W-3% V-10% Co-1.5% C powder having an average particle size of 80 μm were prepared. These raw powders were blended according to the formulation shown in Table 15, mixed in a double corn mixer and compacted to obtain a green compact, and then the resulting green compact was sintered in a dissociated ammonia gas atmosphere under the conditions of a temperature of 1150° C. and a retention time of 60 minutes to obtain an iron-based sintered alloy 141 of the present invention, comparative sintered alloys 29 to 30, and a conventional sintered alloy 43.

Cylindrical sintered alloy blocks for piercing test each having a diameter of 30 mm and a height of 10 mm, made of the sintered alloy 141 of the present invention, the comparative sintered alloys 29 to 30, and the conventional sintered alloy 43 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 15. Machinability was evaluated by the results.

TABLE 15

| Iron-based sintered alloy | | Component ratio of raw powder (mass %) $CaCO_3$ powder Average particle size is described in parenthesis. | Fe-6% Cr-6% Mo-9% W-3% V-10% Co-1.5% C powder | Component ratio of iron-based sintered alloy (mass %) $CaCO_3$ | C | Cr | Mo | W | Co | V | Fe and inevitable impurities | Number of piercing (times) | Remarks |
|---|---|---|---|---|---|---|---|---|---|---|---|---|---|
| Product of the present invention | 141 | 0.5 (0.6 μm) | balance | 0.48 | 1.5 | 6 | 6 | 9 | 10 | 3 | balance | 158 | — |
| Comparative products | 29 | 0.02* (40 μm*) | balance | 0.01* | 1.5 | 6 | 6 | 9 | 10 | 3 | balance | 18 | — |
| | 30 | 3.5* (0.01 μm*) | balance | 3.43* | 1.5 | 6 | 6 | 9 | 10 | 3 | balance | 127 | decrease in strength |
| Conventional product | 43 | $CaF_2$: 1 | balance | $CaF_2$: 1 | 1.5 | 6 | 6 | 9 | 10 | 3 | balance | 26 | — |

The symbol * means the value which is not within the scope of the present invention.

As is apparent from the results shown in Table 15, the number of piercing of the cylindrical sintered alloy block for piercing test made of the sintered alloy 141 of the present invention is larger than that of the cylindrical sintered alloy block for piercing test made of the conventional sintered alloy 43 and therefore the sintered alloy of the present invention is excellent in machinability. However, the comparative sintered alloy 29 containing $CaCO_3$ in the content of less than the range defined in the present invention is inferior in machinability because of small number of piercing, while the comparative sintered alloy 30 containing $CaCO_3$ in the content of more than the range defined in the present invention is excellent in machinability because of large number of piercing, but shows drastically decreased deflection strength, and therefore it is not preferred.

EXAMPLE 16

As raw powders, a $CaCO_3$ powder having an average particle size of 0.6 μm, a $CaF_2$ powder having an average particle size of 36 μm, a Fe-based alloy powder having an average particle size of 80 μm with the composition of Fe-13% Cr-5% Nb-0.8% Si, a Fe powder having an average particle size of 80 μm, a Ni powder having an average particle size of 3 μm, a Mo powder having an average particle size of 3 μm, a Co-based alloy powder having an average particle size of 80 μm with the composition of Co-30% Mo-10% Cr-3% Si, a Cr-based alloy powder having an average particle size of 80 μm with the composition of Cr-25% Co-25% W-11.5% Fe-1% Nb-1% Si-1.5% C, a Co powder having an average particle size of 30 μm and a C powder having an average particle size of 18 μm were prepared. These raw powders were blended according to the formulation shown in Table 16-1, mixed in a double corn mixer and compacted to obtain a green compact, and then the resulting green compact was sintered in a vacuum atmosphere at 0.1 Pa under the conditions of a temperature of 1150° C. and a retention time of 60 minutes to obtain an iron-based sintered alloy 142 of the present invention, comparative sintered alloys 31 to 32, and a conventional sintered alloy 44 shown in Table 16-2.

Cylindrical sintered alloy blocks for piercing test each having a diameter of 30 mm and a height of 10 mm, made of the sintered alloy 142 of the present invention, the comparative sintered alloys 31 to 32, and the conventional sintered alloy 44 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 16-2. Machinability was evaluated by the results.

TABLE 16-1

| Iron-based sintered alloy | | Component ratio of raw powder (mass %) | | | | | | | | |
|---|---|---|---|---|---|---|---|---|---|---|
| | | $CaCO_3$ powder Average particle size is described in parenthesis. | Mo powder | Co-based alloy powder# | Cr-based alloy powder# | Ni powder | C powder | Co powder | Fe-based alloy powder# | Fe powder |
| Product of the present invention | 142 | 0.5 (0.6 μm) | 9.0 | 10 | 12 | 3 | 0.8 | 3.3 | 10 | balance |
| Comparative products | 31 | 0.02* (40 μm*) | 9.0 | 10 | 12 | 3 | 0.8 | 3.3 | 10 | balance |
| | 32 | 3.5* (0.01 μm*) | 9.0 | 10 | 12 | 3 | 0.8 | 3.3 | 10 | balance |
| Conventional product | 44 | $CaF_2$: 1 | 9.0 | 10 | 12 | 3 | 0.8 | 3.3 | 10 | balance |

Fe-based alloy powder#: Fe-13% Cr-5% Nb-0.8% Si
Co-based alloy powder#: Co-30% Mo-10% Cr-3% Si
Cr-based alloy powder#: Cr-25% Co-25% W-11.5% Fe-1% Nb-1% Si-1.5% C
The symbol * means the value which is not within the scope of the present invention.

TABLE 16-2

| Iron-based sintered alloy | | Component ratio of iron-based sintered alloy (mass %) | | | | | | | | | | Number of piercing (times) | Remarks |
|---|---|---|---|---|---|---|---|---|---|---|---|---|---|
| | | $CaCO_3$ | C | Cr | Mo | W | Ni | Si | Co | Nb | Fe and inevitable impurities | | |
| Product of the present invention | 142 | 0.47 | 1 | 6 | 12 | 3 | 3 | 0.5 | 11.7 | 1.1 | balance | 250 | — |
| Comparative products | 31 | 0.01* | 1 | 6 | 12 | 3 | 3 | 0.5 | 11.7 | 1.1 | balance | 14 | — |
| | 32 | 3.47* | 1 | 6 | 12 | 3 | 3 | 0.5 | 11.7 | 1.1 | balance | 140 | decrease in strength |
| Conventional product | 44 | $CaF_2$: 1 | 1 | 6 | 12 | 3 | 3 | 0.5 | 11.7 | 1.1 | balance | 31 | — |

The symbol * means the value which is not within the scope of the present invention.

As is apparent from the results shown in Table 16-1 and Table 16-2, the number of piercing of the cylindrical sintered alloy block for piercing test made of the sintered alloy 142 of the present invention is larger than that of the cylindrical sintered alloy block for piercing test made of the conventional sintered alloy 44 and therefore the sintered alloy of the present invention is excellent in machinability. However, the comparative sintered alloy 31 containing $CaCO_3$ in the content of less than the range defined in the present invention is inferior in machinability because of small number of piercing, while the comparative sintered alloy 32 containing $CaCO_3$ in the content of more than the range defined in the present invention is excellent in machinability because of large number of piercing, but shows drastically decreased deflection strength, and therefore it is not preferred.

EXAMPLE 17

As raw powders, a $CaCO_3$ powder having an average particle size of 0.6 μm, a $CaF_2$ powder having an average particle size of 36 μm, a Fe-based alloy powder having an average particle size of 80 μm with the composition of Fe-13% Cr-5% Nb-0.8% Si, a Fe powder having an average particle size of 80 μm, a Ni powder having an average particle size of 3 μm, a Mo powder having an average particle size of 3 μm, a Co-based alloy powder having an average particle size of 80 μm with the composition of Co-30% Mo-10% Cr-3% Si, a Cr-based alloy powder having an average particle size of 80 μm with the composition of Cr-25% Co-25% W-11.5% Fe-1% Nb-1% Si-1.5% C, a Co powder having an average particle size of 30 μm and a C powder having an average particle size of 18 μm were prepared. These raw powders were blended according to the formulation shown in Table 17-1, mixed in a double corn mixer and compacted to obtain a green compact, and then the resulting green compact was sintered in a vacuum atmosphere at 0.1 Pa under the conditions of a temperature of 1150° C. and a retention time of 60 minutes and subjected to 18% Cu infiltration to obtain an iron-based sintered alloy 143 of the present invention, comparative sintered alloys 33 to 34, and a conventional sintered alloy 45 shown in Table 17-2.

Cylindrical sintered alloy blocks for piercing test each having a diameter of 30 mm and a height of 10 mm, made of the sintered alloy 143 of the present invention, the comparative sintered alloys 33 to 34, and the conventional sintered alloy 45 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 17-2. Machinability was evaluated by the results.

TABLE 17-1

| Iron-based sintered alloy | | Component ratio of raw powder (mass %) | | | | | | | | | |
|---|---|---|---|---|---|---|---|---|---|---|---|
| | | $CaCO_3$ powder Average particle size is described in parenthesis. | Mo powder | Co-based alloy powder# | Cr-based alloy powder# | Ni powder | C powder | Co powder | Fe-based alloy powder# | Infiltration Cu | Fe powder |
| Product of the present invention | 143 | 0.5 (0.6 μm) | 1.5 | 5.0 | 19.0 | 3.0 | 1.5 | 4.4 | 9.0 | 18 | balance |
| Comparative products | 33 | 0.02* (40 μm*) | 1.5 | 5.0 | 19.0 | 3.0 | 1.5 | 4.4 | 9.0 | 18 | balance |
| | 34 | 3.5* (0.01 μm*) | 1.5 | 5.0 | 19.0 | 3.0 | 1.5 | 4.4 | 9.0 | 18 | balance |
| Conventional product | 45 | $CaF_2$: 1 | 1.5 | 5.0 | 19.0 | 3.0 | 1.5 | 4.4 | 9.0 | 18 | balance |

Fe-based alloy powder#: Fe-13% Cr-5% Nb-0.8% Si
Co-based alloy powder#: Co-30% Mo-10% Cr-3% Si
Cr-based alloy powder#: Cr-25% Co-25% W-11.5% Fe-1% Nb-1% Si-1.5% C
The symbol * means the value which is not within the scope of the present invention.

TABLE 17-2

| Iron-based sintered alloy | | Component ratio of iron-based sintered alloy (mass %) | | | | | | | | | | | Number of piercing (times) | Remarks |
|---|---|---|---|---|---|---|---|---|---|---|---|---|---|---|
| | | $CaCO_3$ | C | Cr | Mo | W | Ni | Si | Co | Nb | Cu | Fe and inevitable impurities | | |
| Product of the present invention | 143 | 0.47 | 1.8 | 8 | 3 | 4.8 | 5 | 0.4 | 12 | 1.1 | 18 | balance | 346 | — |
| Comparative products | 33 | 0.01* | 1.8 | 8 | 3 | 4.8 | 5 | 0.4 | 12 | 1.1 | 18 | balance | 38 | — |
| | 34 | 3.47* | 1.8 | 8 | 3 | 4.8 | 5 | 0.4 | 12 | 1.1 | 18 | balance | 205 | decrease in strength |
| Conventional product | 45 | $CaF_2$: 1 | 1.8 | 8 | 3 | 4.8 | 5 | 0.4 | 12 | 1.1 | 18 | balance | 50 | — |

The symbol * means the value which is not within the scope of the present invention.

As is apparent from the results shown in Table 17-1 and Table 17-2, the number of piercing of the cylindrical sintered alloy block for piercing test made of the sintered alloy 143 of the present invention is larger than that of the cylindrical sintered alloy block for piercing test made of the conventional sintered alloy 45 and therefore the sintered alloy of the present invention is excellent in machinability. However, the comparative sintered alloy 33 containing $CaCO_3$ in the content of less than the range defined in the present invention is inferior in machinability because of small number of piercing, while the comparative sintered alloy 34 containing $CaCO_3$ in the content of more than the range defined in the present invention is excellent in machinability because of large number of piercing, but shows drastically decreased deflection strength, and therefore it is not preferred.

EXAMPLE 18

As raw powders, a $CaCO_3$ powder having an average particle size of 0.6 μm, a $CaF_2$ powder having an average particle size of 36 μm, a Fe powder having an average particle size of 80 μm, a Ni powder having an average particle size of 3 μm, a Mo powder having an average particle size of 3 μm, a Co powder having an average particle size of 30 μm and a C powder having an average particle size of 18 μm were prepared. These raw powders were blended according to the formulation shown in Table 18-1, mixed in a double corn mixer and compacted to obtain a green compact, and then the resulting green compact was sintered in a vacuum atmosphere at 0.1 Pa under the conditions of a temperature of 1150° C. and a retention time of 60 minutes to obtain an iron-based sintered alloy 144 of the present invention, comparative sintered alloys 35 to 36, and a conventional sintered alloy 46 shown in Table 18-2.

Cylindrical sintered alloy blocks for piercing test each having a diameter of 30 mm and a height of 10 mm, made of the sintered alloy 144 of the present invention, the comparative sintered alloys 35 to 36, and the conventional sintered alloy 46 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 18-2. Machinability was evaluated by the results.

TABLE 18-1

| Iron-based sintered alloy | | Component ratio of raw powder (mass %) | | | | | |
|---|---|---|---|---|---|---|---|
| | | $CaCO_3$ powder Average particle size is described in parenthesis. | Mo powder | Ni powder | C powder | Co powder | Fe powder |
| Product of the present invention | 144 | 0.5 (0.6 μm) | 2.0 | 2.0 | 1.3 | 1.0 | balance |
| Comparative products | 35 | 0.02* (40 μm*) | 2.0 | 2.0 | 1.3 | 1.0 | balance |
| | 36 | 3.5* (0.01 μm*) | 2.0 | 2.0 | 1.3 | 1.0 | balance |
| Conventional product | 46 | $CaF_2$: 1 | 2.0 | 2.0 | 1.3 | 1.0 | balance |

The symbol * means the value which is not within the scope of the present invention.

TABLE 18-2

| Iron-based sintered alloy | | Component ratio of iron-based sintered alloy (mass %) | | | | | | Number of piercing (times) | Remarks |
|---|---|---|---|---|---|---|---|---|---|
| | | $CaCO_3$ | C | Mo | Ni | Co | Fe and inevitable impurities | | |
| Product of the present invention | 144 | 0.46 | 1.3 | 2 | 2 | 1 | balance | 287 | — |
| Comparative products | 35 | 0.01* | 1.3 | 2 | 2 | 1 | balance | 27 | — |
| | 36 | 3.43* | 1.3 | 2 | 2 | 1 | balance | 167 | decrease in strength |
| Conventional product | 46 | $CaF_2$: 1 | 1.3 | 2 | 2 | 1 | balance | 37 | — |

The symbol * means the value which is not within the scope of the present invention.

As is apparent from the results shown in Table 18-1 and Table 18-2, the number of piercing of the cylindrical sintered alloy block for piercing test made of the sintered alloy 144 of the present invention is larger than that of the cylindrical sintered alloy block for piercing test made of the conventional sintered alloy 46 and therefore the sintered alloy of the present invention is excellent in machinability. However, the comparative sintered alloy 35 containing $CaCO_3$ in the content of less than the range defined in the present invention is inferior in machinability because of small number of piercing, while the comparative sintered alloy 36 containing $CaCO_3$ in the content of more than the range defined in the present invention is excellent in machinability because of large number of piercing, but shows drastically decreased deflection strength, and therefore it is not preferred.

EXAMPLE 19

As raw powders, a $CaCO_3$ powder having an average particle size of 0.6 μm, a $CaF_2$ powder having an average particle size of 36 μm and a SUS316 (Fe-17% Cr-12% Ni-2.5% Mo) powder having an average particle size of 80 μm were prepared. These raw powders were blended according to the formulation shown in Table 19, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 145 of the present invention, comparative sintered alloys 37 to 38, and a conventional sintered alloy 47.

Cylindrical sintered alloy blocks for piercing test each having a diameter of 30 mm and a height of 10 mm, made of the sintered alloy 145 of the present invention, the comparative sintered alloys 37 to 38, and the conventional sintered alloy 47 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 19. Machinability was evaluated by the results.

TABLE 19

| Iron-based sintered alloy | | Component ratio of raw powder (mass %): $CaCO_3$ powder Average particle size is described in parenthesis. | SUS316 (Fe-17% Cr-12% Ni-2.5% Mo) powder | Component ratio of iron-based sintered alloy (mass %): $CaCO_3$ | Cr | Ni | Mo | Fe and inevitable impurities | Number of piercing (times) | Remarks |
|---|---|---|---|---|---|---|---|---|---|---|
| Product of the present invention | 145 | 0.5 (0.6 μm) | balance | 0.48 | 17.1 | 12.3 | 2.2 | balance | 175 | — |
| Comparative products | 37 | 0.02* (40 μm*) | balance | 0.01* | 17.1 | 12.3 | 2.2 | balance | 6 | — |
| | 38 | 3.5* (0.01 μm*) | balance | 3.43* | 17.1 | 12.3 | 2.2 | balance | 105 | decrease in strength |
| Conventional product | 47 | $CaF_2$: 1 | balance | $CaF_2$: 1 | 17.1 | 12.3 | 2.2 | balance | 15 | — |

The symbol * means the value which is not within the scope of the present invention.

As is apparent from the results shown in Table 19, the number of piercing of the cylindrical sintered alloy block for piercing test made of the sintered alloy 145 of the present invention is larger than that of the cylindrical sintered alloy block for piercing test made of the conventional sintered alloy 47 and therefore the sintered alloy of the present invention is excellent in machinability. However, the comparative sintered alloy 37 containing $CaCO_3$ in the content of less than the range defined in the present invention is inferior in machinability because of small number of piercing, while the comparative sintered alloy 38 containing $CaCO_3$ in the content of more than the range defined in the present invention is excellent in machinability because of large number of piercing, but shows drastically decreased deflection strength, and therefore it is not preferred.

EXAMPLE 20

As raw powders, a $CaCO_3$ powder having an average particle size of 0.6 μm, a $CaF_2$ powder having an average particle size of 36 μm and a SUS430 (Fe-17% Cr) powder having an average particle size of 80 μm were prepared. These raw powders were blended according to the formulation shown in Table 20, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 146 of the present invention, comparative sintered alloys 39 to 40, and a conventional sintered alloy 48.

Cylindrical sintered alloy blocks for piercing test each having a diameter of 30 mm and a height of 10 mm, made of the sintered alloy 146 of the present invention, the comparative sintered alloys 39 to 40, and the conventional sintered alloy 48 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 20. Machinability was evaluated by the results.

TABLE 20

| Iron-based sintered alloy | | Component ratio of raw powder (mass %): $CaCO_3$ powder Average particle size is described in parenthesis. | SUS430 (Fe-17% Cr) powder | Component ratio of iron-based sintered alloy (mass %): $CaCO_3$ | Cr | Fe and inevitable impurities | Number of piercing (times) | Remarks |
|---|---|---|---|---|---|---|---|---|
| Product of the present invention | 146 | 0.5 (0.6 μm) | balance | 0.45 | 16.7 | balance | 193 | |
| Comparative products | 39 | 0.02 (40 μm*) | balance | 0.01* | 16.7 | balance | 24 | |
| | 40 | 35* (0.01 μm*) | balance | 3.43* | 16.7 | balance | 134 | decrease in strength |
| Conventional product | 48 | $CaF_2$: 1 | balance | $CaF_2$: 1 | 16.7 | balance | 31 | |

The symbol * means the value which is not within the scope of the present invention.

As is apparent from the results shown in Table 20, the number of piercing of the cylindrical sintered alloy block for piercing test made of the sintered alloy 146 of the present invention is larger than that of the cylindrical sintered alloy block for piercing test made of the conventional sintered alloy 48 and therefore the sintered alloy of the present invention is excellent in machinability. However, the comparative sintered alloy 39 containing $CaCO_3$ in the content of less than the range defined in the present invention is inferior in machinability because of small number of piercing, while the comparative sintered alloy 40 containing $CaCO_3$ in the content of more than the range defined in the present invention is excellent in machinability because of large number of piercing, but shows drastically decreased deflection strength, and therefore it is not preferred.

As is apparent from the results shown in Table 21, the number of piercing of the cylindrical sintered alloy block for piercing test made of the sintered alloy 147 of the present invention is larger than that of the cylindrical sintered alloy block for piercing test made of the conventional sintered alloy 49 and therefore the sintered alloy of the present invention is excellent in machinability. However, the comparative sintered alloy 41 containing $CaCO_3$ in the content of less than the range defined in the present invention is inferior in machinability because of small number of piercing, while the comparative sintered alloy 42 containing $CaCO_3$ in the content of more than the range defined in the present invention is excellent in machinability because of large number of piercing, but shows drastically decreased deflection strength, and therefore it is not preferred.

EXAMPLE 21

As raw powders, a $CaCO_3$ powder having an average particle size of 0.6 μm, a $CaF_2$ powder having an average particle size of 36 μm, a C powder having an average particle size of 18 μm and a SUS410 (Fe-13% Cr) powder having an average particle size of 80 μm were prepared. These raw powders were blended according to the formulation shown in Table 21, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 147 of the present invention, comparative sintered alloys 41 to 42, and a conventional sintered alloy 49.

Cylindrical sintered alloy blocks for piercing test each having a diameter of 30 mm and a height of 10 mm, made of the sintered alloy 147 of the present invention, the comparative sintered alloys 41 to 42, and the conventional sintered alloy 49 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 21. Machinability was evaluated by the results.

EXAMPLE 22

As raw powders, a $CaCO_3$ powder having an average particle size of 0.6 μm, a $CaF_2$ powder having an average particle size of 36 μm and a SUS630 (Fe-17% Cr-4% Ni-4% Cu-0.3% Nb) powder having an average particle size of 80 μm were prepared. These raw powders were blended according to the formulation shown in Table 22, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 148 of the present invention, comparative sintered alloys 43 to 44, and a conventional sintered alloy 50.

Cylindrical sintered alloy blocks for piercing test each having a diameter of 30 mm and a height of 10 mm, made of the sintered alloy 148 of the present invention, the comparative sintered alloys 43 to 44, and the conventional sintered alloy 50 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 22. Machinability was evaluated by the results.

TABLE 21

| | | Component ratio of raw powder (mass %) | | | Component ratio of iron-based sintered alloy (mass %) | | | | | |
|---|---|---|---|---|---|---|---|---|---|---|
| | | $CaCO_3$ powder | | | | | | | | |
| Iron-based sintered alloy | | Average particle size is described in parenthesis. | C powder | SUS410 (Fe-13% Cr) powder | $CaCO_3$ | Cr | C | Fe and inevitable impurities | Number of piercing (times) | Remarks |
| Product of the present invention | 147 | 0.5 (0.6 μm) | 0.15 | balance | 0.49 | 12.8 | 0.1 | balance | 157 | — |
| Comparative products | 41 | 0.02* (40 μm*) | 0.15 | balance | 0.01* | 12.8 | 0.1 | balance | 10 | — |
| | 42 | 3.5* (0.01 μm*) | 0.15 | balance | 3.47* | 12.8 | 0.1 | balance | 115 | decrease in strength |
| Conventional product | 49 | $CaF_2$: 1 | 0.15 | balance | $CaF_2$: 1 | 12.8 | 0.1 | balance | 18 | — |

The symbol * means the value which is not within the scope of the present invention.

TABLE 22

| Iron-based sintered alloy | | Component ratio of raw powder (mass %) $CaCO_3$ powder Average particle size is described in parenthesis. | #SUS630 powder | Component ratio of iron-based sintered alloy (mass %) $CaCO_3$ | Cr | Ni | Cu | Nb | Fe and inevitable impurities | Number of piercing (times) | Remarks |
|---|---|---|---|---|---|---|---|---|---|---|---|
| Product of the present invention | 148 | 0.5 (0.6 μm) | balance | 0.45 | 16.8 | 4.1 | 4 | 0.3 | balance | 143 | — |
| Comparative products | 43 | 0.02* (40 μm*) | balance | 0.01* | 16.8 | 4.1 | 4 | 0.3 | balance | 13 | — |
| | 44 | 3.5* (0.01 μm*) | balance | 3.43* | 16.8 | 4.1 | 4 | 0.3 | balance | 108 | decrease in strength |
| Conventional product | 50 | $CaF_2$: 1 | balance | $CaF_2$: 1 | 16.8 | 4.1 | 4 | 0.3 | balance | 16 | — |

#SUS630 (Fe-17% Cr-4% Ni-4% Cu-0.3% Nb)
The symbol * means the value which is not within the scope of the present invention.

As is apparent from the results shown in Table 22, the number of piercing of the cylindrical sintered alloy block for piercing test made of the sintered alloy 148 of the present invention is larger than that of the cylindrical sintered alloy block for piercing test made of the conventional sintered alloy 50 and therefore the sintered alloy of the present invention is excellent in machinability. However, the comparative sintered alloy 43 containing $CaCO_3$ in the content of less than the range defined in the present invention is inferior in machinability because of small number of piercing, while the comparative sintered alloy 44 containing $CaCO_3$ in the content of more than the range defined in the present invention is excellent in machinability because of large number of piercing, but shows drastically decreased deflection strength, and therefore it is not preferred.

EXAMPLE 23

As raw powders, a $SrCO_3$ powder having an average particle size shown in Table 23 and a pure Fe powder having an average particle size of 80 μm were prepared. These raw powders were blended according to the formulation shown in Table 23, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 149 to 158 of the present invention and comparative sintered alloys 45 to 46.

Cylindrical sintered alloy blocks for piercing test each having a diameter of 30 mm and a height of 10 mm, made of the sintered alloys 149 to 158 of the present invention and the comparative sintered alloys 45 to 46 were produced and these cylindrical sintered alloy blocks for piercing test were repeatedly pierced until the drill is damaged, using a high-speed steel drill having a diameter of 1.2 mm, under the following conditions:

Rotating speed: 10000 rpm
Feed speed: 0.030 mm/rev.
Cutting oil: none (dry).

The number of piercing (maximum number of piercing, lifetime) of one new drill was measured. The results are shown in Table 23. Machinability was evaluated by the results.

TABLE 23

| Iron-based sintered alloy | | Component ratio of raw powder (mass %) $SrCO_3$ powder Average particle size is described in parenthesis. | Fe powder | Component ratio of iron-based sintered alloy (mass %) $SrCO_3$ | Fe and inevitable impurities | Number of piercing (times) | Remarks |
|---|---|---|---|---|---|---|---|
| Products of the present invention | 149 | 0.05 (0.1 μm) | balance | 0.05 | balance | 63 | — |
| | 150 | 0.2 (0.5 μm) | balance | 0.19 | balance | 130 | — |
| | 151 | 0.5 (1 μm) | balance | 0.49 | balance | 145 | — |
| | 152 | 1.0 (1 μm) | balance | 0.98 | balance | 212 | — |
| | 153 | 1.3 (0.5 μm) | balance | 1.28 | balance | 190 | — |
| | 154 | 1.5 (2 μm) | balance | 1.49 | balance | 245 | — |
| | 155 | 1.8 (18 μm) | balance | 1.80 | balance | 197 | — |
| | 156 | 2.1 (2 μm) | balance | 2.09 | balance | 188 | — |
| | 157 | 2.5 (18 μm) | balance | 2.47 | balance | 219 | — |
| | 158 | 3.0 (30 μm) | balance | 2.99 | balance | 305 | — |
| Comparative products | 45 | 0.02* (40 μm*) | balance | 0.01 | balance | 25 | — |
| | 46 | 3.5* (0.01 μm*) | balance | 3.47* | balance | 146 | decrease in strength |

The symbol * means the value which is not within the scope of the present invention.

As is apparent from the results shown in Table 23, the number of piercing of the cylindrical sintered alloy blocks for piercing test made of the sintered alloys 149 to 158 of the present invention is larger than that of the cylindrical sintered alloy blocks for piercing test made of the conventional sintered alloys 1 to 3 shown in Table 1 and therefore the sintered alloys of the present invention are excellent in machinability. However, the comparative sintered alloy 45 containing $SrCO_3$ in the content of less than the range defined in the present invention is inferior in machinability because of small number of piercing, while the comparative sintered alloy 46 containing $SrCO_3$ in the content of more than the range defined in the present invention is excellent in machinability because of large number of piercing, but shows drastically decreased deflection strength, and therefore it is not preferred.

EXAMPLE 24

As raw powders, a $SrCO_3$ powder having an average particle size shown in Table 24 and a Fe-0.6 mass % P powder having an average particle size of 80 μm were prepared. These raw powders were blended according to the formulation shown in Table 24, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 159 to 168 of the present invention and comparative sintered alloys 47 to 48.

Cylindrical sintered alloy blocks for piercing test each having a diameter of 30 mm and a height of 10 mm, made of the sintered alloys 159 to 168 of the present invention and the comparative sintered alloys 47 to 48 were produced and these cylindrical sintered alloy blocks for piercing test were repeatedly pierced until the drill is damaged, using a high-speed steel drill having a diameter of 1.2 mm, under the following conditions:

Rotating speed: 10000 rpm
Feed speed: 0.030 mm/rev.
Cutting oil: none (dry).

The number of piercing (maximum number of piercing, lifetime) of one new drill was measured. The results are shown in Table 24. Machinability was evaluated by the results.

As is apparent from the results shown in Table 24, the number of piercing of the cylindrical sintered alloy blocks for piercing test made of the sintered alloys 159 to 168 of the present invention is larger than that of the cylindrical sintered alloy blocks for piercing test made of the conventional sintered alloys 4 to 6 shown in Table 2 and therefore the sintered alloys of the present invention are excellent in machinability. However, the comparative sintered alloy 47 containing $SrCO_3$ in the content of less than the range defined in the present invention is inferior in machinability because of small number of piercing, while the comparative sintered alloy 48 containing $SrCO_3$ in the content of more than the range defined in the present invention is excellent in machinability because of large number of piercing, but shows drastically decreased deflection strength, and therefore it is not preferred.

EXAMPLE 25

As raw powders, a $SrCO_3$ powder having an average particle size shown in Table 25, a Fe powder having an average particle size of 80 μm and a C powder having an average particle size of 18 μm were prepared. These raw powders were blended according to the formulation shown in Table 25, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 169 to 178 of the present invention and comparative sintered alloys 49 to 50.

Cylindrical sintered alloy blocks for piercing test each having a diameter of 30 mm and a height of 10 mm, made of the sintered alloys 169 to 178 of the present invention and the comparative sintered alloys 49 to 50 were produced and these cylindrical sintered alloy blocks for piercing test were repeatedly pierced until the drill is damaged, using a high-speed steel drill having a diameter of 1.2 mm, under the following conditions:

TABLE 24

| | | Component ratio of raw powder (mass %) | | Component ratio of iron-based sintered alloy (mass %) | | | | |
|---|---|---|---|---|---|---|---|---|
| | | $SrCO_3$ powder | | | | | | |
| Iron-based sintered alloy | | Average particle size is described in parenthesis. | Fe-based alloy powder# | $SrCO_3$ | P | Fe and inevitable impurities | Number of piercing (times) | Remarks |
| Products of the present invention | 159 | 0.05 (0.1 μm) | balance | 0.04 | 0.55 | balance | 51 | — |
| | 160 | 0.2 (0.5 μm) | balance | 0.18 | 0.58 | balance | 121 | — |
| | 161 | 0.5 (1 μm) | balance | 0.49 | 0.53 | balance | 167 | — |
| | 162 | 1.0 (1.0 μm) | balance | 0.99 | 0.53 | balance | 169 | — |
| | 163 | 1.3 (0.5 μm) | balance | 1.28 | 0.57 | balance | 148 | — |
| | 184 | 1.5 (2 μm) | balance | 1.48 | 0.57 | balance | 178 | — |
| | 165 | 1.8 (18 μm) | balance | 1.79 | 0.54 | balance | 159 | — |
| | 166 | 2.1 (2 μm) | balance | 2.07 | 0.53 | balance | 110 | — |
| | 167 | 2.5 (18 μm) | balance | 2.49 | 0.55 | balance | 135 | — |
| | 168 | 3.0 (30 μm) | balance | 2.99 | 0.55 | balance | 178 | — |
| Comparative products | 47 | 0.02* (40 μm*) | balance | 0.02* | 0.56 | balance | 28 | — |
| | 48 | 3.5* (0.01 μm*) | balance | 3.48* | 0.54 | balance | 163 | decrease in strength |

The symbol * means the value which is not within the scope of the present invention.
#Fe-based alloy powder with the composition of Fe-0.6 mass % P Rotating speed: 10000 rpm
Feed speed: 0.018 mm/rev.
Cutting oil: none (dry).

The number of piercing (maximum number of piercing, lifetime) of one new drill was measured. The results are shown in Table 25. Machinability was evaluated by the results.

TABLE 25

| Iron-based sintered alloy | | Component ratio of raw powder (mass %) $SrCO_3$ powder Average particle size is described in parenthesis. | C powder | Fe powder | Infiltration Cu | Component ratio of iron-based sintered alloy (mass %) $SrCO_3$ | C | Cu | Fe and inevitable impurities | Number of piercing (times) | Remarks |
|---|---|---|---|---|---|---|---|---|---|---|---|
| Products of the present invention | 169 | 0.05 (0.1 μm) | 0.13 | balance | 20 | 0.05 | 0.12 | 19.5 | balance | 83 | — |
| | 170 | 0.2 (0.5 μm) | 0.3 | balance | 20 | 0.20 | 0.24 | 20.2 | balance | 130 | — |
| | 171 | 0.5 (1 μm) | 0.6 | balance | 20 | 0.49 | 0.54 | 20.1 | balance | 175 | — |
| | 172 | 1.0 (2 μm) | 0.8 | balance | 20 | 0.97 | 0.75 | 19.6 | balance | 203 | — |
| | 173 | 1.3 (0.5 μm) | 1.1 | balance | 20 | 1.28 | 1.05 | 19.9 | balance | 182 | — |
| | 174 | 1.6 (2 μm) | 1.1 | balance | 20 | 1.46 | 0.99 | 20.4 | balance | 192 | — |
| | 175 | 1.8 (18 μm) | 1.1 | balance | 20 | 1.77 | 1.05 | 19.8 | balance | 183 | — |
| | 176 | 2.1 (2 μm) | 1.1 | balance | 20 | 2.09 | 1.07 | 20.0 | balance | 209 | — |
| | 177 | 2.5 (18 μm) | 1.1 | balance | 20 | 2.45 | 1.07 | 19.7 | balance | 197 | — |
| | 178 | 3.0 (30 μm) | 1.2 | balance | 20 | 2.96 | 1.15 | 19.9 | balance | 172 | — |
| Comparative products | 49 | 0.02* (40 μm*) | 1.1 | balance | 20 | 0.01* | 1.04 | 20.3 | balance | 25 | — |
| | 50 | 3.5* (0.01 μm*) | 1.1 | balance | 20 | 3.45* | 1.06 | 19.6 | balance | 124 | decrease in strength |

The symbol * means the value which is not within the scope of the present invention.

As is apparent from the results shown in Table 25, the number of piercing of the cylindrical sintered alloy blocks for piercing test made of the sintered alloys 169 to 178 of the present invention is larger than that of the cylindrical sintered alloy blocks for piercing test made of the conventional sintered alloys 7 to 9 shown in Table 3 and therefore the sintered alloys of the present invention are excellent in machinability. However, the comparative sintered alloy 49 containing $SrCO_3$ in the content of less than the range defined in the present invention is inferior in machinability because of small number of piercing, while the comparative sintered alloy 50 containing $SrCO_3$ in the content of more than the range defined in the present invention is excellent in machinability because of large number of piercing, but shows drastically decreased deflection strength, and therefore it is not preferred.

EXAMPLE 26

As raw powders, a $SrCO_3$ powder having an average particle size shown in Table 26, a Fe powder having an average particle size of 80 μm and a C powder having an average particle size of 18 μm were prepared. These raw powders were blended according to the formulation shown in Table 26, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes and subjected to 20% Cu infiltration to obtain iron-based sintered alloys 179 to 188 of the present invention and comparative sintered alloys 51 to 52.

Cylindrical sintered alloy blocks for piercing test each having a diameter of 30 mm and a height of 10 mm, made of the sintered alloys 179 to 188 of the present invention and the comparative sintered alloys 51 to 52 were produced and these cylindrical sintered alloy blocks for piercing test were repeatedly pierced until the drill is damaged, using a high-speed steel drill having a diameter of 1.2 mm, under the following conditions:

Rotating speed: 10000 rpm
Feed speed: 0.018 mm/rev.
Cutting oil: none (dry).

The number of piercing (maximum number of piercing, lifetime) of one new drill was measured. The results are shown in Table 26. Machinability was evaluated by the results.

TABLE 26

| Iron-based sintered alloy | | Component ratio of raw powder (mass %) $SrCO_3$ powder Average particle size is described in parenthesis. | C powder | Fe powder | Component ratio of iron-based sintered alloy (mass %) $SrCO_3$ | C | Fe and inevitable impurities | Number of piercing (times) | Remarks |
|---|---|---|---|---|---|---|---|---|---|
| Products of the present invention | 179 | 0.05 (0.1 μm) | 0.13 | balance | 0.05 | 0.12 | balance | 75 | — |
| | 180 | 0.2 (0.5 μm) | 0.3 | balance | 0.20 | 0.24 | balance | 110 | — |
| | 181 | 0.5 (1 μm) | 0.6 | balance | 0.49 | 0.54 | balance | 156 | — |
| | 182 | 1.0 (2 μm) | 0.8 | balance | 0.97 | 0.75 | balance | 172 | — |
| | 183 | 1.3 (0.5 μm) | 1.1 | balance | 1.28 | 1.05 | balance | 181 | — |
| | 184 | 1.5 (2 μm) | 1.1 | balance | 1.46 | 0.99 | balance | 205 | — |

TABLE 26-continued

| Iron-based sintered alloy | | Component ratio of raw powder (mass %) $SrCO_3$ powder Average particle size is described in parenthesis. | C powder | Fe powder | Component ratio of iron-based sintered alloy (mass %) $SrCO_3$ | C | Fe and inevitable impurities | Number of piercing (times) | Remarks |
|---|---|---|---|---|---|---|---|---|---|
| | 185 | 1.8 (18 μm) | 1.1 | balance | 1.77 | 1.05 | balance | 171 | — |
| | 186 | 2.1 (2 μm) | 1.1 | balance | 2.09 | 1.07 | balance | 220 | — |
| | 187 | 2.5 (18 μm) | 1.1 | balance | 2.45 | 1.07 | balance | 199 | — |
| | 188 | 3.0 (30 μm) | 1.2 | balance | 2.96 | 1.15 | balance | 194 | — |
| Comparative products | 51 | 0.02* (40 μm*) | 1.1 | balance | 0.01* | 1.04 | balance | 15 | — |
| | 52 | 3.5* (0.01 μm*) | 1.1 | balance | 3.45* | 1.06 | balance | 122 | decrease in strength |

The symbol * means the value which is not within the scope of the present invention.

As is apparent from the results shown in Table 26, the number of piercing of the cylindrical sintered alloy blocks for piercing test made of the sintered alloys 179 to 188 of the present invention is larger than that of the cylindrical sintered alloy blocks for piercing test made of the conventional sintered alloys 10 to 12 shown in Table 4 and therefore the sintered alloys of the present invention are excellent in machinability. However, the comparative sintered alloy 51 containing $SrCO_3$ in the content of less than the range defined in the present invention is inferior in machinability because of small number of piercing, while the comparative sintered alloy 52 containing $SrCO_3$ in the content of more than the range defined in the present invention is excellent in machinability because of large number of piercing, but shows drastically decreased deflection strength, and therefore it is not preferred.

EXAMPLE 27

As raw powders, a $SrCO_3$ powder having an average particle size shown in Table 27, a Fe powder having an average particle size of 80 μm, a Cu powder having an average particle size of 25 μm and a C powder having an average particle size of 18 μm were prepared. These raw powders were blended according to the formulation shown in Table 27, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 189 to 198 of the present invention and comparative sintered alloys 53 to 54.

Cylindrical sintered alloy blocks for piercing test each having a diameter of 30 mm and a height of 10 mm, made of the sintered alloys 189 to 198 of the present invention and the comparative sintered alloys 53 to 54 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.030 mm/rev.

Cutting oil: none (dry).

The number of piercing (maximum number of piercing, lifetime) of one new drill was measured. The results are shown in Table 27. Machinability was evaluated by the results.

TABLE 27

| Iron-based sintered alloy | | Component ratio of raw powder (mass %) $SrCO_3$ powder Average particle size is described in parenthesis. | Cu powder | C powder | Fe powder | Component ratio of iron-based sintered alloy (mass %) $SrCO_3$ | Cu | C | Fe and inevitable impurities | Number of piercing (times) | Remarks |
|---|---|---|---|---|---|---|---|---|---|---|---|
| Products of the present invention | 189 | 0.05 (0.1 μm) | 0.2 | 0.13 | balance | 0.03 | 2.0 | 0.11 | balance | 48 | — |
| | 190 | 0.2 (0.5 μm) | 2 | 0.25 | balance | 0.18 | 2.1 | 0.22 | balance | 127 | — |
| | 191 | 0.5 (1 μm) | 2 | 0.98 | balance | 0.48 | 1.9 | 0.87 | balance | 136 | — |
| | 192 | 1.0 (2 μm) | 2 | 0.7 | balance | 0.96 | 2.0 | 0.68 | balance | 225 | — |
| | 193 | 1.3 (0.5 μm) | 2 | 0.7 | balance | 1.25 | 2.0 | 0.64 | balance | 247 | — |
| | 194 | 1.5 (2 μm) | 4 | 0.7 | balance | 1.46 | 4.0 | 0.65 | balance | 229 | — |
| | 195 | 1.8 (18 μm) | 5.8 | 0.7 | balance | 1.77 | 5.7 | 0.67 | balance | 213 | — |
| | 196 | 2.1 (2 μm) | 4 | 0.7 | balance | 2.09 | 3.9 | 0.64 | balance | 200 | — |
| | 197 | 2.5 (18 μm) | 2 | 0.98 | balance | 2.48 | 2.0 | 0.92 | balance | 179 | — |
| | 198 | 3.0 (30 μm) | 2 | 1.2 | balance | 2.97 | 2.0 | 1.16 | balance | 154 | — |
| Comparative products | 53 | 0.02* (40 μm*) | 2 | 0.7 | balance | 0.01* | 1.9 | 0.67 | balance | 8 | — |
| | 54 | 3.5* (0.01 μm*) | 2 | 0.7 | balance | 3.47* | 2.0 | 0.65 | balance | 148 | decrease in strength |

The symbol * means the value which is not within the scope of the present invention.

As is apparent from the results shown in Table 27, the number of piercing of the cylindrical sintered alloy blocks for piercing test made of the sintered alloys 189 to 198 of the present invention is larger than that of the cylindrical sintered alloy blocks for piercing test made of the conventional sintered alloys 13 to 15 shown in Table 5 and therefore the sintered alloys of the present invention are excellent in machinability. However, the comparative sintered alloy 53 containing $SrCO_3$ in the content of less than the range defined in the present invention is inferior in machinability because of small number of piercing, while the comparative sintered alloy 54 containing $SrCO_3$ in the content of more than the range defined in the present invention is excellent in machinability because of large number of piercing, but shows drastically decreased deflection strength, and therefore it is not preferred.

EXAMPLE 28

As raw powders, a $SrCO_3$ powder having an average particle size shown in Table 28, a partially diffused Fe-based alloy powder having an average particle size of 80 μm with the composition of Fe-1.5% Cu-4.0% Ni-0.5% Mo and a C powder having an average particle size of 18 μm were prepared. These raw powders were blended according to the formulation shown in Table 28, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 199 to 208 of the present invention and comparative sintered alloys 55 to 56.

Cylindrical sintered alloy blocks for piercing test each having a diameter of 30 mm and a height of 10 mm, made of the sintered alloys 199 to 208 of the present invention and the comparative sintered alloys 55 to 56 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 28. Machinability was evaluated by the results.

TABLE 28

| Iron-based sintered alloy | | Component ratio of raw powder (mass %): $SrCO_3$ powder, Average particle size is described in parenthesis. | C powder | Fe-based alloy powder# | Component ratio of iron-based sintered alloy (mass %): $SrCO_3$ | Cu | C | Ni | Mo | Fe and inevitable impurities | Number of piercing (times) | Remarks |
|---|---|---|---|---|---|---|---|---|---|---|---|---|
| Products of the present invention | 199 | 0.05 (0.1 μm) | 0.13 | balance | 0.03 | 1.5 | 0.11 | 3.9 | 0.50 | balance | 51 | — |
| | 200 | 0.2 (0.5 μm) | 0.25 | balance | 0.18 | 1.5 | 0.19 | 4.0 | 0.50 | balance | 148 | — |
| | 201 | 0.5 (1 μm) | 0.98 | balance | 0.46 | 1.5 | 0.85 | 4.0 | 0.50 | balance | 208 | — |
| | 202 | 1.0 (2 μm) | 0.5 | balance | 0.96 | 1.4 | 0.47 | 4.1 | 0.52 | balance | 308 | — |
| | 203 | 1.3 (0.5 μm) | 0.5 | balance | 1.25 | 1.5 | 0.45 | 4.0 | 0.50 | balance | 301 | — |
| | 204 | 1.5 (2 μm) | 0.5 | balance | 1.45 | 1.5 | 0.45 | 4.0 | 0.50 | balance | 315 | — |
| | 205 | 1.8 (18 μm) | 0.5 | balance | 1.72 | 1.5 | 0.47 | 4.0 | 0.49 | balance | 268 | — |
| | 206 | 2.1 (2 μm) | 0.5 | balance | 2.05 | 1.6 | 0.47 | 3.8 | 0.50 | balance | 298 | — |
| | 207 | 2.5 (18 μm) | 1.0 | balance | 2.44 | 1.5 | 0.90 | 4.0 | 0.50 | balance | 286 | — |
| | 208 | 3.0 (30 μm) | 1.2 | balance | 2.93 | 1.5 | 1.17 | 4.0 | 0.50 | balance | 248 | — |
| Comparative products | 55 | 0.02* (40 μm*) | 0.5 | balance | 0.01* | 1.5 | 0.43 | 4.1 | 0.50 | balance | 9 | — |
| | 56 | 3.5* (0.01 μm*) | 0.5 | balance | 3.42* | 1.5 | 0.44 | 4.0 | 0.51 | balance | 130 | decrease in strength |

The symbol * means the value which is not within the scope of the present invention.
#partially diffused Fe-based alloy powder having an average particle size of 80 μm with the composition of Fe-1.5% Cu-4.0% Ni-0.5% Mo As is apparent from the results shown in Table 28, the number of piercing of the cylindrical sintered alloy blocks for piercing test made of the sintered alloys 199 to 208 of the present invention is larger than that of the cylindrical sintered alloy blocks for piercing test made of the conventional sintered alloys 16 to 18 shown in Table 6 and therefore the sintered alloys of the present invention are excellent in machinability. However, the comparative sintered alloy 55 containing $SrCO_3$ in the content of less than the range defined in the present invention is inferior in machinability because of small number of piercing, while the comparative sintered alloy 56 containing $SrCO_3$ in the content of more than the range defined in the present invention is excellent in machinability because of large number of piercing, but shows drastically decreased deflection strength, and therefore it is not preferred.

EXAMPLE 29

As raw powders, a $SrCO_3$ powder having an average particle size shown in Table 29, a Fe-based alloy powder having an average particle size of 80 μm with the composition of Fe-1.5% Mo and a C powder having an average particle size of 18 μm were prepared. These raw powders were blended according to the formulation shown in Table 29, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 209 to 218 of the present invention and comparative sintered alloys 57 to 58.

Cylindrical sintered alloy blocks for piercing test each having a diameter of 30 mm and a height of 10 mm, made of the sintered alloys 209 to 218 of the present invention and the comparative sintered alloys 57 to 58 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 29. Machinability was evaluated by the results.

TABLE 29

| Iron-based sintered alloy | | Component ratio of raw powder (mass %) $SrCO_3$ powder Average particle size is described in parenthesis. | C powder | Fe-based alloy powder# | Component ratio of iron-based sintered alloy (mass %) $SrCO_3$ | C | Mo | Fe and inevitable impurities | Number of piercing (times) | Remarks |
|---|---|---|---|---|---|---|---|---|---|---|
| Products of the present invention | 209 | 0.05 (0.1 μm) | 0.13 | balance | 0.04 | 0.11 | 1.48 | balance | 55 | — |
| | 210 | 0.2 (0.5 μm) | 0.25 | balance | 0.18 | 0.19 | 1.48 | balance | 89 | — |
| | 211 | 0.5 (1 μm) | 0.98 | balance | 0.48 | 0.88 | 1.50 | balance | 83 | — |
| | 212 | 1.0 (2 μm) | 0.5 | balance | 0.98 | 0.45 | 1.51 | balance | 187 | — |
| | 213 | 1.3 (0.5 μm) | 0.5 | balance | 1.25 | 0.44 | 1.50 | balance | 214 | — |
| | 214 | 1.5 (2 μm) | 0.5 | balance | 1.46 | 0.47 | 1.51 | balance | 235 | — |
| | 215 | 1.8 (18 μm) | 0.5 | balance | 1.73 | 0.43 | 1.46 | balance | 210 | — |
| | 216 | 2.1 (2 μm) | 0.5 | balance | 2.01 | 0.48 | 1.48 | balance | 222 | — |
| | 217 | 2.5 (18 μm) | 1.0 | balance | 2.45 | 0.96 | 1.50 | balance | 156 | — |
| | 218 | 3.0 (30 μm) | 1.2 | balance | 2.93 | 1.13 | 1.48 | balance | 169 | — |
| Comparative products | 57 | 0.02* (40 μm*) | 0.5 | balance | 0.01* | 0.45 | 1.50 | balance | 18 | — |
| | 58 | 3.5* (0.01 μm*) | 0.5 | balance | 3.47* | 0.46 | 1.50 | balance | 106 | decrease in strength |

The symbol * means the value which is not within the scope of the present invention.

#Fe-based alloy powder having a particle size of 80 μm with the composition of Fe-1.5% Mo As is apparent from the results shown in Table 29, the number of piercing of the cylindrical sintered alloy blocks for piercing test made of the sintered alloys 209 to 218 of the present invention is larger than that of the cylindrical sintered alloy blocks for piercing test made of the conventional sintered alloys 19 to 21 shown in Table 7 and therefore the sintered alloys of the present invention are excellent in machinability. However, the comparative sintered alloy 57 containing $SrCO_3$ in the content of less than the range defined in the present invention is inferior in machinability because of small number of piercing, while the comparative sintered alloy 58 containing $SrCO_3$ in the content of more than the range defined in the present invention is excellent in machinability because of large number of piercing, but shows drastically decreased deflection strength, and therefore it is not preferred.

EXAMPLE 30

As raw powders, a $SrCO_3$ powder having an average particle size shown in Table 30, a Fe-based alloy powder having an average particle size of 80 μm with the composition of Fe-3.0% Cr-0.5% Mo and a C powder having an average particle size of 18 μm were prepared. These raw powders were blended according to the formulation shown in Table 30, mixed in a double corn mixer and compacted to obtain a green compact, and then the resulting green compact was sintered in an $N_2$+5% $H_2$ gas mixture under the conditions of a temperature of 1120° C. and a retention time of 20 minutes to obtain iron-based sintered alloys 219 to 228 of the present invention and comparative sintered alloys 59 to 60.

Cylindrical sintered alloy blocks for piercing test each having a diameter of 30 mm and a height of 10 mm, made of the sintered alloys 219 to 228 of the present invention and the comparative sintered alloys 59 to 60 were produced and these cylindrical sintered alloy blocks for piercing test were repeatedly pierced until the drill is damaged, using a high-speed steel drill having a diameter of 1.2 mm, under the following conditions:

Rotating speed: 10000 rpm

Feed speed: 0.006 mm/rev.

Cutting oil: none (dry).

The number of piercing (maximum number of piercing, lifetime) of one new drill was measured. The results are shown in Table 30. Machinability was evaluated by the results.

TABLE 30

| Iron-based sintered alloy | | Component ratio of raw powder (mass %) $SrCO_3$ powder Average particle size is described in parenthesis. | C powder | Fe-based alloy powder# | Component ratio of iron-based sintered alloy (mass %) $SrCO_3$ | C | Cr | Mo | Fe and inevitable impurities | Number of piercing (times) | Remarks |
|---|---|---|---|---|---|---|---|---|---|---|---|
| Products of the present | 219 | 0.05 (0.1 μm) | 0.13 | balance | 0.03 | 0.11 | 3.0 | 0.50 | balance | 56 | — |
| | 220 | 0.2 (0.5 μm) | 0.25 | balance | 0.19 | 0.19 | 3.0 | 0.50 | balance | 87 | — |

TABLE 30-continued

| Iron-based sintered alloy | | Component ratio of raw powder (mass %) $SrCO_3$ powder Average particle size is described in parenthesis. | C powder | Fe-based alloy powder# | Component ratio of iron-based sintered alloy (mass %) $SrCO_3$ | C | Cr | Mo | Fe and inevitable impurities | Number of piercing (times) | Remarks |
|---|---|---|---|---|---|---|---|---|---|---|---|
| invention | 221 | 0.5 (1 μm) | 0.98 | balance | 0.48 | 0.85 | 3.0 | 0.51 | balance | 98 | — |
| | 222 | 1.0 (2 μm) | 0.5 | balance | 0.97 | 0.47 | 3.0 | 0.50 | balance | 150 | — |
| | 223 | 1.3 (0.5 μm) | 0.5 | balance | 1.27 | 0.45 | 2.9 | 0.50 | balance | 203 | — |
| | 224 | 1.5 (2 μm) | 0.5 | balance | 1.44 | 0.45 | 3.0 | 0.51 | balance | 211 | — |
| | 225 | 1.8 (18 μm) | 0.5 | balance | 1.72 | 0.44 | 3.0 | 0.49 | balance | 175 | — |
| | 226 | 2.1 (2 μm) | 0.5 | balance | 1.95 | 0.44 | 3.1 | 0.48 | balance | 188 | — |
| | 227 | 2.5 (18 μm) | 1.0 | balance | 2.39 | 0.90 | 3.0 | 0.50 | balance | 142 | — |
| | 228 | 3.0 (30 μm) | 1.2 | Balance | 2.91 | 1.17 | 3.0 | 0.50 | balance | 111 | — |
| Comparative products | 59 | 0.02* (40 μm*) | 0.5 | balance | 0.01* | 0.43 | 3.1 | 0.50 | balance | 2 | — |
| | 60 | 3.5* (0.01 μm*) | 0.5 | balance | 3.45* | 0.45 | 3.0 | 0.50 | balance | 98 | decrease in strength |

The symbol * means the value which is not within the scope of the present invention.
#Fe-based alloy powder having a particle size of: 80 μm with the composition of Fe-3.0% Cr-0.5% Mo As is apparent from the results shown in Table 30, the number of piercing of the cylindrical sintered alloy blocks for piercing test made of the sintered alloys 219 to 228 of the present invention is larger than that of the cylindrical sintered alloy blocks for piercing test made of the conventional sintered alloys 22 to 24 shown in Table 8 and therefore the sintered alloys of the present invention are excellent in machinability. However, the comparative sintered alloy 59 containing $SrCO_3$ in the content of less than the range defined in the present invention is inferior in machinability because of small number of piercing, while the comparative sintered alloy 60 containing $SrCO_3$ in the content of more than the range defined in the present invention is excellent in machinability because of large number of piercing, but shows drastically decreased deflection strength, and therefore it is not preferred.

EXAMPLE 31

As raw powders, a $SrCO_3$ powder having an average particle size shown in Table 31, a Fe-based alloy powder having an average particle size of 80 μm with the composition of Fe-3.0% Cr-0.5% Mo, a Ni powder having an average particle size of 3 μm and a C powder having an average particle size of 18 μm were prepared. These raw powders were blended according to the formulation shown in Table 31, mixed in a double corn mixer and compacted to obtain a green compact, and then the resulting green compact was sintered in an $N_2$+5% $H_2$ gas mixture under the conditions of a temperature of 1120° C. and a retention time of 20 minutes to obtain iron-based sintered alloys 229 to 238 of the present invention and comparative sintered alloys 61 to 62.

Cylindrical sintered alloy blocks for piercing test each having a diameter of 30 mm and a height of 10 mm, made of the sintered alloys 229 to 238 of the present invention and the comparative sintered alloys 61 to 62 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 31. Machinability was evaluated by the results.

TABLE 31

| Iron-based sintered alloy | | Component ratio of raw powder (mass %) $SrCO_3$ powder Average particle size is described in parenthesis. | C powder | Ni powder | Fe-based alloy powder# | Component ratio of iron-based sintered alloy (mass %) $SrCO_3$ | C | Ni | Cr | Mo | Fe and inevitable impurities | Number of piercing (times) | Remarks |
|---|---|---|---|---|---|---|---|---|---|---|---|---|---|
| Products of the present invention | 229 | 0.05 (0.1 μm) | 0.13 | 0.2 | balance | 0.03 | 0.11 | 0.2 | 3.0 | 0.50 | balance | 57 | — |
| | 230 | 0.2 (0.5 μm) | 0.25 | 2 | balance | 0.19 | 0.19 | 1.9 | 2.8 | 0.50 | balance | 100 | — |
| | 231 | 0.5 (1 μm) | 0.98 | 4 | balance | 0.48 | 0.85 | 4.1 | 3.0 | 0.49 | balance | 125 | — |
| | 232 | 1.0 (2 μm) | 0.5 | 4 | balance | 0.97 | 0.47 | 4.0 | 3.0 | 0.50 | balance | 184 | — |
| | 233 | 1.3 (0.5 μm) | 0.5 | 4 | balance | 1.27 | 0.45 | 4.0 | 2.9 | 0.50 | balance | 122 | — |
| | 234 | 1.5 (2 μm) | 0.5 | 4 | balance | 1.44 | 0.45 | 4.0 | 3.0 | 0.49 | balance | 145 | — |
| | 235 | 1.8 (18 μm) | 0.5 | 4 | balance | 1.72 | 0.44 | 3.9 | 2.9 | 0.49 | balance | 144 | — |
| | 236 | 2.1 (2 μm) | 0.5 | 6 | balance | 1.95 | 0.44 | 6.0 | 3.0 | 0.50 | balance | 135 | — |
| | 237 | 2.5 (18 μm) | 1.0 | 8 | balance | 2.39 | 0.90 | 7.9 | 3.0 | 0.50 | balance | 126 | — |
| | 238 | 3.0 (30 μm) | 1.2 | 9.8 | balance | 2.91 | 1.17 | 9.8 | 3.0 | 0.50 | balance | 108 | — |

TABLE 31-continued

| Iron-based sintered alloy | | Component ratio of raw powder (mass %) $SrCO_3$ powder Average particle size is described in parenthesis. | C powder | Ni powder | Fe-based alloy powder# | Component ratio of iron-based sintered alloy (mass %) $SrCO_3$ | C | Ni | Cr | Mo | Fe and inevitable impurities | Number of piercing (times) | Remarks |
|---|---|---|---|---|---|---|---|---|---|---|---|---|---|
| Comparative products | 61 | 0.02* (40 μm*) | 0.5 | 4 | balance | 0.01* | 0.43 | 4.0 | 3.0 | 0.50 | balance | 5 | — |
| | 62 | 3.5* (0.01 μm*) | 0.5 | 4 | balance | 3.45* | 0.45 | 4.0 | 3.0 | 0.50 | balance | 120 | decrease in strength |

The symbol * means the value which is not within the scope of the present invention.
#Fe-based alloy powder having a particle size of: 80 μm with the composition of Fe-3.0% Cr-0.5% Mo As is apparent from the results shown in Table 31, the number of piercing of the cylindrical sintered alloy blocks for piercing test made of the sintered alloys 229 to 238 of the present invention is larger than that of the cylindrical sintered alloy blocks for piercing test made of the conventional sintered alloys 25 to 27 shown in Table 9 and therefore the sintered alloys of the present invention are excellent in machinability. However, the comparative sintered alloy 61 containing $SrCO_3$ in the content of less than the range defined in the present invention is inferior in machinability because of small number of piercing, while the comparative sintered alloy 62 containing $SrCO_3$ in the content of more than the range defined in the present invention is excellent in machinability because of large number of piercing, but shows drastically decreased deflection strength, and therefore it is not preferred.

EXAMPLE 32

As raw powders, a $SrCO_3$ powder having an average particle size shown in Table 32, a Fe-based alloy powder having an average particle size of 80 μm with the composition of Fe-3.0% Cr-0.5% Mo, a Cu powder having an average particle size of 25 μm, a Ni powder having an average particle size of 3 μm and a C powder having an average particle size of 18 μm were prepared. These raw powders were blended according to the formulation shown in Table 32, mixed in a double corn mixer and compacted to obtain a green compact, and then the resulting green compact was sintered in an $N_2$+5% $H_2$ gas mixture under the conditions of a temperature of 1120° C. and a retention time of 20 minutes to obtain iron-based sintered alloys 239 to 248 of the present invention and comparative sintered alloys 63 to 64.

Cylindrical sintered alloy blocks for piercing test each having a diameter of 30 mm and a height of 10 mm, made of the sintered alloys 239 to 248 of the present invention and the comparative sintered alloys 63 to 64 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 32. Machinability was evaluated by the results.

TABLE 32

| Iron-based sintered alloy | | Component ratio of raw powder (mass %) $SrCO_3$ powder Average particle size is described in parenthesis. | Cu powder | C powder | Ni powder | Fe-based alloy powder# | Component ratio of iron-based sintered alloy (mass %) $SrCO_3$ | Cu | C | Ni | Cr | Mo | Fe and inevitable impurities | Number of piercing (times) | Remarks |
|---|---|---|---|---|---|---|---|---|---|---|---|---|---|---|---|
| Products of the present invention | 239 | 0.05 (0.1 μm) | 0.2 | 0.13 | 0.2 | balance | 0.03 | 0.2 | 0.11 | 0.2 | 3.0 | 0.50 | balance | 31 | — |
| | 240 | 0.2 (0.5 μm) | 2 | 0.25 | 2 | balance | 0.19 | 2.1 | 0.22 | 2.0 | 3.0 | 0.50 | balance | 95 | — |
| | 241 | 0.5 (1 μm) | 2 | 0.98 | 4 | balance | 0.48 | 1.9 | 0.92 | 4.0 | 3.0 | 0.49 | balance | 108 | — |
| | 242 | 1.0 (2 μm) | 2 | 0.5 | 4 | balance | 0.97 | 2.0 | 0.47 | 4.0 | 3.1 | 0.51 | balance | 145 | — |
| | 243 | 1.3 (0.5 μm) | 2 | 0.5 | 4 | balance | 1.27 | 2.0 | 0.47 | 3.9 | 2.9 | 0.50 | balance | 149 | — |
| | 244 | 1.5 (2 μm) | 4 | 0.5 | 4 | balance | 1.44 | 4.0 | 0.45 | 4.0 | 3.0 | 0.50 | balance | 143 | — |
| | 245 | 1.8 (18 μm) | 5.8 | 0.5 | 4 | balance | 1.77 | 5.8 | 0.45 | 4.0 | 3.0 | 0.49 | balance | 136 | — |
| | 246 | 2.1 (2 μm) | 4 | 0.5 | 6 | balance | 2.04 | 4.0 | 0.44 | 6.0 | 3.0 | 0.50 | balance | 151 | — |
| | 247 | 2.5 (18 μm) | 2 | 1.0 | 8 | balance | 2.42 | 2.0 | 0.94 | 7.9 | 3.0 | 0.50 | balance | 140 | — |
| | 248 | 3.0 (30 μm) | 2 | 1.2 | 9.8 | balance | 2.96 | 2.0 | 1.15 | 9.8 | 3.0 | 0.50 | balance | 121 | — |
| Comparative products | 63 | 0.02* (40 μm*) | 2 | 0.5 | 4 | balance | 0.01* | 1.9 | 0.46 | 4.1 | 3.0 | 0.50 | balance | 3 | — |
| | 64 | 3.5* (0.01 μm*) | 2 | 0.5 | 4 | balance | 3.46* | 2.0 | 0.45 | 4.0 | 3.0 | 0.50 | balance | 125 | decrease in strength |

The symbol * means the value which is not within the scope of the present invention.
#Fe-based alloy powder having a particle size of 80 μm with the composition of Fe-3.0% Cr-0.5% Mo As is apparent from the results shown in Table 32, the number of piercing of the cylindrical sintered alloy blocks for piercing test made of the sintered alloys 239 to 248 of the present invention is larger than that of the cylindrical sintered alloy blocks for piercing test made of the conventional sintered alloys 28 to 30 shown in Table 10 and therefore the sintered alloys of the present invention are excellent in machinability. However, the comparative sintered alloy 63 containing $SrCO_3$ in the content of less than the range defined in the present invention is inferior in machinability because of small number of piercing, while the comparative sintered alloy 64 containing $SrCO_3$ in the content of more than the range defined in the present invention is excellent in machinability because of large number of piercing, but shows drastically decreased deflection strength, and therefore it is not preferred.

EXAMPLE 33

As raw powders, a $SrCO_3$ powder having an average particle size shown in Table 33, a Fe powder having an average particle size of 80 μm, a Ni powder having an average particle size of 3 μm and a C powder having an average particle size of 18 μm were prepared. These raw powders were blended according to the formulation shown in Table 33, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 249 to 258 of the present invention and comparative sintered alloys 65 to 66.

Cylindrical sintered alloy blocks for piercing test each having a diameter of 30 mm and a height of 10 mm, made of the sintered alloys 249 to 258 of the present invention and the comparative sintered alloys 65 to 66 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.009 mm/rev.
Cutting oil: none (dry).

The number of piercing (maximum number of piercing, lifetime) of one new drill was measured. The results are shown in Table 33. Machinability was evaluated by the results.

As is apparent from the results shown in Table 33, the number of piercing of the cylindrical sintered alloy blocks for piercing test made of the sintered alloys 249 to 258 of the present invention is larger than that of the cylindrical sintered alloy blocks for piercing test made of the conventional sintered alloys 31 to 33 shown in Table 11 and therefore the sintered alloys of the present invention are excellent in machinability. However, the comparative sintered alloy 65 containing $SrCO_3$ in the content of less than the range defined in the present invention is inferior in machinability because of small number of piercing, while the comparative sintered alloy 66 containing $SrCO_3$ in the content of more than the range defined in the present invention is excellent in machinability because of large number of piercing, but shows drastically decreased deflection strength, and therefore it is not preferred.

EXAMPLE 34

As raw powders, a $SrCO_3$ powder having an average particle size shown in Table 34, a Fe powder having an average particle size of 80 μm, a Ni powder having an average particle size of 3 μm, a Mo powder having an average particle size of 3 μm and a C powder having an average particle size of 18 μm were prepared. These raw powders were blended according to the formulation shown in Table 34, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 259 to 268 of the present invention and comparative sintered alloys 67 to 68. Cylindrical sintered alloy blocks for piercing test each having a diameter of 30 mm and a height of 10 mm, made of the sintered alloys 259 to 268 of the present invention and the comparative sintered alloys 67 to 68 were produced and these cylindrical sintered alloy blocks for piercing test were repeatedly pierced until the drill is damaged, using a high-speed steel drill having a diameter of 1.2 mm, under the following conditions:

TABLE 33

| | | Component ratio of raw powder (mass %) | | | | Component ratio of iron-based sintered alloy (mass %) | | | | | |
|---|---|---|---|---|---|---|---|---|---|---|---|
| | | $SrCO_3$ powder | | | | | | | | | |
| Iron-based sintered alloy | | Average particle size is described in parenthesis. | C powder | Ni powder | Fe powder | $SrCO_3$ | C | Ni | Fe and inevitable impurities | Number of piercing (times) | Remarks |
| Products of the present invention | 249 | 0.05 (0.1 μm) | 0.13 | 0.2 | balance | 0.04 | 0.12 | 0.2 | balance | 45 | — |
| | 250 | 0.2 (0.5 μm) | 0.25 | 1 | balance | 0.24 | 0.23 | 1.0 | balance | 80 | — |
| | 251 | 0.5 (1 μm) | 0.98 | 3 | balance | 0.47 | 0.92 | 2.9 | balance | 86 | — |
| | 252 | 1.0 (2 μm) | 0.5 | 3 | balance | 0.98 | 0.46 | 3.0 | balance | 202 | — |
| | 253 | 1.3 (0.5 μm) | 0.5 | 3 | balance | 1.28 | 0.44 | 3.0 | balance | 136 | — |
| | 254 | 1.5 (2 μm) | 0.5 | 3 | balance | 1.47 | 0.47 | 3.0 | balance | 187 | — |
| | 255 | 1.8 (18 μm) | 0.5 | 3 | balance | 1.75 | 0.46 | 3.0 | balance | 196 | — |
| | 256 | 2.1 (2 μm) | 0.5 | 6 | balance | 2.06 | 0.45 | 6.0 | balance | 154 | — |
| | 257 | 2.5 (18 μm) | 1.0 | 8 | balance | 2.44 | 0.92 | 8.0 | balance | 136 | — |
| | 258 | 3.0 (30 μm) | 1.2 | 9.8 | balance | 2.98 | 1.13 | 9.8 | balance | 95 | — |
| Comparative products | 65 | 0.02* (40 μm*) | 0.5 | 3 | balance | 0.01* | 0.45 | 3.0 | balance | 5 | — |
| | 66 | 3.5* (0.01 μm*) | 0.5 | 3 | balance | 3.49* | 0.45 | 3.0 | balance | 137 | decrease in strength |

The symbol * means the value which is not within the scope of the present invention.

Rotating speed: 5000 rpm
Feed speed: 0.009 mm/rev.
Cutting oil: none (dry).

The number of piercing (maximum number of piercing, lifetime) of one new drill was measured. The results are shown in Table 34. Machinability was evaluated by the results.

TABLE 34

| Iron-based sintered alloy | | Component ratio of raw powder (mass %) $SrCO_3$ powder Average particle size is described in parenthesis. | C powder | Ni powder | Mo powder | Fe powder | Component ratio of iron-based sintered alloy (mass %) $SrCO_3$ | C | Ni | Mo | Fe and inevitable impurities | Number of piercing (times) | Remarks |
|---|---|---|---|---|---|---|---|---|---|---|---|---|---|
| Products of the present invention | 259 | 0.05 (0.1 μm) | 0.13 | 0.2 | 0.2 | balance | 0.05 | 0.11 | 0.2 | 0.2 | balance | 55 | — |
| | 260 | 0.2 (0.5 μm) | 0.25 | 1 | 0.3 | balance | 0.19 | 0.18 | 1.0 | 0.3 | balance | 101 | — |
| | 261 | 0.5 (1 μm) | 0.98 | 4 | 0.5 | balance | 0.44 | 0.93 | 4.0 | 0.5 | balance | 103 | — |
| | 262 | 1.0 (2 μm) | 0.6 | 4 | 0.5 | balance | 0.98 | 0.55 | 4.0 | 0.5 | balance | 204 | — |
| | 263 | 1.3 (0.5 μm) | 0.6 | 4 | 0.5 | balance | 1.28 | 0.57 | 4.0 | 0.5 | balance | 214 | — |
| | 264 | 1.5 (2 μm) | 0.6 | 4 | 1 | balance | 1.48 | 0.54 | 3.9 | 1.0 | balance | 187 | — |
| | 265 | 1.8 (18 μm) | 0.6 | 4 | 3 | balance | 0.76 | 0.54 | 3.9 | 2.9 | balance | 169 | — |
| | 266 | 2.1 (2 μm) | 0.6 | 6 | 4.8 | balance | 1.94 | 0.54 | 6.0 | 4.7 | balance | 159 | — |
| | 267 | 2.5 (18 μm) | 1.0 | 8 | 0.5 | balance | 2.47 | 0.95 | 8.0 | 0.5 | balance | 128 | — |
| | 268 | 3.0 (30 μm) | 1.2 | 9.8 | 0.5 | balance | 2.95 | 1.14 | 9.8 | 0.5 | balance | 159 | — |
| Comparative products | 67 | 0.02* (40 μm*) | 0.6 | 4 | 0.5 | balance | 0.01* | 0.54 | 4.0 | 0.5 | balance | 9 | — |
| | 68 | 3.5* (6.01 μm*) | 0.6 | 4 | 0.5 | balance | 3.46* | 0.54 | 4.0 | 0.5 | balance | 106 | decrease in strength |

The symbol * means the value which is not within the scope of the present invention.

As is apparent from the results shown in Table 34, the number of piercing of the cylindrical sintered alloy blocks for piercing test made of the sintered alloys 259 to 268 of the present invention is larger than that of the cylindrical sintered alloy blocks for piercing test made of the conventional sintered alloys 34 to 36 shown in Table 12 and therefore the sintered alloys of the present invention are excellent in machinability. However, the comparative sintered alloy 67 containing $SrCO_3$ in the content of less than the range defined in the present invention is inferior in machinability because of small number of piercing, while the comparative sintered alloy 68 containing $SrCO_3$ in the content of more than the range defined in the present invention is excellent in machinability because of large number of piercing, but shows drastically decreased deflection strength, and therefore it is not preferred.

EXAMPLE 35

As raw powders, a $SrCO_3$ powder having an average particle size shown in Table 35, a Fe powder having an average particle size of 80 μm, a Ni powder having an average particle size of 3 μm, a Cu powder having an average particle size of 25 μm and a C powder having an average particle size of 18 μm were prepared. These raw powders were blended according to the formulation shown in Table 35, mixed in a double corn mixer and compacted to obtain a green compact, and then the resulting green compact was sintered in an endothermic gas (ratio of components $H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 269 to 278 of the present invention and comparative sintered alloys 69 to 70.

Cylindrical sintered alloy blocks for piercing test each having a diameter of 30 mm and a height of 10 mm, made of the sintered alloys 269 to 278 of the present invention and the comparative sintered alloys 69 to 70 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.009 mm/rev.
Cutting oil: none (dry).

The number of piercing (maximum number of piercing, lifetime) of one new drill was measured. The results are shown in Table 35. Machinability was evaluated by the results.

TABLE 35

| Iron-based sintered alloy | | Component ratio of raw powder (mass %) $SrCO_3$ powder Average particle size is described in parenthesis. | Cu powder | C powder | Ni powder | Fe powder | Component ratio of iron-based sintered alloy (mass %) $SrCO_3$ | Cu | C | Ni | Fe and inevitable impurities | Number of piercing (times) | Remarks |
|---|---|---|---|---|---|---|---|---|---|---|---|---|---|
| Products of the present invention | 269 | 0.05 (0.1 μm) | 0.2 | 0.13 | 0.2 | balance | 0.04 | 0.2 | 0.11 | 0.2 | balance | 49 | — |
| | 270 | 0.2 (0.5 μm) | 1 | 0.25 | 1 | balance | 0.19 | 1.0 | 0.21 | 1.0 | balance | 100 | — |
| | 271 | 0.5 (1 μm) | 1 | 0.98 | 3 | balance | 0.45 | 1.0 | 0.95 | 3.0 | balance | 128 | — |
| | 272 | 1.0 (2 μm) | 1 | 0.6 | 3 | balance | 0.96 | 0.99 | 0.55 | 3.0 | balance | 180 | — |
| | 273 | 1.3 (0.5 μm) | 2 | 0.6 | 3 | balance | 1.27 | 1.0 | 0.54 | 3.0 | balance | 184 | — |
| | 274 | 1.5 (2 μm) | 4 | 0.6 | 3 | balance | 1.48 | 4.0 | 0.55 | 2.9 | balance | 158 | — |

TABLE 35-continued

| Iron-based sintered alloy | | Component ratio of raw powder (mass %) $SrCO_3$ powder Average particle size is described in parenthesis. | Cu powder | C powder | Ni powder | Fe powder | Component ratio of iron-based sintered alloy (mass %) $SrCO_3$ | Cu | C | Ni | Fe and inevitable impurities | Number of piercing (times) | Remarks |
|---|---|---|---|---|---|---|---|---|---|---|---|---|---|
| | 275 | 1.8 (18 μm) | 5.8 | 0.6 | 3 | balance | 1.76 | 5.7 | 0.56 | 3.0 | balance | 179 | — |
| | 276 | 2.1 (2 μm) | 1 | 0.6 | 6 | balance | 1.95 | 1.0 | 0.55 | 6.0 | balance | 164 | — |
| | 277 | 2.5 (18 μm) | 1 | 1.0 | 8 | balance | 2.45 | 1.0 | 0.91 | 8.0 | balance | 155 | — |
| | 278 | 3.0 (30 μm) | 1 | 1.2 | 9.8 | balance | 2.96 | 1.0 | 1.16 | 9.8 | balance | 147 | — |
| Comparative | 69 | 0.02* (40 μm*) | 1 | 0.6 | 3 | balance | 0.01* | 1.0 | 0.55 | 3.0 | balance | 10 | — |
| products | 70 | 3.5* (0.01 μm*) | 1 | 0.6 | 3 | balance | 3.44* | 1.0 | 0.55 | 3.0 | balance | 75 | decrease in strength |

The symbol * means the value which is not within the scope of the present invention.

As is apparent from the results shown in Table 35, the number of piercing of the cylindrical sintered alloy blocks for piercing test made of the sintered alloys 269 to 278 of the present invention is larger than that of the cylindrical sintered alloy blocks for piercing test made of the conventional sintered alloys 37 to 39 shown in Table 13 and therefore the sintered alloys of the present invention are excellent in machinability. However, the comparative sintered alloy 69 containing $SrCO_3$ in the content of less than the range defined in the present invention is inferior in machinability because of small number of piercing, while the comparative sintered alloy 70 containing $SrCO_3$ in the content of more than the range defined in the present invention is excellent in machinability because of large number of piercing, but shows drastically decreased deflection strength, and therefore it is not preferred

EXAMPLE 36

As raw powders, a $SrCO_3$ powder having an average particle size shown in Table 36, a Fe powder having an average particle size of 80 μm, a Cu—P powder having an average particle size of 25 μm and a C powder having an average particle size of 18 μm were prepared. These raw powders were blended according to the formulation shown in Table 36, mixed in a double corn mixer and compacted to obtain a green compact, and then the resulting green compact was sintered in an endothermic gas (ratio of components=$H_2$: 40.5%, CO: 19.8%, $CO_2$: 0.1%, CH: 0.5%, and $N_2$: 39.1%) atmosphere under the conditions of a temperature of 1120° C. and a retention time of 20 minutes to obtain iron-based sintered alloys 279 to 288 of the present invention and comparative sintered alloys 71 to 72.

Cylindrical sintered alloy blocks for piercing test each having a diameter of 30 mm and a height of 10 mm, made of the sintered alloys 279 to 288 of the present invention and the comparative sintered alloys 71 to 72 were produced and these cylindrical sintered alloy blocks for piercing test were repeatedly pierced until the drill is damaged, using a high-speed steel drill having a diameter of 1.2 mm, under the following conditions:

Rotating speed: 10000 rpm
Feed speed: 0.009 mm/rev.
Cutting oil: none (dry).

The number of piercing (maximum number of piercing, lifetime) of one new drill was measured. The results are shown in Table 36. Machinability was evaluated by the results.

TABLE 36

| Iron-based sintered alloy | | Component ratio of raw powder (mass %) $SrCO_3$ powder Average particle size is described in parenthesis. | C powder | Cu-P powder | Fe powder | Component ratio of iron-based sintered alloy (mass %) $SrCO_3$ | C | Cu | P | Fe and inevitable impurities | Number of piercing (times) | Remarks |
|---|---|---|---|---|---|---|---|---|---|---|---|---|
| Products of the | 279 | 0.05 (0.1 μm) | 1.0 | 0.7 | balance | 0.03 | 0.90 | 0.6 | 0.1 | balance | 71 | — |
| present | 280 | 0.2 (0.5 μm) | 1.5 | 1.2 | balance | 0.17 | 1.42 | 1.1 | 0.1 | balance | 88 | — |
| invention | 281 | 0.5 (1 μm) | 1.5 | 1.8 | balance | 0.46 | 1.45 | 1.6 | 0.2 | balance | 102 | — |
| | 282 | 1.0 (2 μm) | 2.0 | 1.8 | balance | 0.95 | 1.95 | 1.6 | 0.2 | balance | 199 | — |
| | 283 | 1.3 (0.5 μm) | 2.0 | 2.8 | balance | 1.25 | 1.94 | 2.5 | 0.3 | balance | 240 | — |
| | 284 | 1.5 (2 μm) | 2.0 | 2.8 | balance | 1.44 | 1.93 | 2.5 | 0.3 | balance | 209 | — |
| | 285 | 1.8 (18 μm) | 2.0 | 3.3 | balance | 1.73 | 1.94 | 3 | 0.3 | balance | 255 | — |
| | 286 | 2.1 (2 μm) | 2.5 | 6.0 | balance | 1.89 | 2.45 | 5.4 | 0.6 | balance | 190 | — |
| | 287 | 2.5 (18 μm) | 2.5 | 8.0 | balance | 2.40 | 2.44 | 5 | 0.6 | balance | 202 | — |
| | 288 | 3.0 (30 μm) | 3.0 | 9.0 | balance | 2.92 | 2.97 | 8.2 | 0.8 | balance | 265 | — |
| Comparative | 71 | 0.02* (40 μm*) | 1 | 2.8 | balance | 0.01* | 0.44 | 2.5 | 0.3 | balance | 5 | — |
| products | 72 | 3.5* (0.01 μm*) | 1 | 2.8 | balance | 3.43* | 0.45 | 2.5 | 0.3 | balance | 169 | decrease in strength |

The symbol * means the value which is not within the scope of the present invention.

As is apparent from the results shown in Table 36, the number of piercing of the cylindrical sintered alloy blocks for piercing test made of the sintered alloys 279 to 288 of the present invention is larger than that of the cylindrical sintered alloy blocks for piercing test made of the conventional sintered alloys 40 to 42 shown in Table 14 and therefore the sintered alloys of the present invention are excellent in machinability. However, the comparative sintered alloy 71 containing $SrCO_3$ in the content of less than the range defined in the present invention is inferior in machinability because of small number of piercing, while the comparative sintered alloy 72 containing $SrCO_3$ in the content of more than the range defined in the present invention is excellent in machinability because of large number of piercing, but shows drastically decreased deflection strength, and therefore it is not preferred.

EXAMPLE 37

As raw powders, a $SrCO_3$ powder having an average particle size of 1 μm and a Fe-6% Cr-6% Mo-9% W-3% V-10% Co-1.5% C powder having an average particle size of 80 μm were prepared. These raw powders were blended according to the formulation shown in Table 37, mixed in a double corn mixer and compacted to obtain a green compact, and then the resulting green compact was sintered in a dissociated ammonia gas atmosphere under the conditions of a temperature of 1150° C. and a retention time of 60 minutes to obtain an iron-based sintered alloy 289 of the present invention and comparative sintered alloys 73 to 74.

Cylindrical sintered alloy blocks for piercing test each having a diameter of 30 mm and a height of 10 mm, made of the sintered alloy 289 of the present invention and the comparative sintered alloys 73 to 74 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 37. Machinability was evaluated by the results.

TABLE 37

| Iron-based sintered alloy | | Component ratio of raw powder (mass %): $SrCO_3$ powder Average particle size is described in parenthesis. | Component ratio of raw powder (mass %): Fe-6% Cr-6% Mo-9% W-3% V-10% Co-1.5% C powder | Component ratio of iron-based sintered alloy (mass %): $SrCO_3$ | C | Cr | Mo | W | Co | V | Fe and inevitable impurities | Number of piercing (times) | Remarks |
|---|---|---|---|---|---|---|---|---|---|---|---|---|---|
| Product of the present invention | 289 | 0.5 (1 μm) | balance | 0.49 | 1.5 | 6 | 6 | 9 | 10 | 3 | balance | 150 | — |
| Comparative products | 73 | 0.02* (40 μm*) | balance | 0.01* | 1.5 | 6 | 6 | 9 | 10 | 3 | balance | 16 | — |
| | 74 | 3.5* (0.01 μm*) | balance | 3.43* | 1.5 | 6 | 6 | 9 | 10 | 3 | balance | 121 | decrease in strength |

The symbol * means the value which is not within the scope of the present invention.

As is apparent from the results shown in Table 37, the number of piercing of the cylindrical sintered alloy block for piercing test made of the sintered alloy 289 of the present invention is larger than that of the cylindrical sintered alloy block for piercing test made of the conventional sintered alloy 43 shown in Table 15 and therefore the sintered alloy of the present invention is excellent in machinability. However, the comparative sintered alloy 73 containing $SrCO_3$ in the content of less than the range defined in the present invention is inferior in machinability because of small number of piercing, while the comparative sintered alloy 74 containing $SrCO_3$ in the content of more than the range defined in the present invention is excellent in machinability because of large number of piercing, but shows drastically decreased deflection strength, and therefore it is not preferred.

EXAMPLE 38

As raw powders, a $SrCO_3$ powder having an average particle size of 1 μm, a Fe-based alloy powder having an average particle size of 80 μm with the composition of Fe-13% Cr-5% Nb-0.8% Si, a Fe powder having an average particle size of 80 μm, a Ni powder having an average particle size of 3 μm, a Mo powder having an average particle size of 3 μm, a Co-based alloy powder having an average particle size of 80 μm with the composition of Co-30% Mo-10% Cr-3% Si, a Cr-based alloy powder having an average particle size of 80 μm with the composition of Cr-25% Co-25% W-11.5% Fe-1% Nb-1% Si-1.5% C, a Co powder having an average particle size of 30 μm and a C powder having an average particle size of 18 μm were prepared. These raw powders were blended according to the formulation shown in Table 38-1, mixed in a double corn mixer and compacted to obtain a green compact, and then the resulting green compact was sintered in a vacuum atmosphere at 0.1 Pa under the conditions of a temperature of 1150° C. and a retention time of 60 minutes to obtain an iron-based sintered alloy 290 of the present invention and comparative sintered alloys 75 to 76 shown in Table 38-2.

Cylindrical sintered alloy blocks for piercing test each having a diameter of 30 mm and a height of 10 mm, made of the sintered alloy 290 of the present invention and the comparative sintered alloys 75 to 76 were produced and these cylindrical sintered alloy blocks for piercing test were repeatedly pierced until the drill is damaged, using a high-speed steel drill having a diameter of 1.2 mm, under the following conditions: edly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 38-2. Machinability was evaluated by the results.

TABLE 38-1

| Iron-based sintered alloy | | Component ratio of raw powder (mass %) $SrCO_3$ powder Average particle size is described in parenthesis. | Mo powder | Co-based alloy powder# | Cr-based alloy powder# | Ni powder | C powder | Co powder | Fe-based alloy powder# | Fe powder |
|---|---|---|---|---|---|---|---|---|---|---|
| Product of the present invention | 290 | 0.5 (1 μm) | 9.0 | 10 | 12 | 3 | 0.8 | 3.3 | 10 | balance |
| Comparative products | 75 | 0.02* (40 μm*) | 9.0 | 10 | 12 | 3 | 0.8 | 3.3 | 10 | balance |
| | 76 | 3.5* (0.01 μm*) | 9.0 | 10 | 12 | 3 | 0.8 | 3.3 | 10 | balance |

Fe-based alloy powder#: Fe-13% Cr-5% Nb-0.8% Si
Co-based alloy powder#: Co-30% Mo-10% Cr-3% Si
Cr-based alloy powder#: Cr-25% Co-25% W-11.5% Fe-1% Nb-1% Si-1.5% C
The symbol * means the value which is not within the scope of the present invention.

TABLE 38-2

| Iron-based sintered alloy | | Component ratio of iron-based sintered alloy (mass %) $SrCO_3$ | C | Cr | Mo | W | Ni | Si | Co | Nb | Fe and inevitable impurities | Number of piercing (times) | Remarks |
|---|---|---|---|---|---|---|---|---|---|---|---|---|---|
| Product of the present invention | 290 | 0.47 | 1 | 6 | 12 | 3 | 3 | 0.5 | 11.7 | 1.1 | balance | 265 | — |
| Comparative products | 75 | 0.01* | 1 | 6 | 12 | 3 | 3 | 0.5 | 11.7 | 1.1 | balance | 18 | — |
| | 76 | 3.47* | 1 | 6 | 12 | 3 | 3 | 0.5 | 11.7 | 1.1 | balance | 152 | decrease in strength |

The symbol * means the value which is not within the scope of the present invention.

As is apparent from the results shown in Table 38-1 and Table 38-2, the number of piercing of the cylindrical sintered alloy block for piercing test made of the sintered alloy 290 of the present invention is larger than that of the cylindrical sintered alloy block for piercing test made of the conventional sintered alloy 44 shown in Table 16-1 to Table 16-2 and therefore the sintered alloy of the present invention is excellent in machinability. However, the comparative sintered alloy 75 containing $SrCO_3$ in the content of less than the range defined in the present invention is inferior in machinability because of small number of piercing, while the comparative sintered alloy 76 containing $SrCO_3$ in the content of more than the range defined in the present invention is excellent in machinability because of large number of piercing, but shows drastically decreased deflection strength, and therefore it is not preferred.

EXAMPLE 39

As raw powders, a $SrCO_3$ powder having an average particle size of 1 μm, a Fe-based alloy powder having an average particle size of 80 μm with the composition of Fe-13% Cr-5% Nb-0.8% Si, a Fe powder having an average particle size of 80 μm, a Ni powder having an average particle size of 3 μm, a Mo powder having an average particle size of 3 μm, a Co-based alloy powder having an average particle size of 80 μm with the composition of Co-30% Mo-10% Cr-3% Si, a Cr-based alloy powder having an average particle size of 80 μm with the composition of Cr-25% Co-25% W-11.5% Fe-1% Nb-1% Si-1.5% C, a Co powder having an average particle size of 30 μm and a C powder having an average particle size of 18 μm were prepared. These raw powders were blended according to the formulation shown in Table 39-1, mixed in a double corn mixer and compacted to obtain a green compact, and then the resulting green compact was sintered in a vacuum atmosphere at 0.1 Pa under the conditions of a temperature of 1150° C. and a retention time of 60 minutes and subjected to 18% Cu infiltration to obtain an iron-based sintered alloy 291 of the present invention and comparative sintered alloys 77 to 78 shown in Table 39-2.

Cylindrical sintered alloy blocks for piercing test each having a diameter of 30 mm and a height of 10 mm, made of the sintered alloy 291 of the present invention and the comparative sintered alloys 77 to 78 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 39-2. Machinability was evaluated by the results.

TABLE 39-1

| Iron-based sintered alloy | | Component ratio of raw powder (mass %) | | | | | | | | | |
|---|---|---|---|---|---|---|---|---|---|---|---|
| | | $SrCO_3$ powder Average particle size is described in parenthesis. | Mo powder | Co-based alloy powder# | Cr-based alloy powder# | Ni powder | C powder | Co powder | Fe-based alloy powder# | Infiltration Cu | Fe powder |
| Product of the present invention | 291 | 0.5 (1 μm) | 1.5 | 5.0 | 19.0 | 3.0 | 1.5 | 4.4 | 9.0 | 18 | balance |
| Comparative products | 77 | 0.02* (40 μm*) | 1.5 | 5.0 | 19.0 | 3.0 | 1.5 | 4.4 | 9.0 | 18 | balance |
| | 78 | 3.5* (0.01 μm*) | 1.5 | 5.0 | 19.0 | 3.0 | 1.5 | 4.4 | 9.0 | 18 | balance |

Fe-based alloy powder#: Fe-13% Cr-5% Nb-0.8% Si
Co-based alloy powder#: Co-30% Mo-10% Cr-3% Si
Cr-based alloy powder#: Cr-25% Co-25% W-11.5% Fe-1% Nb-1% Si-1.5% C
The symbol * means the value which is not within the scope of the present invention.

TABLE 39-2

| Iron-based sintered alloy | | Component ratio of iron-based sintered alloy (mass %) | | | | | | | | | | | Number of piercing (times) | Remarks |
|---|---|---|---|---|---|---|---|---|---|---|---|---|---|---|
| | | $SrCO_3$ | C | Cr | Mo | W | Ni | Si | Co | Nb | Cu | Fe and inevitable impurities | | |
| Product of the present invention | 291 | 0.49 | 1.8 | 8 | 3 | 4.8 | 5 | 0.4 | 12 | 1.1 | 18 | balance | 337 | — |
| Comparative products | 77 | 0.01* | 1.8 | 8 | 3 | 4.8 | 5 | 0.4 | 12 | 1.1 | 18 | balance | 31 | — |
| | 78 | 3.47* | 1.8 | 8 | 3 | 4.8 | 5 | 0.4 | 12 | 1.1 | 18 | balance | 199 | decrease in strength |

The symbol * means the value which is not within the scope of the present invention.

As is apparent from the results shown in Table 39-1 and Table 39-2, the number of piercing of the cylindrical sintered alloy block for piercing test made of the sintered alloy 291 of the present invention is larger than that of the cylindrical sintered alloy block for piercing test made of the conventional sintered alloy 45 shown in Table 17-1 to Table 17-2 and therefore the sintered alloy of the present invention is excellent in machinability. However, the comparative sintered alloy 77 containing $SrCO_3$ in the content of less than the range defined in the present invention is inferior in machinability because of small number of piercing, while the comparative sintered alloy 78 containing $SrCO_3$ in the content of more than the range defined in the present invention is excellent in machinability because of large number of piercing, but shows drastically decreased deflection strength, and therefore it is not preferred.

EXAMPLE 40

As raw powders, a $SrCO_3$ powder having an average particle size of 1 μm, a Fe powder having an average particle size of 80 μm, a Ni powder having an average particle size of 3 μm, a Mo powder having an average particle size of 3 μm, a Co powder having an average particle size of 30 μm and a C powder having an average particle size of 18 μm were prepared. These raw powders were blended according to the formulation shown in Table 40-1, mixed in a double corn mixer and compacted to obtain a green compact, and then the resulting green compact was sintered in a vacuum atmosphere at 0.1 Pa under the conditions of a temperature of 1150° C. and a retention time of 60 minutes to obtain an iron-based sintered alloy 292 of the present invention and comparative sintered alloys 79 to 80 shown in Table 40-2.

Cylindrical sintered alloy blocks for piercing test each having a diameter of 30 mm and a height of 10 mm, made of the sintered alloy 292 of the present invention and the comparative sintered alloys 79 to 80 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 40-2. Machinability was evaluated by the results.

TABLE 40-1

| Iron-based sintered alloy | | Component ratio of raw powder (mass %) | | | | | |
|---|---|---|---|---|---|---|---|
| | | $SrCO_3$ powder Average particle size is described in parenthesis. | Mo powder | Ni powder | C powder | Co powder | Fe powder |
| Product of the present invention | 292 | 0.5 (1 μm) | 2.0 | 2.0 | 1.3 | 1.0 | balance |
| Comparative products | 79 | 0.02* (40 μm*) | 2.0 | 2.0 | 1.3 | 1.0 | balance |
| | 80 | 3.5* (0.01 μm*) | 2.0 | 2.0 | 1.3 | 1.0 | balance |

The symbol * means the value which is not within the scope of the present invention.

TABLE 40-2

| Iron-based sintered alloy | | Component ratio of iron-based sintered alloy (mass %) $SrCO_3$ | C | Mo | Ni | Co | Fe and inevitable impurities | Number of piercing (times) | Remarks |
|---|---|---|---|---|---|---|---|---|---|
| Product of the present invention | 292 | 0.48 | 1.3 | 2 | 2 | 1 | balance | 278 | — |
| Comparative products | 79 | 0.01* | 1.3 | 2 | 2 | 1 | balance | 23 | — |
| | 80 | 3.45* | 1.3 | 2 | 2 | 1 | balance | 160 | decrease in strength |

The symbol * means the value which is not within the scope of the present invention.

As is apparent from the results shown in Table 40-1 and Table 40-2, the number of piercing of the cylindrical sintered alloy block for piercing test made of the sintered alloy 292 of the present invention is larger than that of the cylindrical sintered alloy block for piercing test made of the conventional sintered alloy 46 shown in Table 18-1 to Table 18-2 and therefore the sintered alloy of the present invention is excellent in machinability. However, the comparative sintered alloy 79 containing $SrCO_3$ in the content of less than the range defined in the present invention is inferior in machinability because of small number of piercing, while the comparative sintered alloy 80 containing $SrCO_3$ in the content of more than the range defined in the present invention is excellent in machinability because of large number of piercing, but shows drastically decreased deflection strength, and therefore it is not preferred.

EXAMPLE 41

As raw powders, a $SrCO_3$ powder having an average particle size of 1 μm and a SUS316 (Fe-17% Cr-12% Ni-2.5% Mo) powder having an average particle size of 80 μm were prepared. These raw powders were blended according to the formulation shown in Table 41, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 293 of the present invention and comparative sintered alloys 81 to 82.

Cylindrical sintered alloy blocks for piercing test each having a diameter of 30 mm and a height of 10 mm, made of the sintered alloy 293 of the present invention and the comparative sintered alloys 81 to 82 were produced and these cylindrical sintered alloy blocks for piercing test were repeatedly pierced until the drill is damaged, using a high-speed steel drill having a diameter of 1.2 mm, under the following conditions:

Rotating speed: 5000 rpm

Feed speed: 0.006 mm/rev.

Cutting oil: none (dry).

The number of piercing (maximum number of piercing, lifetime) of one new drill was measured. The results are shown in Table 41. Machinability was evaluated by the results.

TABLE 41

| Iron-based sintered alloy | | Component ratio of raw powder (mass %) $SrCO_3$ powder Average particle size is described in parenthesis. | SUS316 (Fe-17% Cr-12% Ni-2.5% Mo) powder | Component ratio of iron-based sintered alloy (mass %) $SrCO_3$ | Cr | Ni | Mo | Fe and inevitable impurities | Number of piercing (times) | Remarks |
|---|---|---|---|---|---|---|---|---|---|---|
| Product of the present invention | 293 | 0.5 (1 μm) | balance | 0.46 | 17.1 | 12.3 | 2.2 | balance | 182 | — |
| Comparative products | 81 | 0.02* (40 μm*) | balance | 0.01* | 17.1 | 12.3 | 2.2 | balance | 8 | — |
| | 82 | 3.5* (0.01 μm*) | balance | 3.45* | 17.1 | 12.3 | 2.2 | balance | 111 | decrease in strength |

The symbol * means the value which is not within the scope of the present invention.

As is apparent from the results shown in Table 41, the number of piercing of the cylindrical sintered alloy block for piercing test made of the sintered alloy 293 of the present invention is larger than that of the cylindrical sintered alloy block for piercing test made of the conventional sintered alloy 47 shown in 19 and therefore the sintered alloy of the present invention is excellent in machinability. However, the comparative sintered alloy 81 containing $SrCO_3$ in the content of less than the range defined in the present invention is inferior in machinability because of small number of piercing, while the comparative sintered alloy 82 containing $SrCO_3$ in the content of more than the range defined in the present invention is excellent in machinability because of large number of piercing, but shows drastically decreased deflection strength, and therefore it is not preferred.

EXAMPLE 42

As raw powders, a $SrCO_3$ powder having an average particle size of 1 μm and a SUS430 (Fe-17% Cr) powder having an average particle size of 80 μm were prepared. These raw powders were blended according to the formulation shown in Table 42, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 294 of the present invention and comparative sintered alloys 83 to 84.

Cylindrical sintered alloy blocks for piercing test each having a diameter of 30 mm and a height of 10 mm, made of the sintered alloy 294 of the present invention and the comparative sintered alloys 83 to 84 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 42. Machinability was evaluated by the results.

TABLE 42

| Iron-based sintered alloy | | Component ratio of raw powder (mass %) $SrCO_3$ powder Average particle size is described in parenthesis. | SUS430 (Fe-17% Cr) powder | Component ratio of iron-based sintered alloy (mass %) $SrCO_3$ | Cr | Fe and inevitable impurities | Number of piercing (times) | Remarks |
|---|---|---|---|---|---|---|---|---|
| Product of the present invention | 294 | 0.5 (1 μm) | balance | 0.49 | 16.7 | balance | 201 | — |
| Comparative products | 83 | 0.02* (40 μm*) | balance | 0.01* | 16.7 | balance | 26 | — |
| | 84 | 3.5* (0.01 μm*) | balance | 3.47* | 16.7 | balance | 141 | decrease in strength |

The symbol * means the value which is not within the scope of the present invention.

As is apparent from the results shown in Table 42, the number of piercing of the cylindrical sintered alloy block for piercing test made of the sintered alloy 294 of the present invention is larger than that of the cylindrical sintered alloy block for piercing test made of the conventional sintered alloy 48 shown in 20 and therefore the sintered alloy of the present invention is excellent in machinability. However, the comparative sintered alloy 83 containing $SrCO_3$ in the content of less than the range defined in the present invention is inferior in machinability because of small number of piercing, while the comparative sintered alloy 84 containing $SrCO_3$ in the content of more than the range defined in the present invention is excellent in machinability because of large number of piercing, but shows drastically decreased deflection strength, and therefore it is not preferred.

EXAMPLE 43

As raw powders, a $SrCO_3$ powder having an average particle size of 1 μm, a C powder having an average particle size of 18 μm and a SUS410 (Fe-13% Cr) powder having an average particle size of 80 μm were prepared. These raw powders were blended according to the formulation shown in Table 43, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 295 of the present invention and comparative sintered alloys 85 to 86.

Cylindrical sintered alloy blocks for piercing test each having a diameter of 30 mm and a height of 10 mm, made of the sintered alloy 295 of the present invention and the comparative sintered alloys 85 to 86 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 43. Machinability was evaluated by the results.

TABLE 43

| Iron-based sintered alloy | | Component ratio of raw powder (mass %) $SrCO_3$ powder Average particle size is described in parenthesis. | C powder | SUS410 (Fe-13% Cr) powder | Component ratio of iron-based sintered alloy (mass %) $SrCO_3$ | Cr | C | Fe and inevitable impurities | Number of piercing (times) | Remarks |
|---|---|---|---|---|---|---|---|---|---|---|
| Product of the present invention | 295 | 0.5 (1 μm) | 0.15 | balance | 0.49 | 12.8 | 0.1 | balance | 147 | — |
| Comparative products | 85 | 0.02* (40 μm*) | 0.15 | balance | 0.01* | 12.8 | 0.1 | balance | 7 | — |
| | 86 | 3.5* (0.01 μm*) | 0.15 | balance | 3.47* | 12.8 | 0.1 | balance | 106 | decrease in strength |

The symbol * means the value which is not within the scope of the present invention.

As is apparent from the results shown in Table 43, the number of piercing of the cylindrical sintered alloy block for piercing test made of the sintered alloy 295 of the present invention is larger than that of the cylindrical sintered alloy block for piercing test made of the conventional sintered alloy 49 shown in 21 and therefore the sintered alloy of the present invention is excellent in machinability. However, the comparative sintered alloy 85 containing $SrCO_3$ in the content of less than the range defined in the present invention is inferior in machinability because of small number of piercing, while the comparative sintered alloy 86 containing $SrCO_3$ in the content of more than the range defined in the present invention is excellent in machinability because of large number of piercing, but shows drastically decreased deflection strength, and therefore it is not preferred.

EXAMPLE 44

As raw powders, a $SrCO_3$ powder having an average particle size of 1 μm and a SUS630 (Fe-17% Cr-4% Ni-4% Cu-0.3% Nb) powder having an average particle size of 80 μm were prepared. These raw powders were blended according to the formulation shown in Table 44, mixed in a double corn mixer and compacted to obtain a green compact, and then the resulting green compact was sintered in a vacuum atmosphere at 0.1 Pa under the conditions of a temperature of 1200° C. and a retention time of 60 minutes to obtain an iron-based sintered alloy 296 of the present invention and comparative sintered alloys 87 to 88.

Cylindrical sintered alloy blocks for piercing test each having a diameter of 30 mm and a height of 10 mm, made of the sintered alloy 296 of the present invention and the comparative sintered alloys 87 to 88 were produced and these cylindrical sintered alloy blocks for piercing test were repeatedly pierced until the drill is damaged, using a high-speed steel drill having a diameter of 1.2 mm, under the following conditions:

Rotating speed: 5000 rpm
Feed speed: 0.006 mm/rev.
Cutting oil: none (dry).

The number of piercing (maximum number of piercing, lifetime) of one new drill was measured. The results are shown in Table 44. Machinability was evaluated by the results.

TABLE 44

| | | Component ratio of raw powder (mass %) | | Component ratio of iron-based sintered alloy (mass %) | | | | | | | |
|---|---|---|---|---|---|---|---|---|---|---|---|
| Iron-based sintered alloy | | $SrCO_3$ powder Average particle size is described in parenthesis. | #SUS630 powder | $SrCO_3$ | Cr | Ni | Cu | Nb | Fe and inevitable impurities | Number of piercing (times) | Remarks |
| Product of the present invention | 296 | 0.5 (1 μm) | balance | 0.45 | 16.8 | 4.1 | 4 | 0.3 | balance | 143 | — |
| Comparative products | 87 | 0.02* (40 μm*) | balance | 0.01* | 16.8 | 4.1 | 4 | 0.3 | balance | 13 | — |
| | 88 | 3.5* (0.01 μm*) | balance | 3.43* | 16.8 | 4.1 | 4 | 0.3 | balance | 108 | decrease in strength |

#SUS630 (Fe-17% Cr-4% Ni-4% Cu-0.3% Nb)
The symbol * means the value which is not within the scope of the present invention.

As is apparent from the results shown in Table 44, the number of piercing of the cylindrical sintered alloy block for piercing test made of the sintered alloy 296 of the present invention is larger than that of the cylindrical sintered alloy block for piercing test made of the conventional sintered alloy 50 shown in 22 and therefore the sintered alloy of the present invention is excellent in machinability. However, the comparative sintered alloy 87 containing $SrCO_3$ in the content of less than the range defined in the present invention is inferior in machinability because of small number of piercing, while the comparative sintered alloy 88 containing $SrCO_3$ in the content of more than the range defined in the present invention is excellent in machinability because of large number of piercing, but shows drastically decreased deflection strength, and therefore it is not preferred.

INDUSTRIAL APPLICABILITY

The iron-based sintered alloy containing a machinability improving component comprising $CaCO_3$ and the iron-based sintered alloy containing a machinability improving component comprising $SrCO_3$ according to the present invention are excellent in machinability. Therefore, in various electric and machine components made of the iron-based sintered alloys of the present invention, the cost of machining such as piercing, cutting or grinding can be reduced. Thus, the present invention can contribute largely toward the development of mechanical industry by providing various machine components, which require dimensional accuracy, at low cost.

The invention claimed is:

1. An iron-based sintered alloy having excellent machinability, consisting of 0.05 to 3% by mass of calcium carbonate, 15 to 27% by mass of Cr and 3 to 29% by mass of Ni, the balance being Fe and inevitable impurities.

2. An iron-based sintered alloy having excellent machinability, consisting of 0.05 to 3% by mass of calcium carbonate, 14 to 19% by mass of Cr and 2 to 8% by mass of Ni, the balance being Fe and inevitable impurities.

3. The iron-based sintered alloy having excellent machinability according to claim 1, wherein the calcium carbonate is dispersed at grain boundaries in a in a matrix of the iron-based sintered alloy.

4. A method for preparing the iron-based sintered alloy having excellent machinability according to claim 1, comprising the steps of:

compacting a raw powder mixture containing metal powders of Fe, Cr and Ni, and 0.05 to 3% by mass of a calcium carbonate powder to obtain a green compact, the calcium carbonate powder having an average particle size of 0.1 to 30 μm as a raw powder; and sintering the resulting green compact in a nonoxidizing gas atmosphere.

5. The iron-based sintered alloy having excellent machinability according to claim 2, wherein the calcium carbonate is dispersed at grain boundaries in a matrix of the iron-based sintered alloy.

6. A method for preparing the iron-based sintered alloy having excellent machinability according to claim 2, comprising the steps of:

a raw powder mixture containing metal powders of Fe, Cr and Ni, and 0.05 to 3% by mass of a calcium carbonate powder to obtain a green compact, the calcium carbonate powder having an average particle size of 0.1 to 30 μm as a raw powder; and sintering the resulting green compact in a nonoxidizing gas atmosphere.

* * * * *

UNITED STATES PATENT AND TRADEMARK OFFICE

CERTIFICATE OF CORRECTION

PATENT NO. : 7,578,866 B2
APPLICATION NO. : 10/548677
DATED : August 25, 2009
INVENTOR(S) : Kinya Kawase et al.

It is certified that error appears in the above-identified patent and that said Letters Patent is hereby corrected as shown below:

On the Title page of the patent, under Assignee's address, please delete "Nigata" and insert -- Niigata -- therefor.

Signed and Sealed this

Tenth Day of November, 2009

David J. Kappos

David J. Kappos
*Director of the United States Patent and Trademark Office*